US011339625B2

(12) United States Patent
Brown et al.

(10) Patent No.: US 11,339,625 B2
(45) Date of Patent: May 24, 2022

(54) SELF-INFLATING HIGH EXPANSION SEAL

(71) Applicant: Schlumberger Technology Corporation, Sugar Land, TX (US)

(72) Inventors: Gareth Brown, Aberdeen (GB); Oliver Fry, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/101,283

(22) Filed: Nov. 23, 2020

(65) Prior Publication Data

US 2021/0071496 A1 Mar. 11, 2021

Related U.S. Application Data

(63) Continuation-in-part of application No. PCT/US2020/040735, filed on Jul. 2, 2020, and a (Continued)

(51) Int. Cl.
*E21B 33/1295* (2006.01)
*E21B 33/12* (2006.01)

(Continued)

(52) U.S. Cl.
CPC ..... *E21B 33/1295* (2013.01); *E21B 33/1208* (2013.01); *E21B 33/1294* (2013.01); *E21B 33/134* (2013.01)

(58) Field of Classification Search
CPC .. E21B 33/12; E21B 33/1208; E21B 33/1216; E21B 33/134; E21B 33/1291;

(Continued)

(56) References Cited

U.S. PATENT DOCUMENTS 2,701,615 A 2/1955 Riordan, Jr.
3,572,627 A 3/1971 Jones (Continued)

FOREIGN PATENT DOCUMENTS

GB 2559109 A * 8/2018 ..... E21B 33/1208
WO 2010032152 A1 3/2010

(Continued)

OTHER PUBLICATIONS

International Search Report and Written Opinion issued in PCT Application PCT/US2020/040735, dated Oct. 20, 2020 (12 pages).

(Continued)

*Primary Examiner* — David Carroll
(74) *Attorney, Agent, or Firm* — Ashley E. Brown

(57) ABSTRACT

Embodiments described herein provide a downhole tool (e.g., a retrievable bridge plug) that includes a sealing device and a load retention/equalization mechanism. The sealing device includes an elastomer seal component and an expansion device configured to radially expand outwardly to compress the elastomer seal component against a wellbore casing within which the downhole tool is located. The sealing device further includes lower and upper support barriers configured to radially expand outwardly against the wellbore. The sealing device also includes a seal energizing spring configured to maintain an initial setting force of the elastomer seal component against the wellbore casing. The load retention/equalization mechanism includes a spool/inflation valve configured to direct fluid into an internal volume to inflate the elastomer seal component radially outwardly based on a differential pressure between a first volume uphole relative to the downhole tool and a second volume downhole relative to the downhole tool.

20 Claims, 49 Drawing Sheets

Related U.S. Application Data continuation-in-part of application No. PCT/US2020/040732, filed on Jul. 2, 2020.

(60) Provisional application No. 62/908,213, filed on Sep. 30, 2019, provisional application No. 62/908,104, filed on Sep. 30, 2019, provisional application No. 62/908,157, filed on Sep. 30, 2019, provisional application No. 62/908,237, filed on Sep. 30, 2019, provisional application No. 62/869,773, filed on Jul. 2, 2019.

(51) Int. Cl.
*E21B 33/129* (2006.01)
*E21B 33/134* (2006.01)

(58) Field of Classification Search
CPC ..... E21B 33/1292; E21B 33/1293; E21B 33/1294; E21B 33/1295; E21B 33/1212
See application file for complete search history.

(56) References Cited

U.S. PATENT DOCUMENTS

| | | | | |
|---|---|---|---|---|
| 3,872,925 | A * | 3/1975 | Owen | E21B 23/065 166/286 |
| 3,915,424 | A | 10/1975 | LeRouax | |
| 4,892,144 | A * | 1/1990 | Coone | E21B 33/1277 166/122 |
| 6,598,672 | B2 | 7/2003 | Bell et al. | |
| 7,290,603 | B2 | 11/2007 | Hiorth et al. | |
| 7,921,921 | B2 | 4/2011 | Bishop et al. | |
| 8,083,001 | B2 | 12/2011 | Conner et al. | |
| 8,167,033 | B2 | 5/2012 | White | |
| 2002/0092654 | A1* | 7/2002 | Coronado | E21B 43/105 166/369 |
| 2004/0194969 | A1 | 10/2004 | Hiorth et al. | |
| 2013/0319654 | A1 | 12/2013 | Hiorth et al. | |
| 2014/0144625 | A1* | 5/2014 | Corre | E21B 49/08 166/264 |
| 2015/0275618 | A1 | 10/2015 | Clemens et al. | |
| 2016/0298414 | A1 | 10/2016 | Stæhr et al. | |
| 2017/0218710 | A1* | 8/2017 | Zhou | E21B 21/103 |
| 2019/0323316 | A1* | 10/2019 | Brown | E21B 33/1208 |
| 2019/0352997 | A1 | 11/2019 | Brown | |

FOREIGN PATENT DOCUMENTS

| | | | |
|---|---|---|---|
| WO | 2018087553 | A1 | 5/2018 |
| WO | 2018186869 | A1 | 10/2018 |
| WO | 2021003412 | A1 | 1/2021 |
| WO | 2021003415 | A1 | 1/2021 |

OTHER PUBLICATIONS

International Search Report and Written Opinion issued in PCT Application PCT/US2020/040732, dated Oct. 15, 2020 (15 pages).
International Search Report and Written Opinion issued in PCT Application PCT/US2021/057886, dated Feb. 23, 2022, 11 pages.

* cited by examiner

SELF-INFLATING HIGH EXPANSION SEAL

CROSS-REFERENCE TO RELATED APPLICATIONS

This application is a continuation-in-part of U.S. Provisional Patent Application No. 62/869,773, titled "Expanding and Collapsing Apparatus and Methods of Use," filed Jul. 2, 2019; U.S. Provisional Patent Application No. 62/908,104, titled "Expanding and Collapsing Apparatus Having Interlocking Features," filed Sep. 30, 2019; U.S. Provisional Patent Application No. 62/908,157, titled "Expanding and Collapsing Apparatus Having Wedge Features," filed Sep. 30, 2019; U.S. Provisional Patent Application No. 62/908,213, titled "Expanding and Collapsing Apparatus with Seal Pressure Equalization," filed Sep. 30, 2019; U.S. Provisional Patent Application No. 62/908,237, titled "Expanding and Collapsing Apparatus with Elastomer Sealing," filed Sep. 30, 2019; PCT Application No. PCT/US20/40732, titled "Expanding and Collapsing Apparatus and Methods of Use," filed Jul. 2, 2020; and PCT Application No. PCT/US20/40735, titled "Expanding and Collapsing Apparatus with Seal Pressure Equalization," filed Jul. 2, 2020, which are incorporated by reference herein in their entireties for all purposes.

BACKGROUND

The present disclosure generally relates to systems and methods for creating self-inflating seals using expanding and collapsing apparatus for use in oilfield devices including, but not limited to, anti-extrusion rings, plugs, packers, locks, patching tools, connection systems, and variable diameter tools run in a wellbore.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many fields of mechanical engineering, and in the field of hydrocarbon exploration and production in particular, it is known to provide expansion mechanisms for the physical interaction of tubular components. Expansion mechanisms may expand outwardly to engage an external surface or may collapse inwardly to engage an internal surface. Applications are many and varied, but in hydrocarbon exploration and production, applications may include the actuation and setting of flow barriers and seal elements such as plugs and packers, anchoring and positioning tools such as wellbore anchors, casing and liner hangers, and locking mechanisms for setting equipment downhole. Other applications include providing anti-extrusion, mechanical support or back up for elements such as elastomers or inflatable bladders. For example, a typical anti-extrusion ring is positioned between a packer or seal element and its actuating slip members, and is formed from a split or segmented metallic ring. During deployment of the packer or seal element, the segments move to a radially expanded condition. During expansion and at the radially expanded condition, spaces are formed between the segments, as they are required to occupy a larger annular volume. These spaces create extrusion gaps, which may result in failure of the packer or seal under working conditions.

Various configurations have been proposed to minimize the effect of spaces between anti-extrusion segments, including providing multi-layered rings, such that extrusion gaps are blocked by an offset arrangement of segments. For example, U.S. Pat. No. 6,598,672 describes an anti-extrusion ring for a packer assembly, which has first and second ring portions that are circumferentially offset to create gaps in circumferentially offset locations. U.S. Pat. No. 2,701,615 discloses a well packer comprising an arrangement of crowned spring metal elements, which are expanded by relative movement. Other proposals, for example those disclosed in U.S. Pat. Nos. 3,572,627, 7,921,921, U.S. Patent Application Publication No. 2013/0319654, U.S. Pat. Nos. 7,290,603, and 8,167,033 include arrangements of circumferentially lapped segments. U.S. Pat. No. 3,915,424 describes a similar arrangement in a drilling BOP configuration, in which overlapping anti-extrusion members are actuated by a radial force to move radially and circumferentially to a collapsed position, which supports annular sealing elements. Such arrangements avoid introducing extrusion gaps during expansion, but create a ring with uneven or stepped faces or flanks. These configurations do not provide an unbroken support wall for a sealing element, are spatially inefficient, and may be difficult to reliably move back to their collapsed configurations. U.S. Pat. No. 8,083,001 proposes an alternative configuration in which two sets of wedge-shaped segments are brought together by sliding axially with respect to one another to create an expanded gauge ring. Applications of existing expanding and collapsing apparatus are limited by the expansion ratios that can be achieved. In anchoring, positioning, setting, locking and connection applications, radially expanding and collapsing structures are typically circumferentially distributed at discrete locations when at their increased outer diameter. This reduces the surface area available to contact an auxiliary engagement surface and, therefore, limits the maximum force and pressure rating for a given size of device.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes running a downhole tool into a wellbore formed by a wellbore casing, wherein the downhole tool includes a sealing device and a load retention/equalization mechanism. The method also includes outwardly radially expanding lower support barriers of the sealing device against the wellbore casing. The method further includes outwardly radially expanding an expansion device of the sealing device to compress an elastomer seal component of the sealing device against the wellbore casing. The method also includes using a seal energizing spring of the sealing device to maintain an initial setting force of the elastomer seal component against the wellbore casing. The method further includes outwardly radially expanding upper support barriers of the sealing device against the wellbore casing. The method also includes using a spool/inflation valve of the load retention/equalization mechanism to direct fluid into an internal volume within the expansion device to inflate the elastomer seal component radially outwardly to create a main setting force of the elastomer seal component against the wellbore casing, wherein the spool/inflation valve directs the fluid into the internal volume based on a differential pressure between a first volume uphole relative to the downhole tool and a second volume downhole relative to the downhole tool.

Other embodiments of the present disclosure include a downhole tool that includes a sealing device and a load retention/equalization mechanism. The sealing device includes an elastomer seal component. The sealing device also includes an expansion device configured to radially expand outwardly to compress the elastomer seal component against a wellbore casing within which the downhole tool is located. The sealing device further includes lower and upper support barriers, each support barrier configured to radially expand outwardly against the wellbore, wherein the lower and upper support barriers are disposed on opposite axial ends of the expansion device. The sealing device also includes a seal energizing spring configured to maintain an initial setting force of the elastomer seal component against the wellbore casing. The load retention/equalization mechanism includes a spool/inflation valve configured to direct fluid into an internal volume within the expansion device to inflate the elastomer seal component radially outwardly to create a main setting force of the elastomer seal component against the wellbore casing, wherein the spool/inflation valve directs the fluid into the internal volume based on a differential pressure between a first volume uphole relative to the downhole tool and a second volume downhole relative to the downhole tool.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1A:
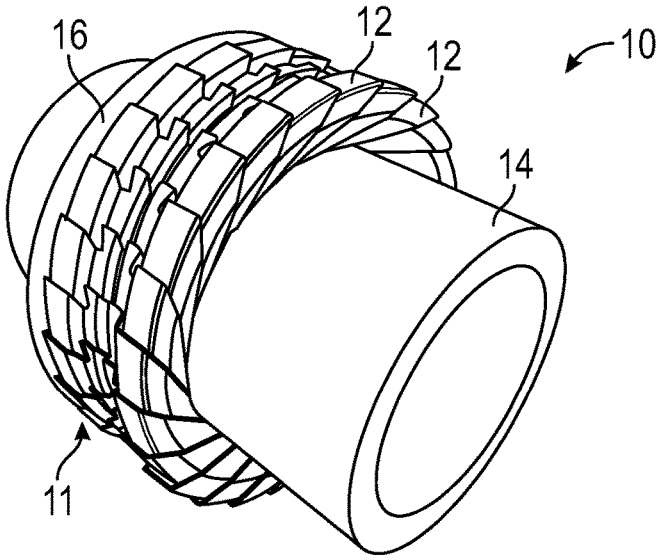
FIGS. 1A through 1D are respective perspective, first end, part sectional, and second end views of an apparatus shown in a collapsed condition, in accordance with embodiments of the present disclosure.

One or more specific embodiments of the present disclosure will be described below. These described embodiments are only examples of the presently disclosed techniques. Additionally, to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole," "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

The present disclosure generally relates to an expanding and collapsing apparatus for use in oilfield devices, including anti-extrusion rings, plugs, packers, locks, patching tools, connection systems, and variable diameter tools run in a wellbore. The embodiments described herein enable relatively high expansion applications. In addition, at an optimal expansion condition, the outer surfaces of the individual elements combine to form a complete circle with no gaps in between the individual elements and, therefore, the apparatus can be optimized for a specific diameter, to form a perfectly round expanded ring (within manufacturing tolerances) with no extrusion gaps on the inner or outer surfaces of the ring structure. The design of the expansion apparatus described herein also has the benefit that a degree of under expansion or over expansion (for example, to a slightly different radial position) does not introduce significantly large gaps. In addition, the elements described herein are mutually supported before, throughout, and after the expansion, and do not create gaps between the individual elements during expansion or at the fully expanded position. In addition, the arrangement of elements in a circumferential ring facilitates the provision of smooth side faces or flanks on the expanded ring structure. This enables use of the apparatus in close axial proximity to other functional elements, and/or as ramps or surfaces for deployment of other expanding structures. In addition, each of the ring structures described herein provides a smooth, unbroken circumferential surface, which may be used in engagement or anchoring applications, including in plugs, locks, and connectors. This may provide an increased anchoring force, or full abutment with upper and lower shoulders defined in a locking or latching profile, enabling tools or equipment be rated to a higher maximum working pressure.

In addition, the present disclosure generally relates to using an expanding and collapsing apparatus as part of a sealing device in a high expansion retrievable bridge plug, for example. The embodiments described herein solve an issue of forming a high expansion seal without excessively deforming, or even damaging, a sealing element (e.g., a rubber element) of the sealing device. In general, to deform the sealing element over such expansion ratios can make recovery of the sealing device relatively difficult. In addition, in certain situations, thin membranes that form a compressive seal against a casing are often not robust enough to survive relatively large differential pressures. In addition, in certain situations, the lack of an extrusion barrier provides a pressure and temperature limit.

The embodiments described herein enable the formation of a relatively high-pressure inflatable seal without the requirement to pump into the sealing device to inflate the sealing device. Rather, by using an expanding and collapsing apparatus, as described in greater detail herein, to form an initial seal, differential well pressure may be used to inflate a sealing membrane. The sealing membrane is then able to hold in burst against supporting segments of the expanding and collapsing apparatus. In this manner, the initial seal against the casing is not required to hold the full differential pressure. Rather, the initial seal against the casing is only required to hold the inflation pressure of the rubber membrane. In this manner, a high expansion seal may be formed that does not require relatively high compressive loads to hold a differential pressure, has a satisfactory extrusion barrier that is unrelated to the sealing device, and does not require plastic deformation of the sealing membrane, thereby aiding recovery of the sealing device and reducing the chance of damage during setting.

Referring first to FIGS. 1A through 4F, the principles of the embodiments of the present disclosure will be described with reference to an expanding apparatus 10 in the form of a simple ring. In this embodiment, the expanding apparatus 10 includes an expanding ring structure configured to be expanded from a first collapsed or unexpanded condition (shown in FIGS. 1A through 1D) and a second expanded condition (shown in FIGS. 2A through 2D). The apparatus 10 illustrated in these figures may be referred to as an "expanding apparatus" for convenience, as they are operable to move to an expanded state from a normal collapsed state. However, the apparatus 10 may equally be referred to as a "collapsing apparatus," an "expanding and collapsing apparatus," or an "expanding and/or collapsing apparatus," as they are capable of being expanded or collapsed, depending on operational state.

As illustrated, in certain embodiments, the expanding apparatus 10 includes a plurality of elements 12 assembled together to form a ring structure 11, which defines an inner ring surface, which is supported by an outer surface of a cylinder 14. In certain embodiments, each element 12 includes an inner surface 20, an outer surface 21, and first and second contact surfaces 22, 23. In certain embodiments, the first and second contact surfaces 22, 23 may be oriented in non-parallel planes, which are tangential to a circle centered on a longitudinal axis of the apparatus 10. In certain embodiments, the non-parallel orientation planes of the first and second contact surfaces 22, 23 converge towards the inner surface 20 of the element 12. Therefore, in certain embodiments, each element 12 may be in the general form of a wedge, and the wedges may be assembled together in a circumferentially overlapping fashion to form the ring structure 11. In operation, the first and second contact surfaces 22, 23 of adjacent elements 12 are mutually supportive.

Figure 3:
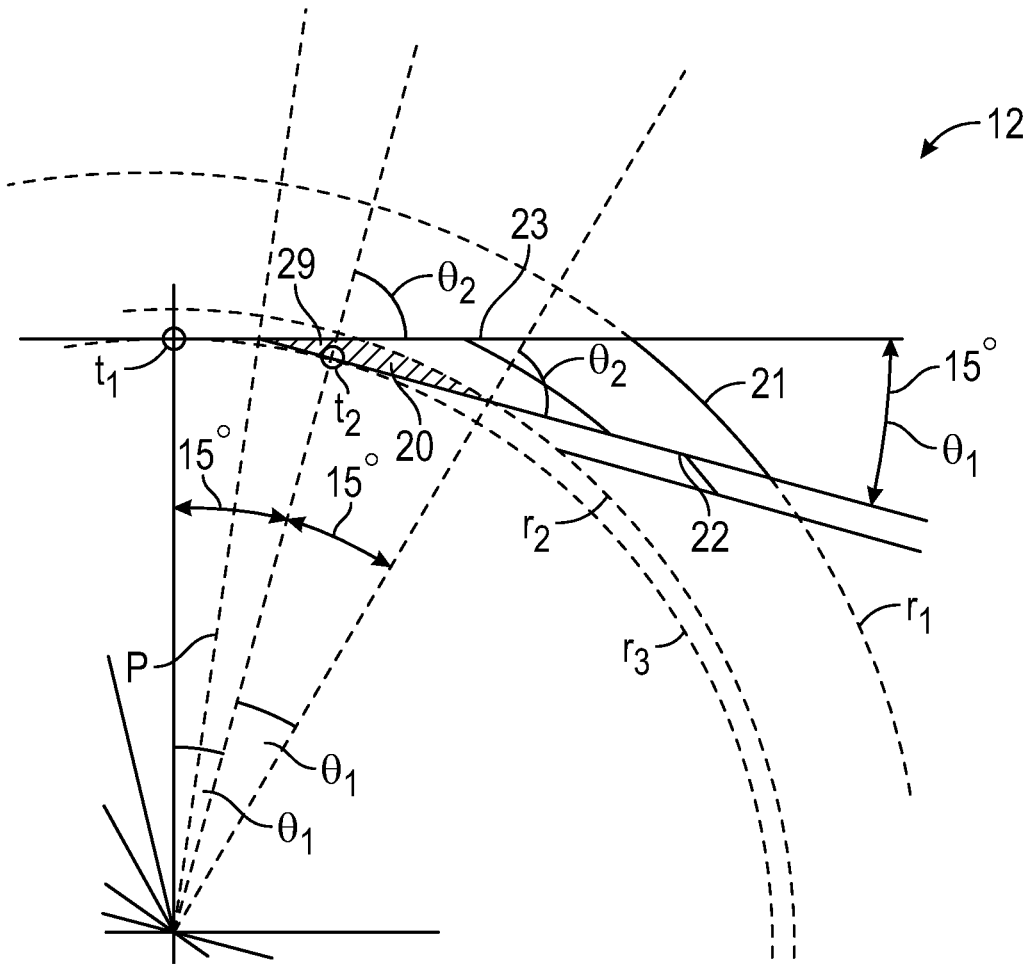
FIG. 3 is a geometric representation of an element of the apparatus of FIGS. 1A through 1D, shown from one side, in accordance with embodiments of the present disclosure.
Figure 4A:
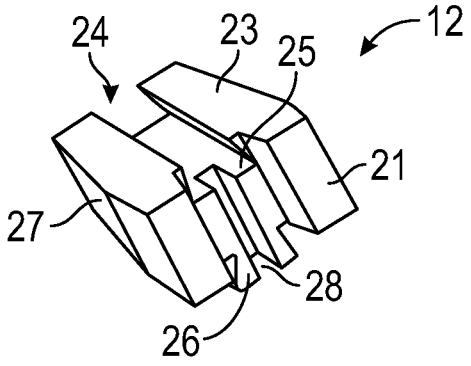
FIGS. 4A through 4F are respective first perspective, second perspective, plan, first end, lower, and second end views of an element of the apparatus of FIGS. 1A through 1D, in accordance with embodiments of the present disclosure.
Figure 4B:
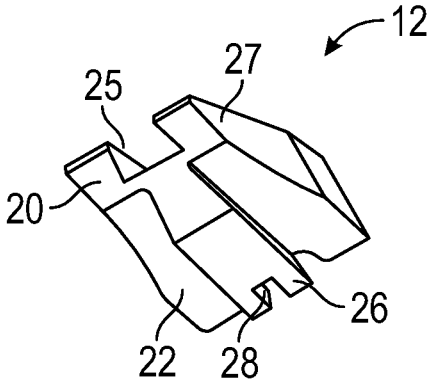
Figure 4C:
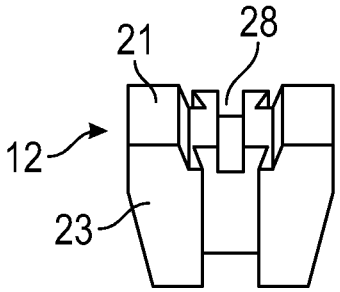
Figure 4D:
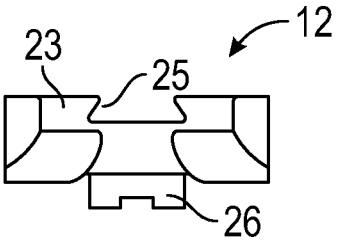
Figure 4E:
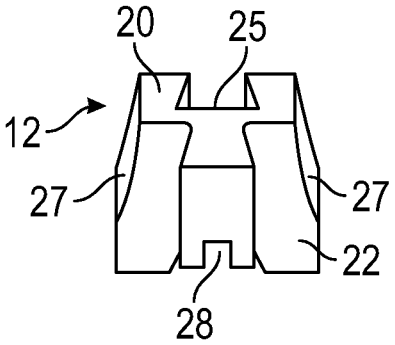
Figure 4F:
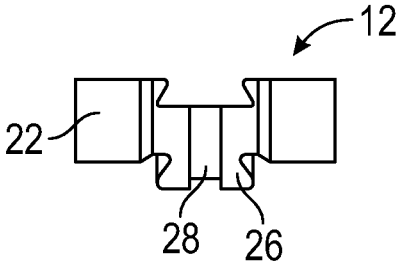

As illustrated in FIG. 3, when the ring structure 11 is expanded to its optimal outer diameter, the orientation planes of the first and second contact surfaces 22, 23 intersect an inner surface of the ring structure 11, and together with the longitudinal axis of the apparatus 10, the lines of intersection define a sector of a cylinder. In such embodiments, the ring structure 11 is formed from twenty-four identical elements 12, and the central angle $\theta_1$ is approximately 15 degrees. The angle described between the orientation planes of the first and second contact surface 22, 23 is the same as (e.g., within 2 degrees, within 1.5 degrees, within 1 degree, within 0.5 degree, or even closer, in certain embodiments) the central angle of the cylindrical sector, so that the elements 12 are arranged rotationally symmetrically in the structure 11.

As illustrated, in certain embodiments, each element 12 is based on a notional wedge-shaped segment of a ring centered on an axis, with each notional wedge-shaped segment being inclined with respect to the radial direction of the ring. In general, the nominal outer diameter of the segment is at the optimum expansion condition of the ring (with radius shown at $r_1$).

As illustrated, in certain embodiments, the orientation planes of the first and second contact surfaces 22, 23 of the element 12 are tangential to a circle with radius $r_3$ concentric with the ring at points $t_1$, $t_2$. The angle described between the tangent points is equal to the angle $\theta_1$ of the segment. The orientation planes of the first and second contact surfaces 22, 23 of each notional wedge-shaped segment intersect one another on a radial plane P, which bisects radial planes located at the tangent points (i.e., is at an angle of $\theta_1/2$ to both). This intersection plane P defines the expanding and collapsing path of the segment.

Figure 1B:
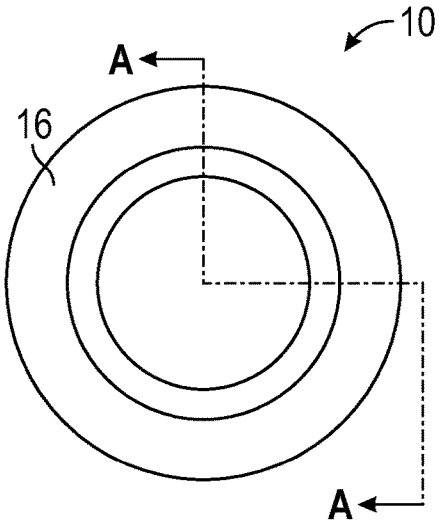
Figure 1C:
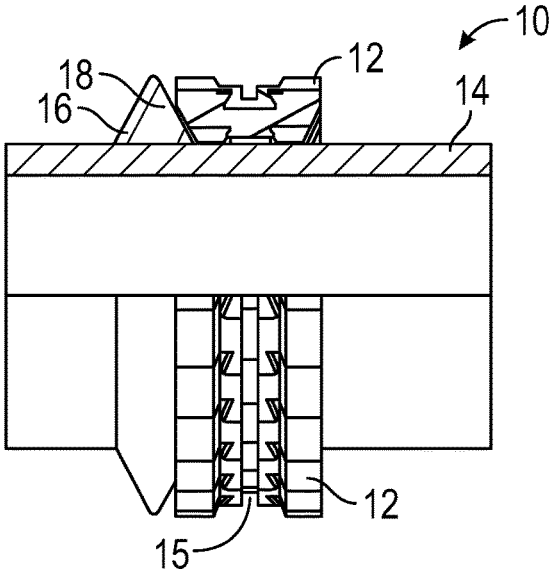
Figure 1D:
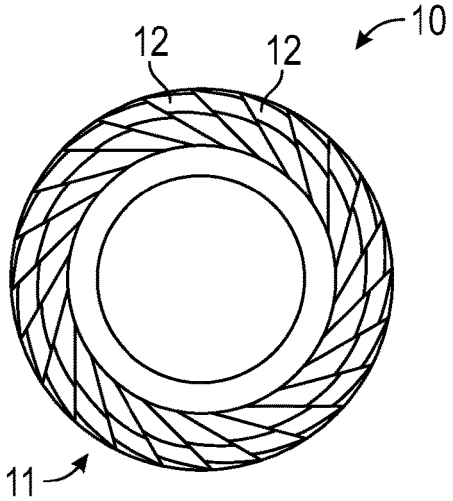
Figure 2A:
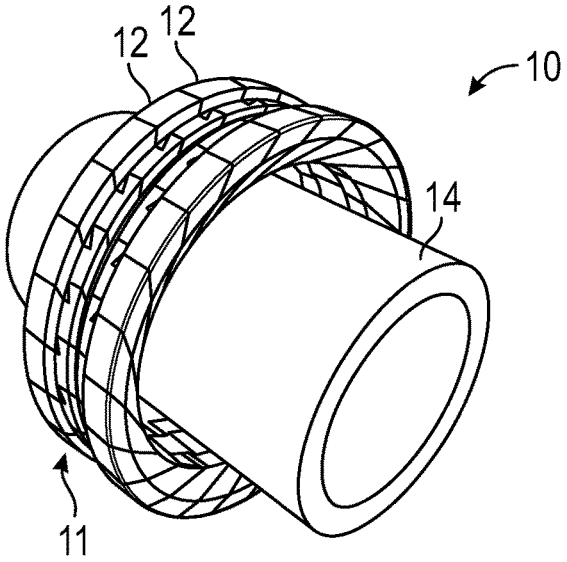
FIGS. 2A through 2D are respective perspective, first side, part sectional, and second side views of the apparatus of FIGS. 1A through 1D, shown in an expanded condition, in accordance with embodiments of the present disclosure.
Figure 2B:
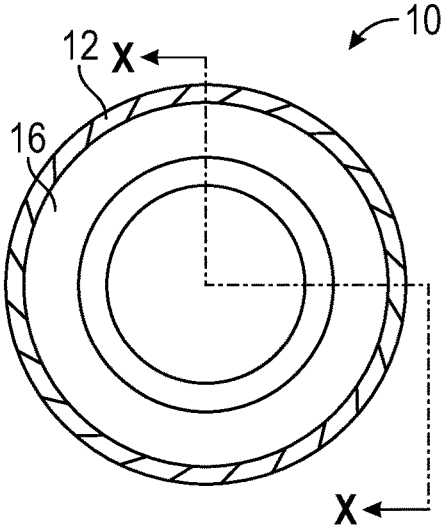
Figure 2C:
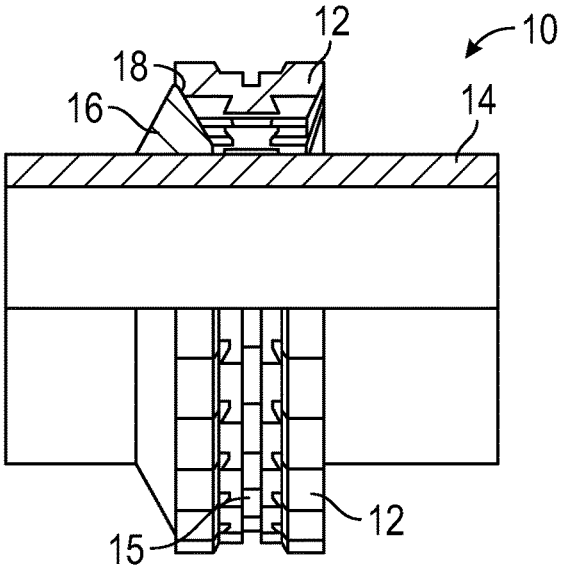
Figure 2D:
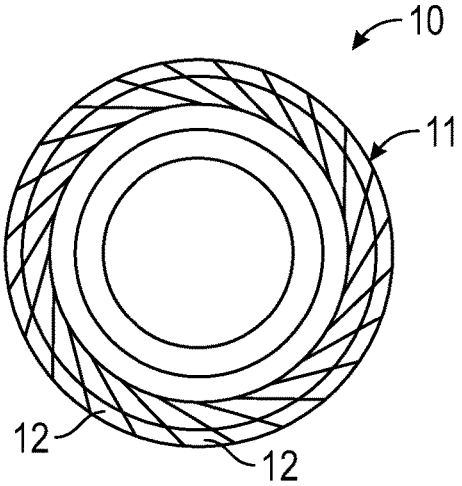

In the configuration shown in FIGS. 1A through 2D, notional wedge-shaped segments are modified by removal of tips 29 of the wedges, to provide a curved or arced inner surface 20 with radius ¾ when the ring is in its expanded condition, as illustrated in FIGS. 2A and 2D. The modification of the wedge-shaped elements 12 may be thought of as an increase in diameter of an internal bore through the ring structure by $2(r_2-r_3)$, or a truncation of the inner diameter. This change in the inner diameter from the notional inner diameter $r_3$ to which the contact surfaces 22, 23 are tangential to a truncated inner diameter has the effect of changing an angle between the contact surfaces 22, 23 and the radial plane from the center of the ring. Taking angle $\theta_2$ to be an angle described between the contact surface 22, 23 and a radial plane defined between the center point of the ring structure and the point at which the orientation surface 22, 23 meets or intersects a circle at the radial position of the inner surface 20, $\theta_2$ may be changed in dependence on the amount by which the segment has its inner diameter truncated. For the notional wedge shaped segment, the orientation planes of the contact surfaces 22, 23 are tangential to a circle at the inner diameter at (i.e., angle $\theta_2$ is approximately 90 degrees). For the modified elements 12, the orientation planes of the contact surfaces 22, 23, instead, intersect a circle at the (increased) inner diameter, and are inclined at a reduced angle $\theta_2$.

In certain embodiments, the angle $\theta_2$ at which the segment is inclined is related to the amount of material removed from the notional wedge-shaped segment, but is independent from the central angle $\theta_1$ of the wedge. Angle $\theta_2$ is selected to provide element dimensions suitable for manufacture, robustness, and fit within the desired annular volume and inner and outer diameters of the collapsed ring. As the angle $\theta_2$ approaches 90 degrees, a shallower, finer wedge profile is created by the element 12, which may enable optimization of the collapsed volume of the ring structure. Although a shallower, finer wedge profile may have the effect of reducing the size of the gaps created at the inner surface of the ring in the collapsed condition and/or enabling a more compact collapsed condition, there may be some consequences, including the introduction of flat sections at the inner surfaces 20 of the elements 12, which manifest as spaces at the inner diameter of the ring when in an expanded or partially expanded condition. When $\theta_2$ is 90 degrees and the segments are purely tangential to inner diameter, the collapsed volume for a given outer diameter and inner diameter is most efficient, but the inner surface of the ring structure is polygonal with flat sections created by each segment. However, these flat sections may be undesirable. There may also be potential difficulties with manufacture of the elements 12, and robustness of the elements 12 as well as the assembled ring structure 11. However, in many applications, where the profile of the inner surface of the expanded ring may not be critical, for example, when the inner diameter of the ring structure is floating and/or the true inner diameter is defined by an actuation wedge profile rather than the inner surface of the ring, this compromise may not be detrimental to the operation of the apparatus 10, and the reduced collapse volume may justify an inclination angle $\theta_2$ of (or approximately) 90 degrees.

In the apparatus 10 illustrated in FIGS. 1A through 4F, the angle $\theta_2$ is approximately 75 degrees. Relaxing $\theta_2$ to a reduced angle would provide a smooth outer diameter and inner diameter profile to the expanded ring, as a portion of the inner circular arc may be retained at the expense of a slightly increased collapsed volume. It should be noted that the angle $\theta_2$ is independent from the angle $\theta_1$. Where the ring structure 11 is desired to have a circular inner surface, certain embodiments may have an angle $\theta_2$ that is in the range of (90 degrees-2 $\theta_1$) to 90 degrees inclusive, and certain embodiments may have an angle $\theta_2$ in the range of approximately 70 degrees to approximately 90 degrees (e.g., in a range of approximately 73 degrees to approximately 90 degrees, in certain embodiments). In general, to provide sufficient truncation of the inner diameter to retain a useful portion of an inner arc, and to provide a smooth inner surface to the ring structure 11, a maximum value for $\theta_2$ of (90 degrees$-\theta_1/2$) may be used. This would be approximately 82.5 degrees in the described embodiments.

In other embodiments, the geometry of the notional wedge-shaped segments forming the elements 12 may be unmodified (save for the provision of functional formations such as for interlocking and/or retention of the elements 12), without the removal of material from the tip 29 of the notional wedge-shaped segments. Such embodiments may be desirable when there is no requirement for the ring structure 11 to have a circular inner surface.

As illustrated in FIGS. 4A through 4F, the first and second contact surfaces 22, 23 of the element 12 may have corresponding interlocking profiles 24 formed therein, such that adjacent elements 12 may interlock with one another. In such embodiments, the interlocking profiles include a dovetail groove 25 and a corresponding dovetail tongue 26. The interlocking profiles 24 resist circumferential and/or radial separation of the elements 12 in the ring structure 11, but permit relative sliding motion between adjacent elements 12. The interlocking profiles 24 also facilitate smooth and uniform expansion and contraction of the elements 12 during use. It will be appreciated that alternative forms of interlocking profiles 24, for example, including recesses and protrusions of other shapes and forms, may be used within the scope of the present disclosure.

In certain embodiments, the elements 23 may also include inclined side wall portions 27, which may facilitate deployment of the apparatus 10 in use. In certain embodiments, the side wall portions 27 are formed in an inverted cone shape, which corresponds to the shape and curvature of the actuating cone wedge profiles when the apparatus 10 is in its maximum load condition (e.g., typically at its optimum expansion condition).

In certain embodiments, each element 12 may also be provided with a groove 28, and in the assembled ring structure, the grooves are aligned to provide a circular groove, which extends around the ring. The groove accommodates a biasing element (not shown), for example a spiral retaining ring of the type marketed by Smalley Steel Ring Company under the Spirolox brand, or a garter spring. In such embodiments, the biasing means may be located around the outer surface of the elements 12, to bias the apparatus 10 towards the collapsed condition, as shown in FIGS. 1A through 1D. Although one groove for accommodating a biasing means is illustrated in the figures, in other embodiments, multiple grooves and biasing means may instead be provided.

In certain embodiments, the apparatus 10 includes a wedge member 16, which in this case is an annular ring having a conical surface 18 opposing one side of the ring structure 11. The wedge angle corresponds with the angle of the inclined conical side walls 27 of the elements 12. A corresponding wedge shaped profile (not shown) may optionally be provided on the opposing side of the ring structure 11 to facilitate expansion of the ring elements 12. In other embodiments, this optional additional wedge may instead be substituted with an abutment shoulder.

Operation of the expansion apparatus 10 will now be described in more detail. In the first, collapsed or unexpanded condition, as illustrated in FIG. 1C, the elements 12 are assembled in a ring structure 11, which extends to a first outer diameter. In this configuration, and as illustrated in FIGS. 1B and 1C, the wedge member 16 defines the maximum outer diameter of the apparatus 10 in the first condition. In certain embodiments, the elements 12 are biased towards the unexpanded condition by a spiral retaining ring (not shown), and are supported on the inner surface by the outer surface of the cylinder 14.

In use, an axial actuation force is imparted on the wedge member 16. Any of a number of suitable means known in the art may be used for application of the axial actuation force, for example, the application of a force from an outer sleeve positioned around the cylinder 14. The force causes the wedge member 16 to move axially with respect to the cylinder 14, and to transfer a component of the axial force onto the recessed side wall of the elements 12. The angle of the wedge transfers a radial force component to the elements 12, which causes them to slide with respect to one another along their respective contact surfaces 22, 23.

The movement of the expanding elements 12 is tangential to a circle defined about the longitudinal axis of the apparatus 10. The contact surfaces 22, 23 of the elements 12 mutually support one another before, during, and after expansion. The radial position of the elements 12 increases on continued application of the axial actuation force until the elements 12 are located at a desired outer radial position. This radial position may be defined by a controlled and limited axial displacement of the wedge member, or alternatively may be determined by an inner surface of a bore or tubular within which the apparatus 10 is disposed.

FIGS. 2A through 2D show the apparatus 10 in its expanded condition. At an optimal expansion condition, shown in FIGS. 2B and 2D, the outer surfaces of the individual elements 12 combine to form a complete circle with no gaps in between the individual elements 12. The outer surface of the expansion apparatus 10 may be optimized for a specific diameter, to form a perfectly round expanded ring (within manufacturing tolerances) with no extrusion gaps on the inner or outer surfaces of the ring structure 11. The design of the expansion apparatus 10 also has the benefit that a degree of under expansion or over expansion (for example, to a slightly different radial position) does not introduce significantly large gaps.

It is a feature of the described embodiments that the elements 12 are mutually supported before, throughout, and after the expansion, and do not create gaps between the individual elements 12 during expansion or at the fully expanded position. In addition, the arrangement of elements 12 in a circumferential ring, and their movement in a plane perpendicular to the longitudinal axis, facilitates the provision of smooth side faces or flanks on the expanded ring structure 11. Furthermore, with deployment of the elements 12 in the plane of the ring structure 11, the overall width of the ring structure 11 does not change. This enables use of the apparatus 10 in close axial proximity to other functional elements.

The apparatus 10 has a range of applications, some of which are illustrated in the following example embodiments. However, additional applications of the apparatus 10 are possible, which exploit its ability to effectively perform one or more of blocking or sealing an annular path; contacting an auxiliary surface; gripping or anchoring against an auxiliary surface; locating or engaging with radially spaced profiles; and/or supporting a radially spaced component. The embodiments presented herein extend the principles described above to expanding apparatus 10 that include combinations of structural elements, ring elements, and combinations thereof, which have particular applications and advantages to systems in which an increased expansion ratio is desirable.

Figure 5A:
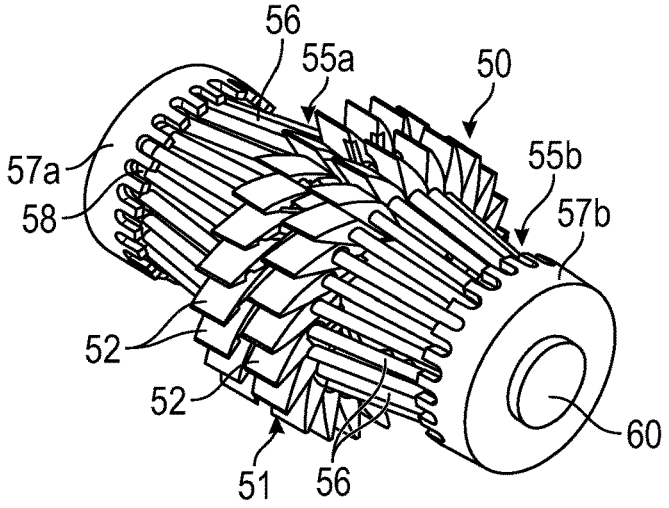
FIGS. 5A through 5C are respective isometric, side and end views of an apparatus in a collapsed condition, in accordance with embodiments of the present disclosure.
Figure 5B:
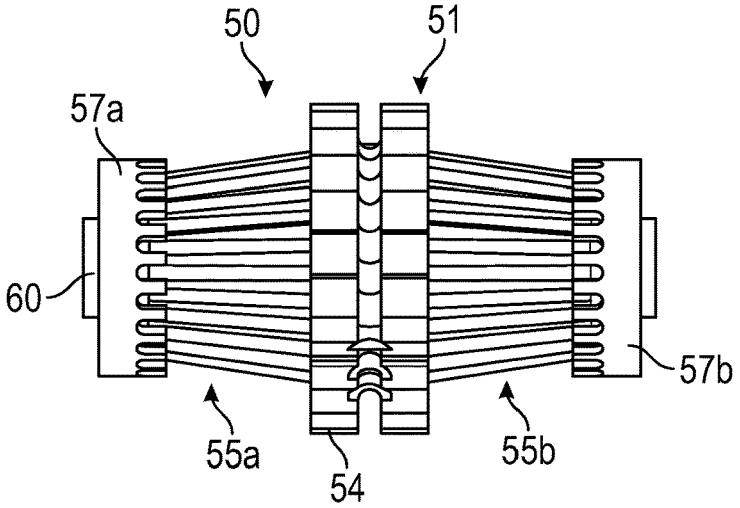
Figure 5C:
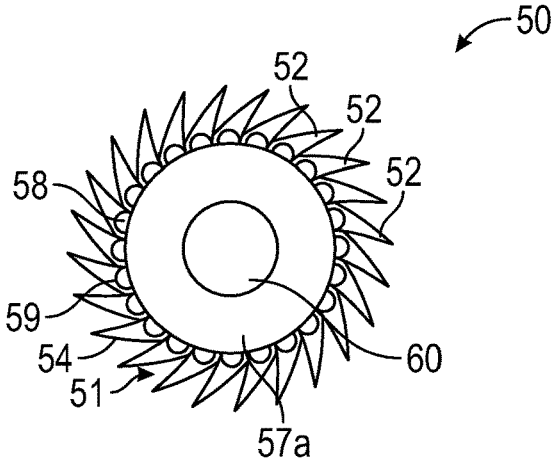
Figure 6A:
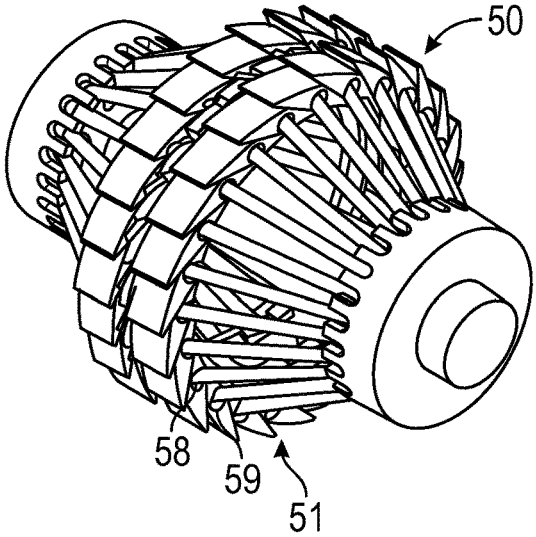
FIGS. 6A through 6C are respective isometric, side and end views of the apparatus of FIGS. 5A through 5C in a partially expanded condition, in accordance with embodiments of the present disclosure.
Figure 6B:
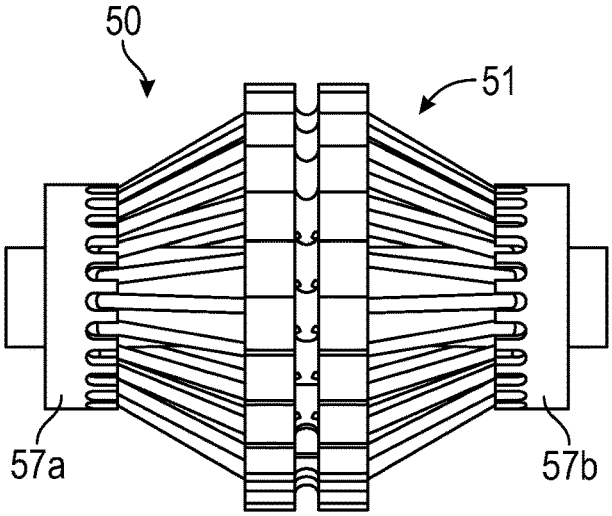
Figure 6C:
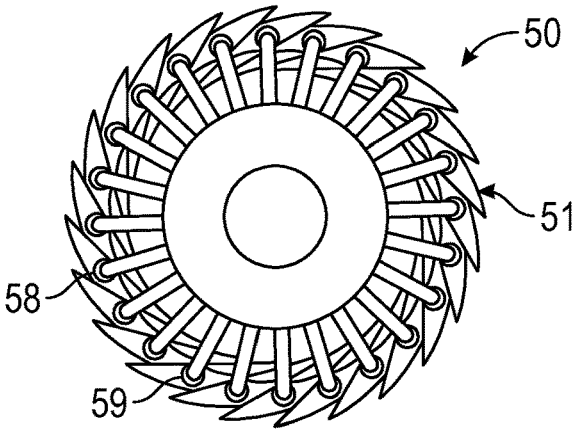
Figure 7A:
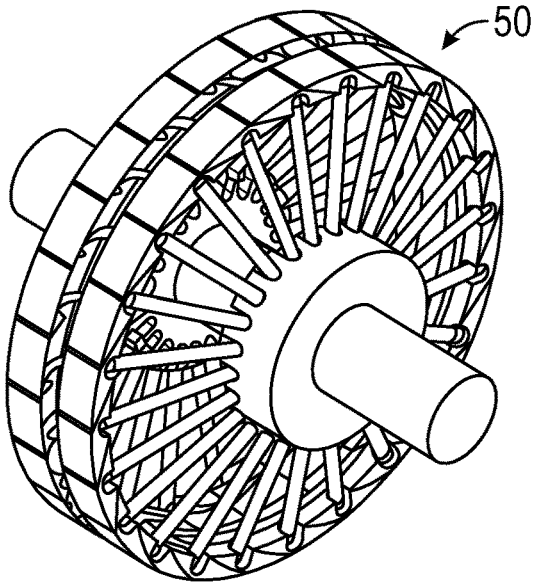
FIGS. 7A through 7C are respectively isometric side and end views of the apparatus of FIGS. 5A through 5C in a fully expanded condition, in accordance with embodiments of the present disclosure.
Figure 7B:
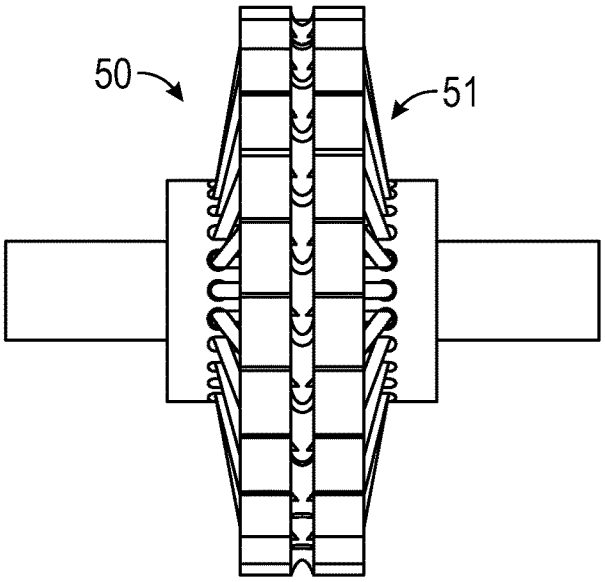
Figure 7C:
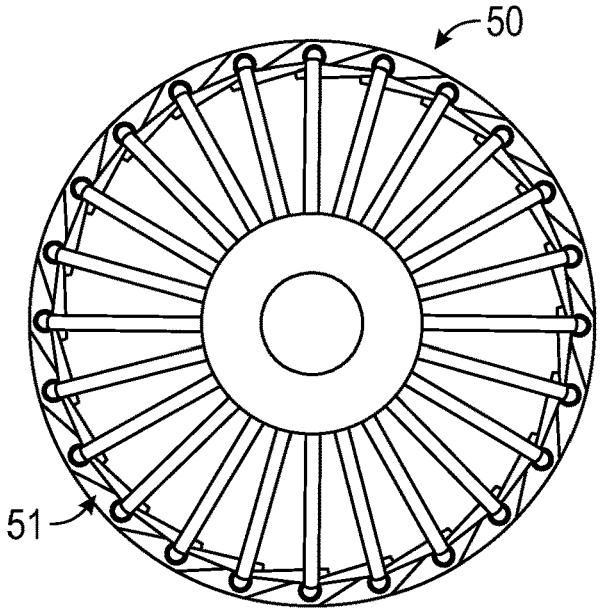
Figure 8:
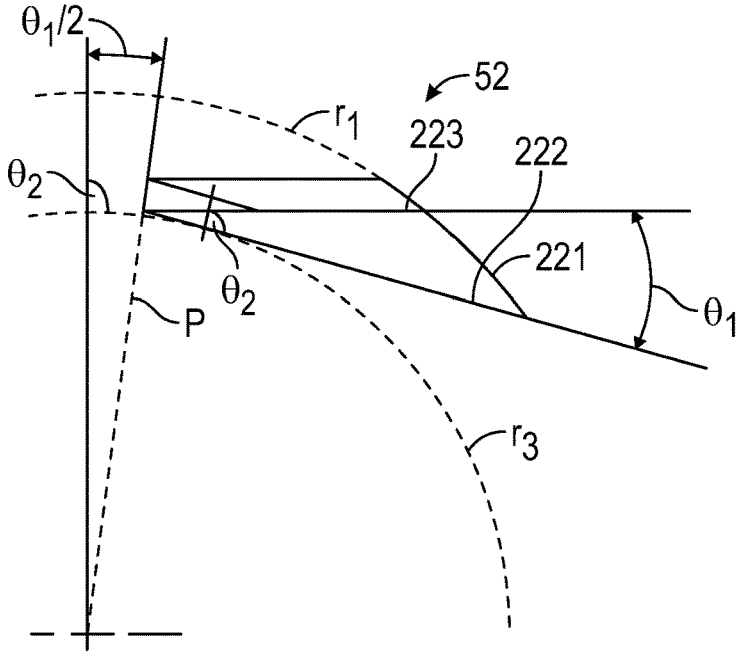
FIG. 8 is a geometric representation of an element of the apparatus of FIGS. 5A through 5C, shown from one side, in accordance with embodiments of the present disclosure.
Figure 9A:
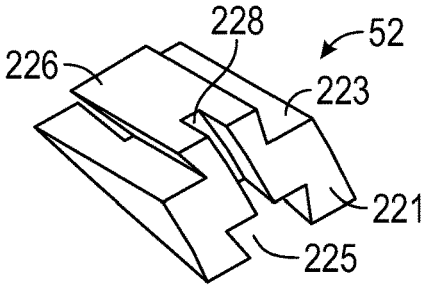
FIGS. 9A through 9F are respective first perspective, second perspective, plan, first end, lower, and second end views of an element of the apparatus of FIGS. 5A through 5C, in accordance with embodiments of the present disclosure.
Figure 9D:
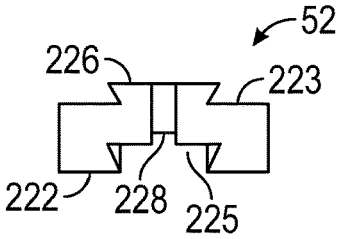
Figure 9B:
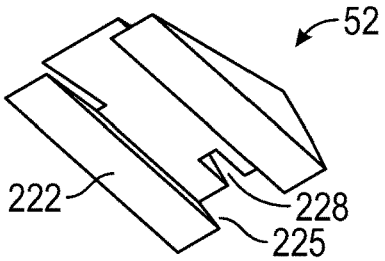
Figure 9E:
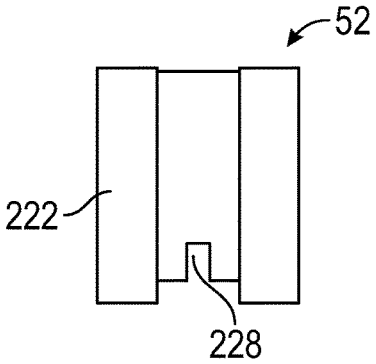
Figure 9C:
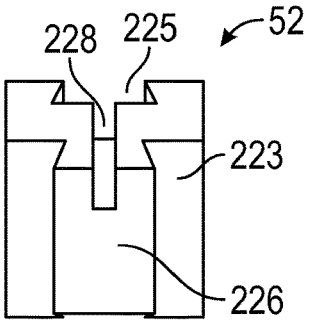
Figure 9F:
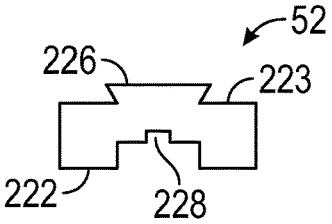

Referring now to FIGS. 5A through 7C, there is shown an expansion apparatus 50 in accordance with certain embodiments of the present disclosure. FIGS. 5A through 5C are respective isometric, side and end views of the apparatus 50 shown in a collapsed condition on a central mandrel 60. FIGS. 6A through 6C are corresponding views of the apparatus 50 in a partially expanded condition, and FIGS. 7A through 7C are corresponding views of the apparatus 50 in a fully expanded condition.

As illustrated, in certain embodiments, the apparatus 50 includes an expansion assembly 51 formed from a plurality of elements, including a set of ring elements 52 assembled together to form a centrally disposed ring structure 54, and two sets 55*a*, 55*b* of structural elements 56. The ring elements 52 are similar to the elements 12 described above, and their form and function will be understood from FIGS. 1A through 4F and their accompanying description. The ring elements 52 are shown in more detail in FIGS. 8 and 9A through 9F, and include inner and outer surfaces, first and second contact surfaces, interlocking profiles, and a groove for retaining a circumferential spring, which features are equivalent in form and function to the features of the elements 12 described above. In certain embodiments, a biasing means in the form of a circumferential spring (not shown) retains the center ring structure in its collapsed condition shown in FIGS. 5A through 5C.

The geometry of the individual ring elements 52 differs from the geometry of the ring elements 12 described above in that the ring elements 52 are based on a notional wedge-shaped segment, which is unmodified (save for the provision of functional formations such as for interlocking and/or retention of the elements) and without the removal of material from the tip of the notional wedge-shaped segments. These embodiments may be particularly desirable when there is no requirement for the ring structure to have a circular inner surface, as is the case with the "floating" ring structure of the apparatus 50.

As illustrated in FIGS. 8 and 9A through 9F, in certain embodiments, each element includes an outer surface 221 and first and second contact surfaces 222, 223. The first and second contact surfaces 222, 223 are oriented in non-parallel planes, which are tangential to a circle centered on the longitudinal axis of the apparatus 50 with radius $r_3$. The inner surface of the ring structure is defined at $r_3$ and, therefore, the orientation planes are fully tangential (and angle $\theta_2$ is approximately 90 degrees). The planes converge towards the inner surface of the ring element 52 to an intersection line on a radial plane P that bisects the radial planes at the tangent points (i.e., is at an angle of $\theta_1/2$ to both). This intersection plane P defines the expanding and collapsing path of the segment. Therefore, each ring element 52 is in the general form of a wedge, and the wedges are assembled together in a circumferentially overlapping fashion to form the ring structure 54. In use, the first and second contact surfaces 222, 223 of adjacent ring elements 52 are mutually supportive. In the illustrated embodiment, the ring structure 54 is formed from twenty-four identical ring elements 52, and the angle described between the first and second contact surfaces 222, 223 of each ring element 52 is approximately 15 degrees, so that the ring elements 52 are arranged rotationally symmetrically in the ring structure 54.

As illustrated in FIGS. 9A through 9F, in certain embodiments, the first and second contact surfaces 222, 223 of the ring element 52 may have corresponding interlocking profiles 224 formed therein, such that adjacent ring elements 52 may interlock with one another. In certain embodiments, the interlocking profiles 224 include a dovetail groove 225 and a corresponding dovetail tongue 226. The interlocking profiles 224 resist circumferential and/or radial separation of the ring elements 52 in the ring structure 54, but permit relative sliding motion between adjacent ring elements 52. The interlocking profiles 224 also facilitate smooth and uniform expansion and contraction of the ring elements 52 during use. The ring elements 52 differ from the elements 12 described above in that the tongue and groove are inverted, with the tongue of the ring element 52 on the (longer) contact surface 223. This facilitates increased contact between adjacent ring elements 52 throughout the expanding and contracted range. It will be appreciated that alternative forms of interlocking profiles 224, for example, including recesses and protrusions of other shapes and forms, may be used within the scope of the present embodiments.

In certain embodiments, each element may also be provided with a groove 228, and in the assembled ring structure 54, the grooves 228 may be aligned to provide a circular groove, which extends around the ring and may accommodate a biasing element (not shown), for example, a spiral retaining ring of the type marketed by Smalley Steel Ring Company under the Spirolox brand, or a garter spring. As such, the biasing means may be located around the outer surface of the ring elements 52, to bias the apparatus 50 towards the collapsed condition illustrated in FIGS. 5A through 5D. Although one groove 228 for accommodating a biasing means is provided in the illustrated embodiment, in other embodiments, multiple grooves and biasing means may be provided.

In certain embodiments, the structural elements 56 may be in the form of spokes or struts. First ends of each of the spokes 56 are connected to a respective retaining ring 57*a*, 57*b*, which each act as a base element. Each ring element 52 is connected to a pair of spokes 56, one from each of the respective sets 55*a*, 55*b*, at their second ends. In certain embodiments, the first and second ends are provided with balls or knuckles 58, which are received in respective sockets 59 (not shown in FIG. 8 or 9A through 9F for clarity of the geometry) in the retaining rings and ring elements 52 to create a pivoting and rotating connection. In a first, collapsed condition, the apparatus 50 has a first outer diameter, which is defined by the outer edges of the ring elements 52.

Operation of the apparatus 50 will now be described with additional reference to FIGS. 6A through 7C. In certain embodiments, the apparatus 50 may be actuated to be radially expanded to a second diameter by an axial actuation force, which acts on one or both of the retaining rings 57*a*, 57*b* to move one or both with respect to the mandrel 60. As such, the retaining rings 57*a*, 57*b* function as pusher rings for the apparatus 50. Any of several suitable means known in the art may be used for application of the axial actuation force, for example, the application of a force from an outer sleeve positioned around the cylinder. The axial actuation force acts through the sets of spokes 56 to impart axial and radial force components onto the ring elements 52. In certain embodiments, the pivot point between the ring elements 52 and the respective spokes 56 is set radially further out from the mandrel 60 than the pivot point between the retaining rings 57*a*, 57*b* and the spokes 56, thus ensuring that any compressive force on the end rings has a radial component to act radially on the ring element 52. Radial expansion of the ring structure 54 is initially resisted by the circumferential spring. When the force of the circumferential spring is overcome, the ring elements 52 of the center ring structure are moved radially outward from the collapsed position, towards the partially expanded condition shown in FIGS. 6A through 6C. As the ring structure 54 moves radially outward, the spokes 56 pivot with respect to the retaining rings 57*a*, 57*b* and the ring elements 52 to create a pair of substantially conical supports for the ring structure 54. The ring elements 52 slide tangentially with respect to one another to expand the center ring structure as the first ends of the spokes 56 are moved towards one another.

As the retaining rings 57*a*, 57*b* and sets of spokes 56 are brought towards the position shown in FIGS. 7A through 7C, the ring elements 52 slide with respect to one another into the radially expanded condition. The radial movement of the ring elements 52 of the outer rings is the same as the movement of the elements 12 described with reference to FIGS. 1A through 4F. For example, the ring elements 52 slide with respect to one another in a tangential direction, while remaining in mutually supportive planar contact. The interlocking arrangement of the ring elements 52 enables the apparatus 50 to move uniformly between the collapsed and expanded condition.

The resulting expanded condition is shown in FIGS. 7A through 7C. The apparatus 50 forms an expanded ring structure 54 that is solid, with no gaps between its ring elements 52, and that has a smooth circular outer surface at its fully expanded condition. The outer diameter of the expanded ring is significantly greater than the outer diameter of the ring structures in their collapsed state, with the increased expansion resulting from the combination of sets of structural elements 56 supporting the ring structure 54. The open structure of the conical support renders this embodiment particularly suitable for applications such as lightweight centralization, swaging applications, removable support structures, and/or adjustable drift tools.

Maintaining the axial force on the retaining rings 57*a*, 57*b* will keep the apparatus in an expanded condition, and a reduction in the axial force to separate the retaining rings 57*a*, 57*b* enables the ring structure 54 and sets of spokes 56 to collapse under the retention forces of the spring element. Collapsing of the apparatus 50 to a collapsed condition is, therefore, achieved by releasing the axial actuation force. Separation of the retaining rings 57*a*, 57*b* collapses the ring structure 54 under the retaining force of its biasing spring, back to the collapsed position shown in FIGS. 5A through 5C.

In addition, the connections between the spokes 56 and the ring elements 52, and the spokes 56 and the retaining rings 57*a*, 57*b* (which in certain embodiments may be ball and socket or knuckle and socket connections) are configured to enable the transfer of a tensile force. This enables a tension to be pulled between the retaining rings 57*a*, 57*b*, the structural elements 56 and the ring elements 52 (or vice versa). This axial interlocking of the spokes 56 and the ring elements 52 ties the components together longitudinally, and enables a tension to be pulled between the elements to retract the apparatus 50 towards or to its collapsed condition. Pulling a tension may facilitate collapsing of the apparatus 50 to its original outer diameter, in conjunction with the action of a biasing spring, or in alternative embodiments, the tensile force may be used to retract the apparatus 50 without the use of a biasing spring. The apparatus 50 may, therefore, be a passive device, with no default condition defined by a biasing means.

The combination of structural elements and the ring structure enables the provision of an expanding and collapsing apparatus 50 having the advantages of an expanded ring structure that is solid, with no gaps between its elements, and a smooth circular outer surface at its fully expanded condition, with increased maximum expansion ratios. The embodiments provide increased maximum expansion ratios with few additional moving parts and little increase in complexity over with the ring structure of FIGS. 1A through 4F.

Figure 10A:
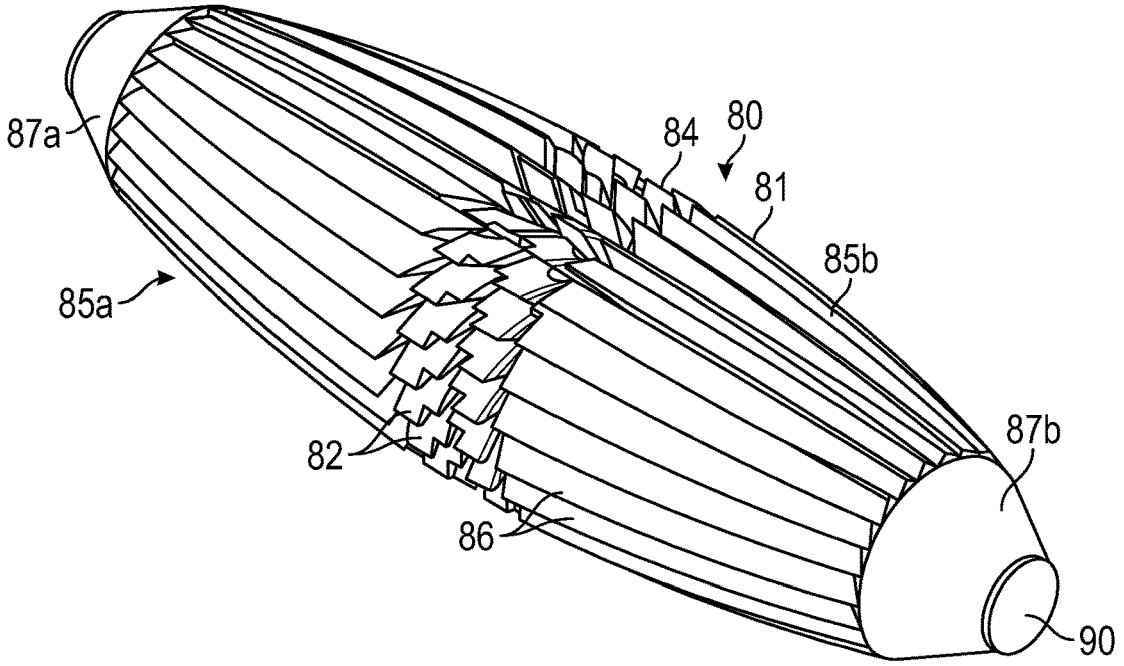
FIGS. 10A and 10B are respective isometric and longitudinal sectional views of an apparatus in a collapsed position, in accordance with embodiments of the present disclosure.
Figure 10B:
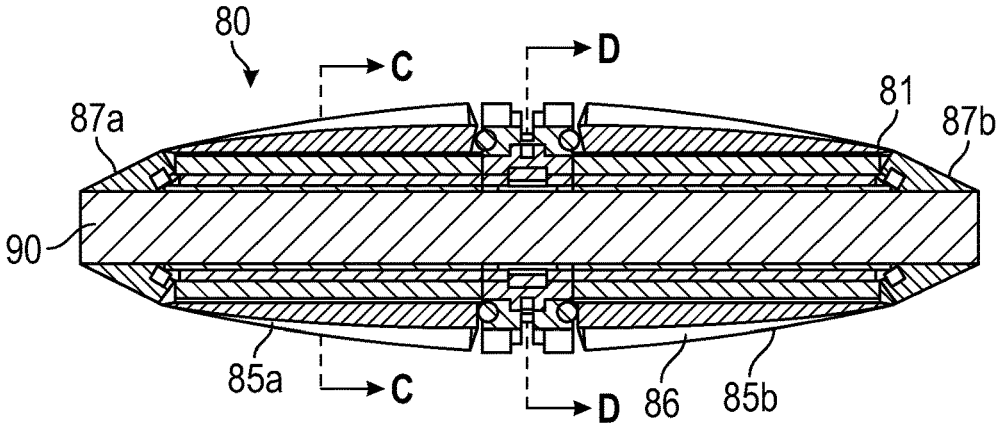
Figure 10C:
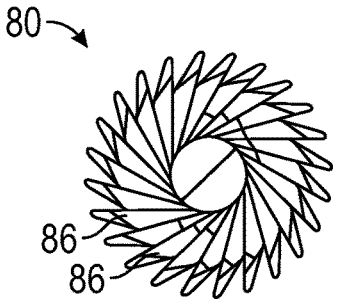
FIGS. 10C and 10D are respective cross-sectional views of the apparatus of FIGS. 10A and 10B through lines C-C and D-D, respectively, in accordance with embodiments of the present disclosure.
Figure 10D:
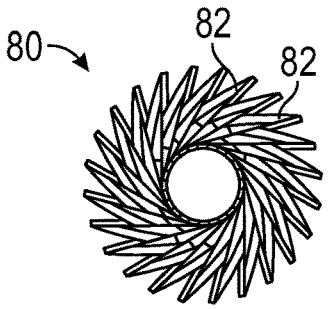
Figure 11A:
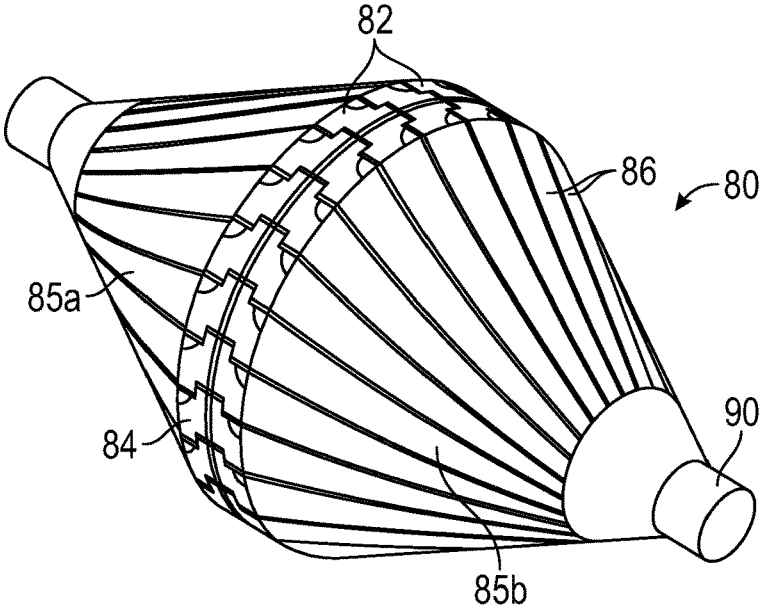
FIGS. 11A and 11B are respective isometric and longitudinal sectional views of the apparatus of FIGS. 10A through 10D in an expanded condition, in accordance with embodiments of the present disclosure.
Figure 11B:
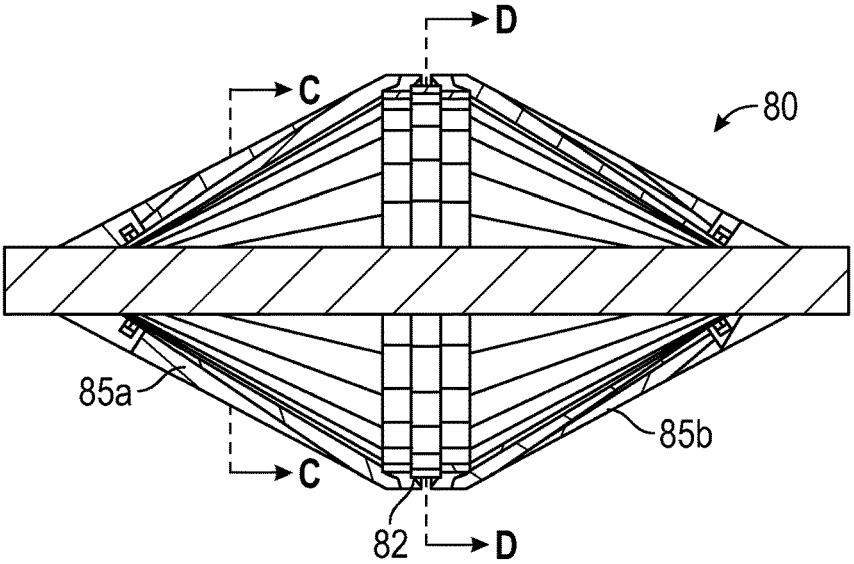
Figure 11C:
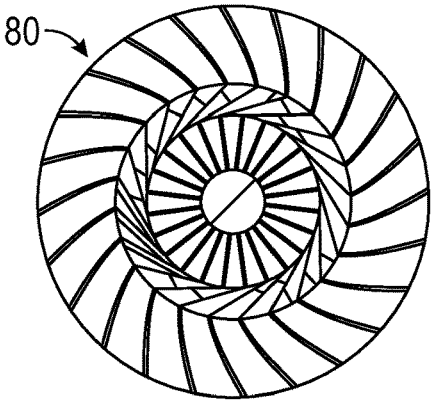
FIGS. 11C and 11D are respective cross-sectional views of the apparatus of FIGS. 11A and 11B through lines C-C and D-D, respectively, in accordance with embodiments of the present disclosure.
Figure 11D:
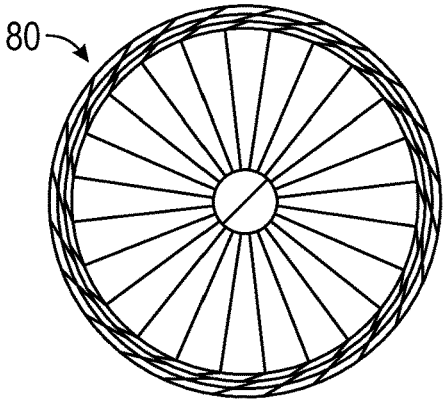

Referring now to FIGS. 10A through 11D, there is shown an expanding and collapsing apparatus 80 according to alternative embodiments. FIGS. 10A and 10B are respective isometric and longitudinal sectional views of the apparatus 80 in a collapsed position, and FIGS. 10C and 10D are respective cross-sectional views of the through lines C-C and D-D of FIG. 10B. FIGS. 11A through 11D are corresponding views of the apparatus 80 in an expanded condition.

Figure 12:
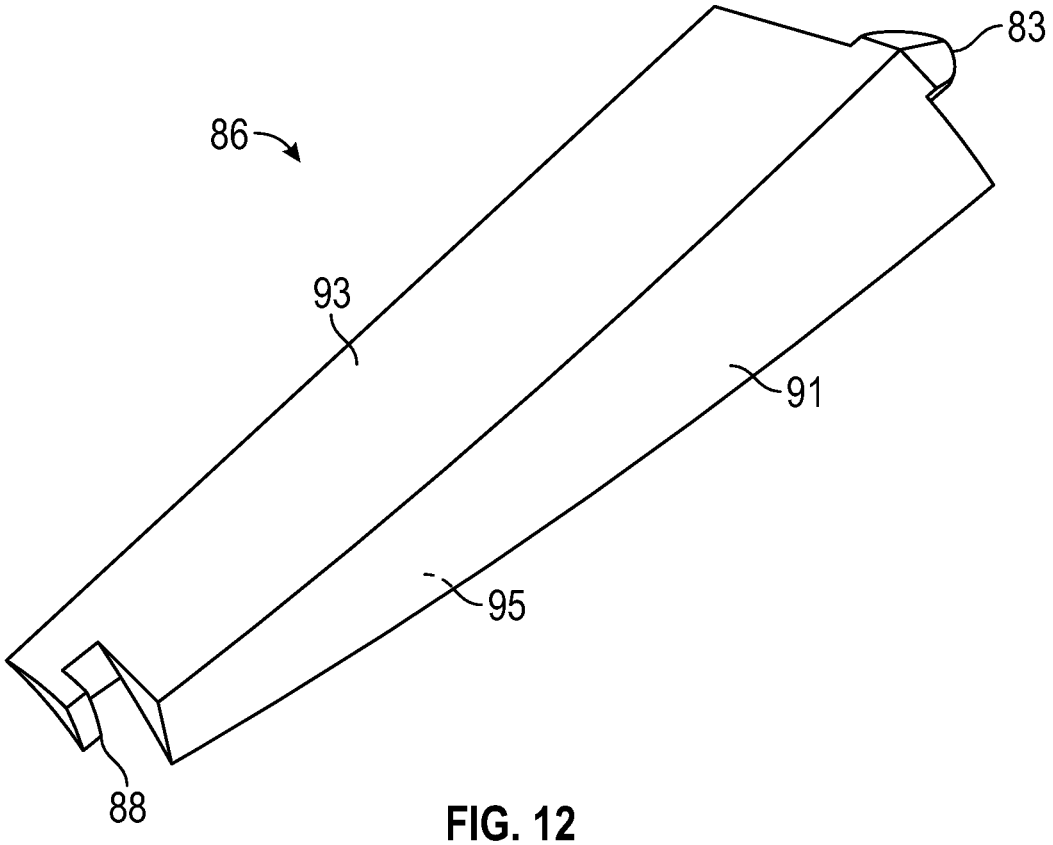
FIG. 12 is an isometric view of a structural element of the apparatus of FIGS. 10A through 10D, in accordance with embodiments of the present disclosure.
Figure 13:
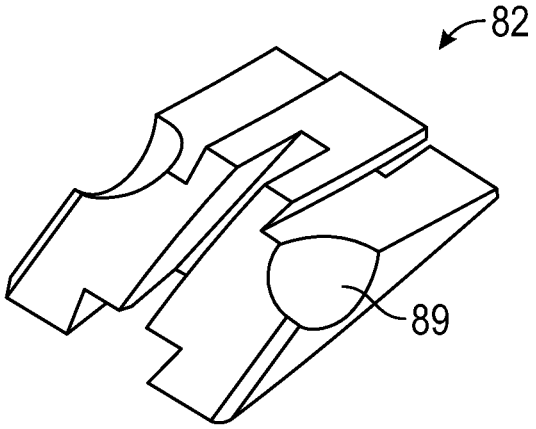
FIG. 13 is an isometric view of a ring element of the apparatus of FIGS. 10A through 10D, in accordance with embodiments of the present disclosure.

The apparatus 80 is substantially similar to the apparatus 50, and will be understood from FIGS. 5A through 9F and the accompanying description. As illustrated, in certain embodiments, the apparatus 80 includes an expansion assembly 81 formed from a plurality of elements, including a set of ring elements 82 assembled to form a centrally disposed ring structure 84. The ring elements 82, as illustrated in FIG. 13, are substantially similar in form and function to the ring elements 52 of the previous embodiments. Two sets 85*a*, 85*b* of structural elements 86 are in the form of cone segments, as illustrated in FIG. 12. The cone segment 86 has an outer surface 91, an upper planar contact surface 93, and a lower planar contact surface 95. As illustrated, in certain embodiments, first ends of each of the cone segments 86 may be connected to a respective retaining ring 87*a*, 87*b* by a hook 88 disposed at the first ends for engaging with an undercut in the retaining ring 87*a*, 87*b*. Each ring element 82 is connected to a pair of segments 86, one from each of the respective sets 85*a*, 85*b*, at the second ends of the segments 86. In certain embodiments, the second ends of the segments 86 are provided with balls or knuckles 83, which are received in respective recesses 89 in the ring elements 82 to create a pivoting and rotating connection. In a first, collapsed condition, the apparatus 80 has a first outer diameter, which is defined by the outer edges of the ring elements 82.

Operation of the apparatus 80 is substantially similar to the operation of the apparatus 50 described above. The apparatus 80 may be actuated to be radially expanded to a second diameter by an axial actuation force, which acts on one or both of the retaining rings 87*a*, 87*b* to move one or both with respect to the mandrel 90. The axial actuation force acts through the sets 85*a*, 85*b* of cone segments 86 to impart axial and radial force components onto the ring elements 82. Radial expansion of the ring structure 84 is initially resisted by the circumferential spring, but when the force of the spring is overcome, the ring elements 82 of the central ring structure 84 are moved radially outward from the collapsed position, towards the expanded condition shown in FIGS. 11A through 11D. As the ring structure 84 moves radially outward, the ring elements 82 pivot with respect to the retaining rings 87*a*, 87*b* and the ring elements 82 to create a pair of conical support structures (e.g., via the cone segments 86) for the ring structure 84. In certain embodiments, each ring element is supported in an A-frame arrangement. The ring elements 82 slide tangentially with respect to one another to expand the center ring structure 84 as the first ends of the cone segments 86 are moved towards one another. In addition, on any selected plane along the length of the cone segment 86 perpendicular to the longitudinal axis (for example section C-C of FIGS. 10C and 10D), the cone segment 86 is moving tangentially to a circle that is in the selected plane and concentric with the longitudinal axis.

Figure 14A:
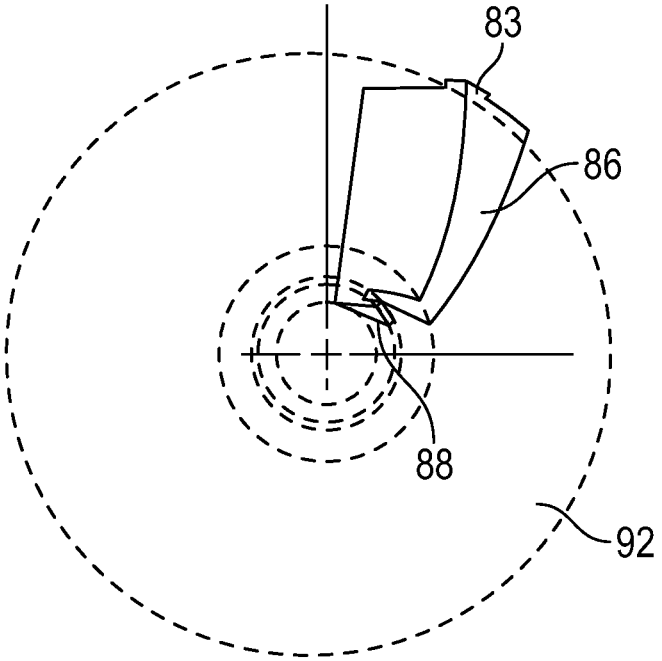
FIGS. 14A and 14B are views of the structural element of FIG. 12 with reference to a virtual cone of which the structural element is a segment, in accordance with embodiments of the present disclosure.
Figure 14B:
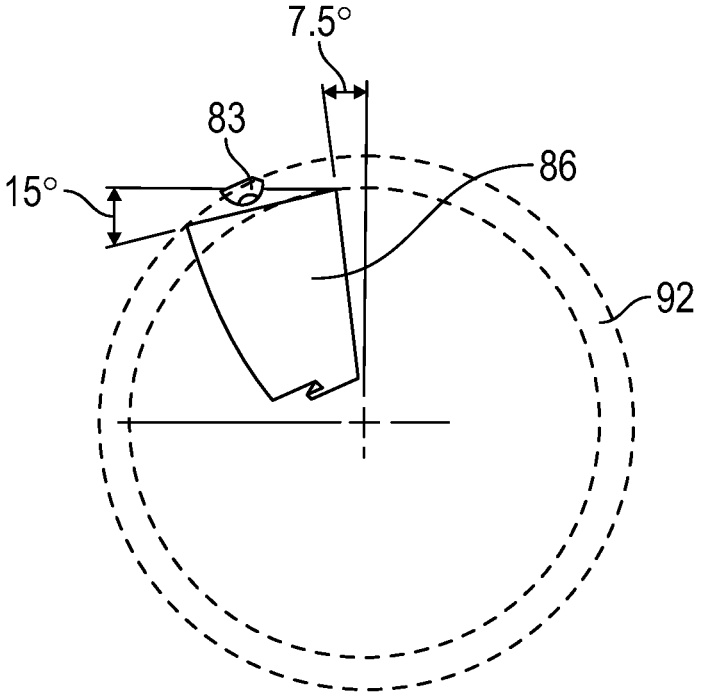
Figure 15A:
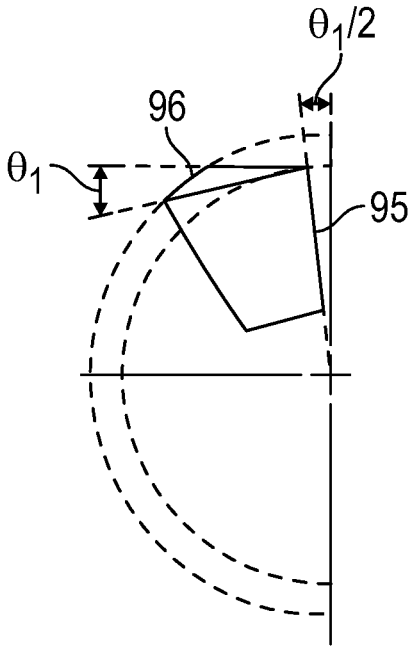
FIGS. 15A through 15C are geometric reference diagrams, useful for understanding how a structural element as described herein may be formed, in accordance with embodiments of the present disclosure.
Figure 15B:
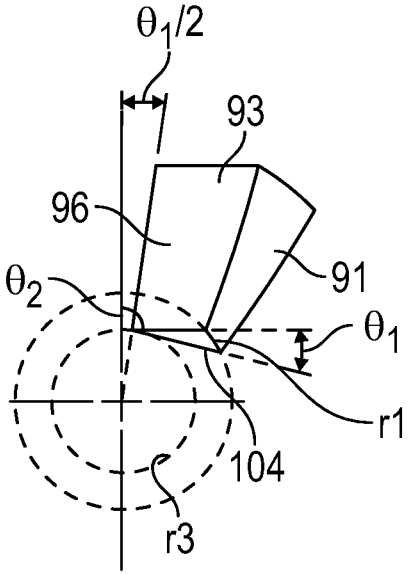
Figure 15C:
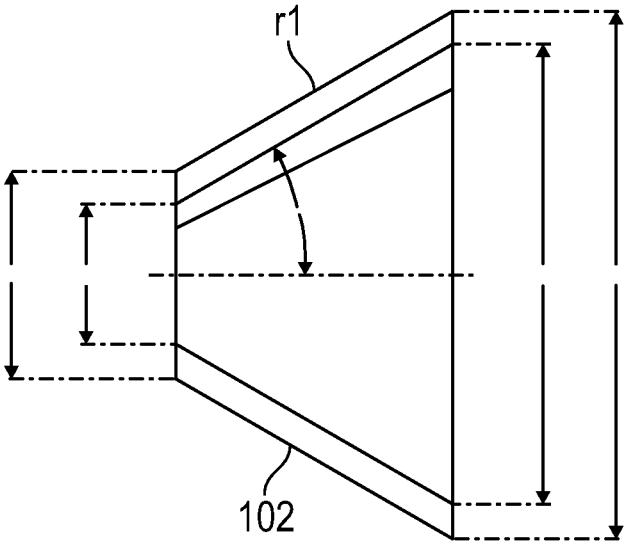

Movement of the cone segments 86 with respect to one another is governed by their shape, and FIGS. 14A, 14B, and 15A through 15C are useful for understanding the manner in which the shape of the cone segments 86 is created in certain embodiments. FIGS. 14A and 14B show the cone segment 86, complete with hook 88 and knuckle 83, as a segment of a hollow cone 92. FIGS. 15A through 15C are geometric reference diagrams, useful for understanding how a simplified cone segment 96 may be formed.

Referring to FIGS. 15A through 15C, the starting point for forming the cone segment 96 is a hollow cone 102 (FIG. 15C), with an internal cone angle, minimum inner diameter and outer diameter, and maximum inner diameter and outer diameter. In certain embodiments, the cone 102 may have any internal and external angle, and need not have a uniform wall thickness (although the example cone 102 does have a uniform wall thickness).

On the small end of the cone 102, as shown in FIG. 15B, the cross-sectional profile of the cone segment 96 is based on a notional wedge-shaped segment of a ring, as described with respect to previous embodiments. The ring is centered on an axis, with the notional wedge-shaped segment being inclined with respect to the radial direction of the ring. The nominal outer diameter of the segment is at the optimum expansion condition of the ring (with radius shown at $r_1$). As with the embodiments illustrated FIGS. 5A through 9F, the orientation planes of upper and lower contact surfaces of the segment element are tangential to a circle centered on the longitudinal axis of the apparatus with radius $r_3$. The inner surface of the ring structure is defined at $r_3$ and, therefore, the orientation planes are fully tangential (and angle $\theta_2$ is approximately 90 degrees). The angle described between the tangent points is equal to the angle $\theta_1$ of the segment. The orientation planes of the first and second contact surfaces of each notional wedge-shaped segment intersect on a radial plane P, which bisects the radial planes at the tangent points (i.e., is at an angle of $\theta_1/2$ to both). This intersection plane P defines the expanding and collapsing path of the segment. In this apparatus, the segment angle $\theta_1$ is approximately 15 degrees, and the radial plane P is inclined to the radial plane at the tangent point by approximately 7.5 degrees.

Having determined the profile 104 of one end of the segment, the internal angle of the inside face of the cone 102 defines the inclined angle of the upper and lower planar surfaces of a formed segment, which extend from the end profile 104. The upper planar surface 93 is defined by a cut through the body of the cone from the upper line of the end profile 104, where the cut remains tangential to the inner surface of the cone throughout the length of the cone. The lower planar surface 95 is defined by a cut through the body of the cone from the lower line of the end profile 104, where the cut remains tangential to the inner surface of the cone throughout the length of the cone. The outer surface 91 of the segment is the outer surface of cone between the upper and lower planar surfaces.

The geometry of a cross-section of the cone segment is the same at each position through the length of the segment: the outer surface 91 is at the nominal outer diameter of the segment at the optimum expansion condition of the ring; the first and second contact surfaces of the cone segment are tangential to the circle at radius $r_3$, and the orientation planes of the first and second contact surfaces intersect on a radial plane P inclined at an angle of $\theta_1/2$ to the radial planes at the tangent points. The same radial plane P can be described as being inclined to the upper contact surface by an angle of $90-\theta_1/2$ degrees and inclined to the lower contact surface by an angle of $90+\theta_1/2$. The principles illustrated in FIGS. 15A through 15C may be used to determine the basic shape of the cone segment, which may then be detailed with additional features such as grooves and undercuts to create the functional cone segment 86.

In use, as the retaining rings 87 and sets 85 of cone segments 86 are brought towards the position shown in FIGS. 11A through 11D, the ring elements 82 and the structural ring elements 86 slide with respect to one another into the radially expanded condition. The radial movement of the elements of the outer rings is substantially similar to the movement of the elements described with reference to FIGS. 1A through 4F: the elements 82, 86 slide with respect to one another in a tangential direction, while remaining in mutually supportive planar contact. The centrally positioned ring elements 82 ensure that the outer structural segments 86 remain held in a uniform pattern, equally spaced and evenly deployed. The expansion of the center ring also controls the alignment and the order of the outer structural segments 86.

The resulting expanded condition is shown in FIGS. 11A through 11D. The apparatus 80 may be expanded to an optimal expansion condition, at which the planar surfaces of cone segments 86 are in full contact, and where the outer diameter defined by the ring structure 84 is slightly smaller than the inner diameter of a conduit or borehole within which the apparatus 80 is disposed. Further thrust on the retaining rings 87 causes over-expansion of the ring structure 84, without substantially affecting the surface profile of the conical or cylindrical ring structures.

Maintaining the axial force on the retaining rings 87 may keep the apparatus 80 in an expanded condition, and a reduction in the axial force to separate the retaining rings 87 enables the ring structure 84 and sets 85*a*, 85*b* of spokes to collapse under the retention forces of the spring element. Collapsing of the apparatus 80 to a collapsed condition is, therefore, achieved by releasing the axial actuation force. Separation of the retaining rings 87 collapses the ring structure 84 under the retaining force of its biasing spring, back to the collapsed position shown in FIGS. 10A through 10C.

The combination of structural elements and the ring structure enables the provision of an expanding and collapsing apparatus with increased maximum expansion ratios. The embodiments described herein provide increased maximum expansion ratios with few additional moving parts and little increase in complexity over with the ring structure of FIGS. 1A through 4F. The apparatus forms an expanded ring structure that is solid, with no gaps between its elements and has a smooth circular outer surface at its fully expanded condition. In addition, the conical support structures created by the cone segments are formed as solid, smooth flanks of the expanded apparatus. This facilitates use of the conical structures as deployment or actuation devices, or support structures for seal elements and other mechanical structures, as will be described in more detail below.

Figure 16A:
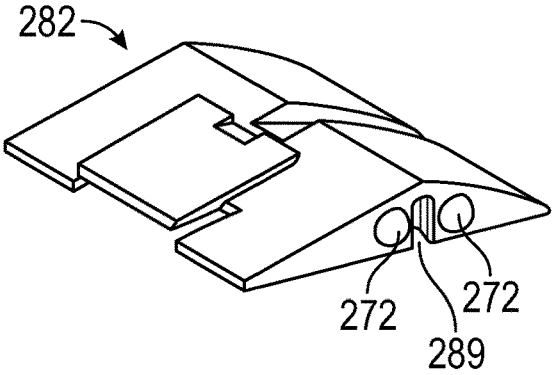
FIGS. 16A through 16C are respective first isometric, lower, and second isometric end views of a ring element of an apparatus, in accordance with embodiments of the present disclosure.
Figure 16B:
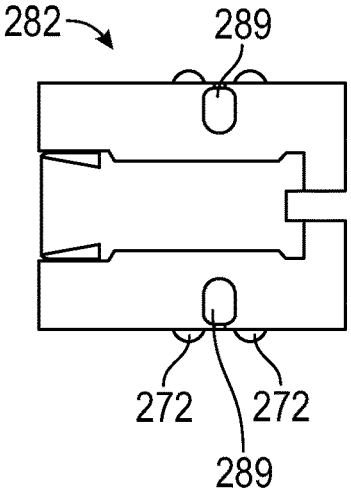
Figure 16C:
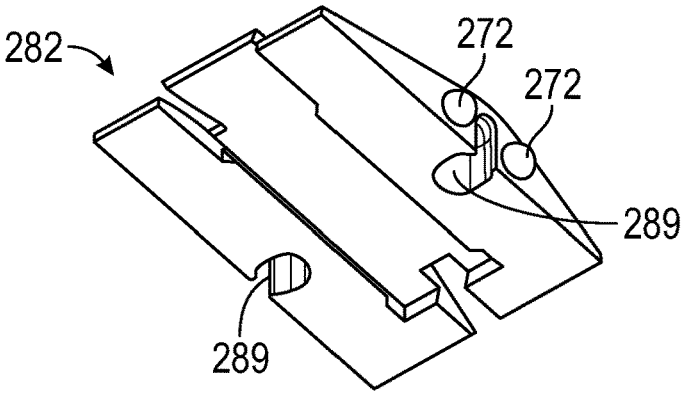
Figure 17A:
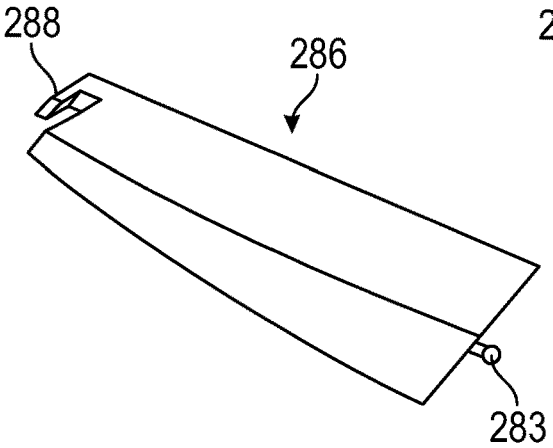
FIGS. 17A and 17B are respective first and second isometric views of a structural element of an apparatus, in accordance with embodiments of the present disclosure.
Figure 17B:
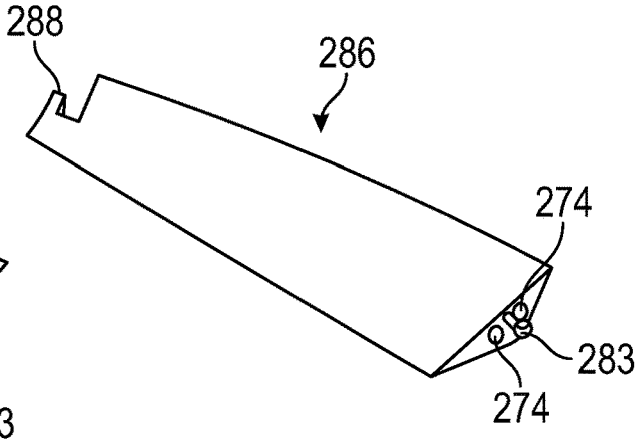
Figure 18A:
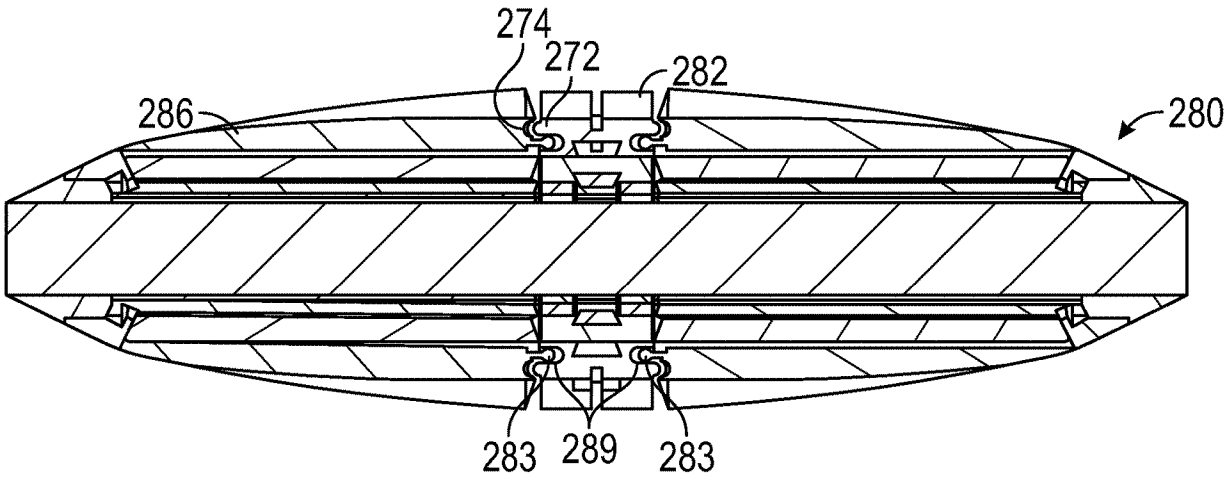
FIGS. 18A and 18B are longitudinal sectional views of an apparatus incorporating the ring element and structural element of FIGS. 16A through 17B in collapsed and expanded conditions, respectively, in accordance with embodiments of the present disclosure.
Figure 18B:
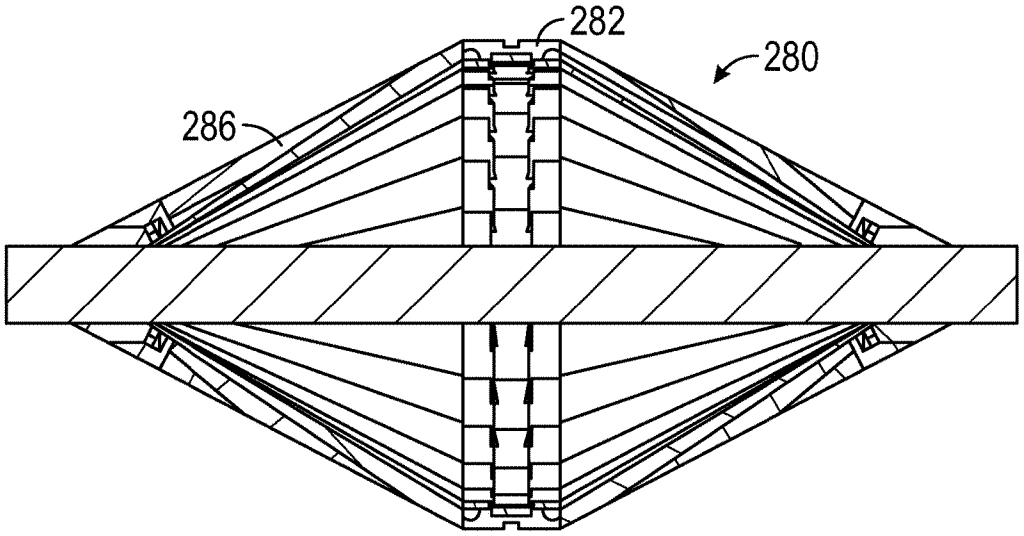

A variation to the apparatus 80 will now be described with reference to FIGS. 16A through 18B. FIGS. 18A and 18B are longitudinal sectional views of an apparatus 280, which is substantially similar to the apparatus 80 described above and will be understood from FIGS. 10A through 15C and the accompanying description. FIGS. 16A through 16C are various views of a ring element 282 of the apparatus 280, and FIGS. 17A and 17B are isometric views of a structural element 286 of the apparatus 280. The basic geometry of the ring element 282 and structural element 286 is substantially similar to the geometry of the elements 82, 86 as previously described. As with the apparatus 80, in certain embodiments, a hook 288 may be provided for engaging with an undercut in a respective retaining ring. However, the elements 282, 286 differ in the configuration of their connection to one another. More specifically, instead of the spherical ball joint and socket provided in components of the apparatus 80, the apparatus 280 has a knuckle joint 283 provided on the structural element 286, and a corresponding socket 289 on the ring element 282. In certain embodiments, the socket 289 includes an opening on the lower contact surface for receiving the knuckle 283, and a U-shaped slot in the side wall, which enables the elements to be assembled while retaining the knuckle 283, and allows a tension to be pulled between the structural element 286 and a respective retaining ring (or vice versa).

In certain embodiments, corresponding side walls of the ring element 282 and the structural element 286 are also provided with a cooperating arrangement of knurls 272 and sockets 274. In such embodiments, the knurls 272 of the ring elements 282 self-locate in the sockets 274 of the structural elements 286 when the apparatus 280 is in its expanded condition, shown in FIG. 18B, and provide additional support to the structure. In the illustrated embodiment, two knurls 272 are provided on each side wall of each ring element 282, with corresponding sockets 274 provided on the contacting side wall of the respective structural element 286, but it will be appreciated that in other embodiments, the position may be reversed, and/or other configurations of locating formations may be provided.

Figure 19A:
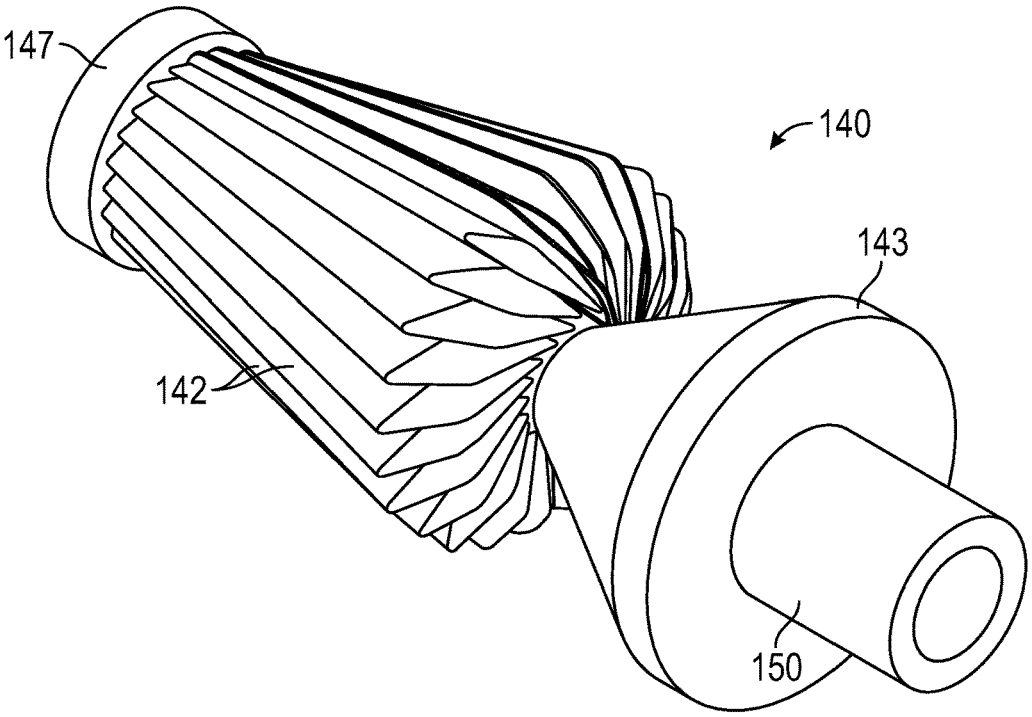
FIGS. 19A through 19C are respective isometric, longitudinal sectional, and end views of an apparatus in a collapsed condition, in accordance with embodiments of the present disclosure.
Figure 19B:
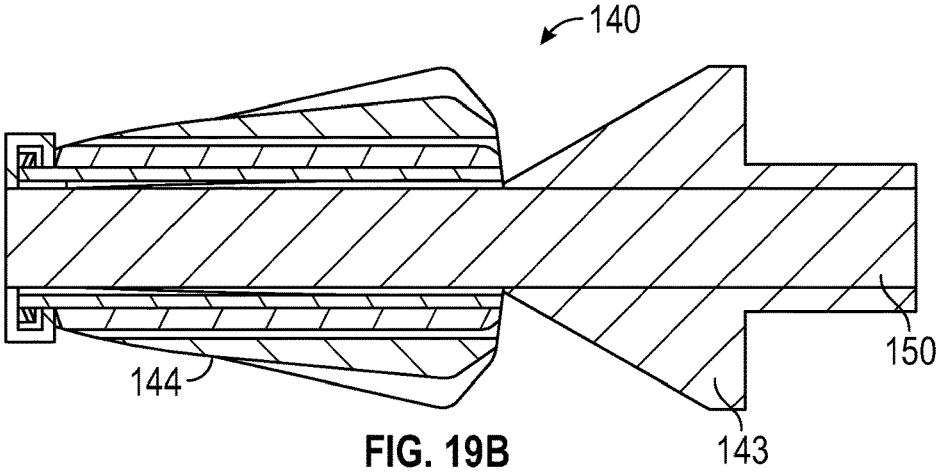
Figure 19C:
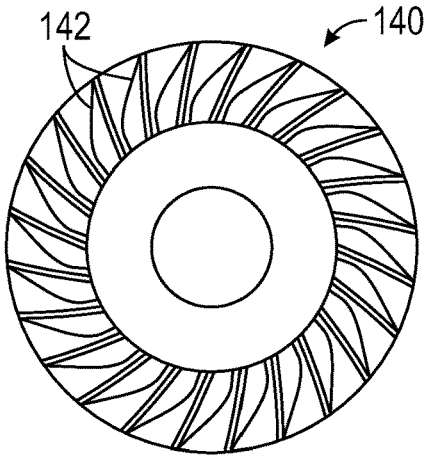
Figure 20A:
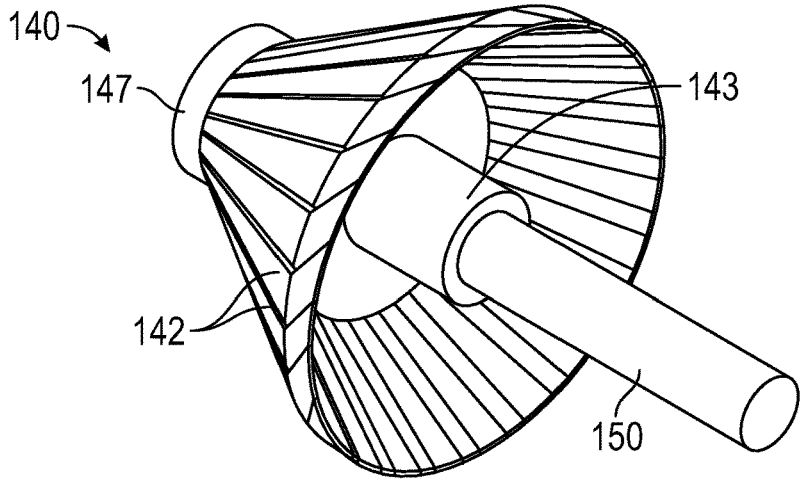
FIGS. 20A through 20C are respective isometric, longitudinal sectional, and end views of the apparatus of FIGS. 19A through 19C in an expanded condition, in accordance with embodiments of the present disclosure.
Figure 20B:
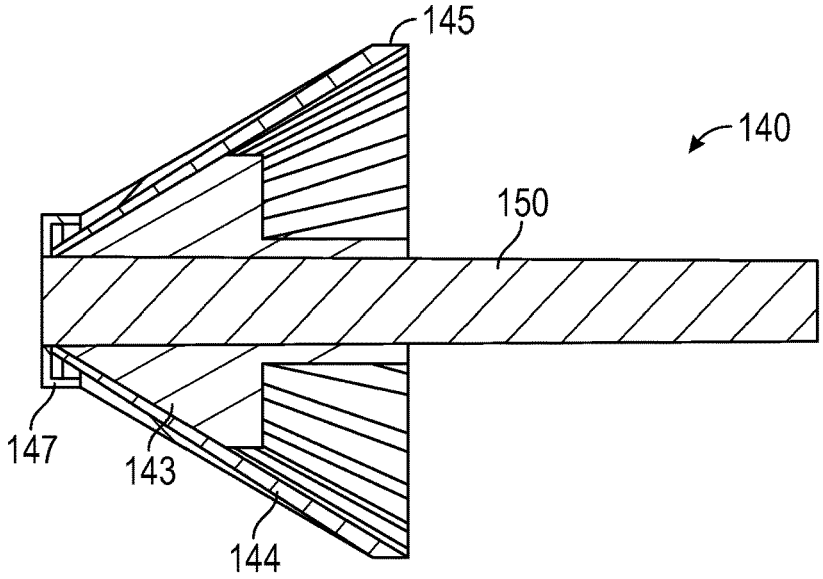
Figure 20C:
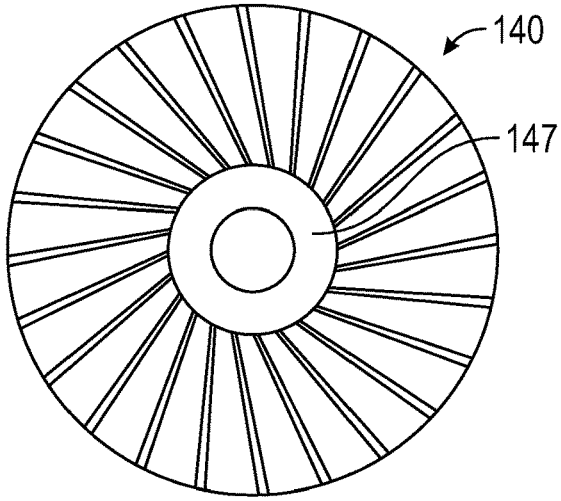

Although the foregoing embodiments include combinations of cylindrical ring structures and conical support assemblies, the principles of the embodiments described herein may also be applied to expanding cone structures without connection to cylindrical rings. For example, certain embodiments are described with reference to FIGS. 19A through 20D. FIGS. 19A through 19C are respective isometric, longitudinal sectional, and end views of an apparatus 140 in a collapsed condition. FIGS. 20A through 20C are corresponding views of the apparatus 140 in an expanded condition. In certain embodiments, the apparatus 140 includes an expansion assembly 141 formed from a plurality of elements, including a set of elements 142 assembled together to form conical ring structure 154. The elements 142 are assembled on a mandrel 150, with first ends of the elements 142 connected to a retaining ring 147. Second ends of the elements 142 are adjacent an actuating wedge cone 143.

The elements 142 are substantially similar to the cone segments 86, and their form and function will be understood from FIGS. 10A through 11D and the accompanying description. The shape of the elements 142 is created by the principles described with reference to FIGS. 14A through 15C. The elements 142 include an outer surface, an upper planar contact surface, and a lower planar contact surface. The contact surfaces are mutually supportive when assembled to form the ring structure. In a first, collapsed condition, the apparatus 140 has a first outer diameter, which is defined by the outer edges of the second ends of the elements 142. The shape of the apparatus 140 in its collapsed condition is substantially conical.

In use, the apparatus 140 may be actuated to be radially expanded to a second diameter by an axial actuation force, which acts on one or both of the retaining ring 147 or a wedge member 143 to move one or both with respect to the mandrel 150. The force causes the wedge member 143 to move axially with respect to the elements 142, and transfer a component of the axial force onto inner surfaces of the elements 142. The angle of the wedge member 143 transfers a radial force component to the elements 142, which causes them to slide with respect to one another along their respective contact surfaces.

The movement of the expanding elements 142 is tangential to a circle defined about the longitudinal axis of the apparatus 140. The contact surfaces of the elements 142 mutually support one another before, during, and after expansion. The radial position of the elements 142 increases on continued application of the axial actuation force until the elements 142 are located at a desired outer radial position. This radial position may be defined by a controlled and limited axial displacement of the wedge member 143 or, alternatively, may be determined by an inner surface of a bore or tubular within which the apparatus 140 is disposed.

FIGS. 20A through 20C show the apparatus 140 in its expanded condition. At an optimal expansion condition, shown in FIGS. 20B and 20C, the outer surfaces of the individual elements 142 combine to form a complete conical surface with no gaps in between the individual elements 142. At the second end of the elements 142, a cylindrical surface 145 is formed at the optimal expanded condition. The outer surfaces of the individual elements 142 combine to form a complete circle with no gaps in between the individual elements. The outer surface of the expansion apparatus may be optimized for a specific diameter, to form a perfectly smooth cone and round expanded ring (within manufacturing tolerances) with no extrusion gaps on the inner or outer surfaces of the ring structure. The design of the expansion apparatus 140 also has the benefit that a degree of under expansion or over expansion (for example, to a slightly different radial position) does not introduce significantly large gaps.

It is a feature of the described arrangement that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. This enables use of the apparatus in close axial proximity to other functional elements.

Figure 21A:
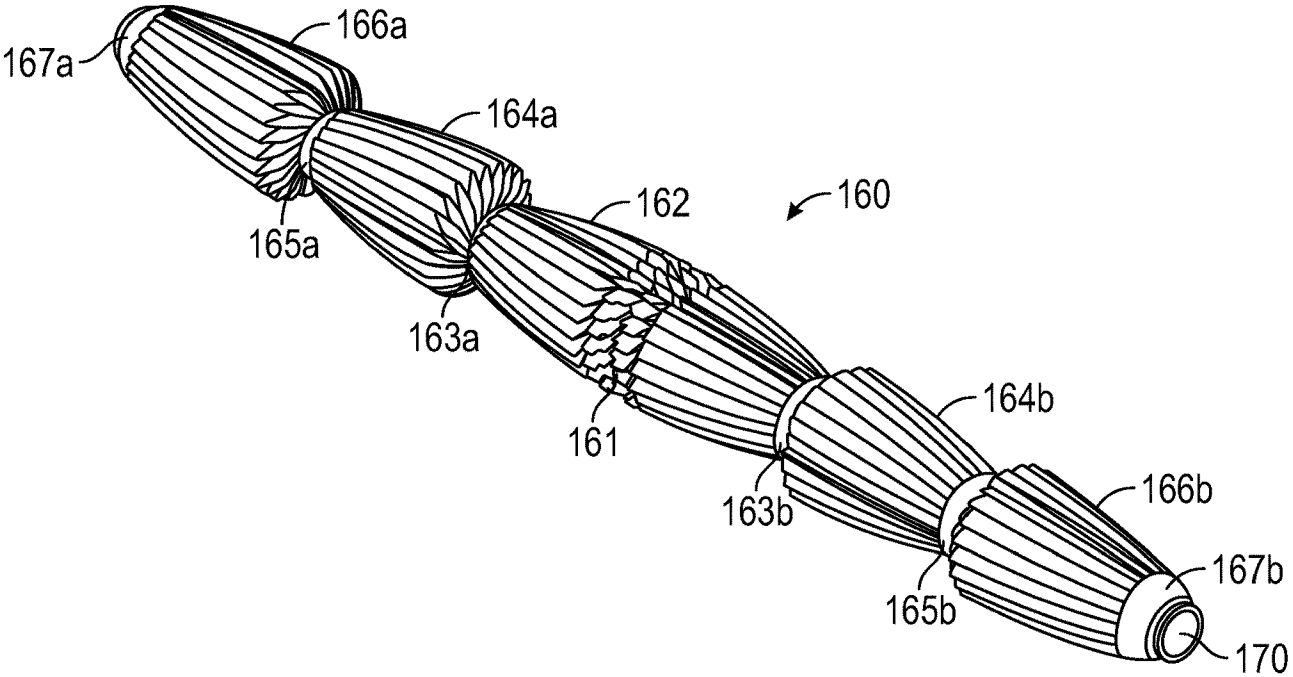
FIGS. 21A through 21C are respective isometric, longitudinal sectional and cross-sectional views of an apparatus in a collapsed condition, in accordance with embodiments of the present disclosure.
Figure 21B:
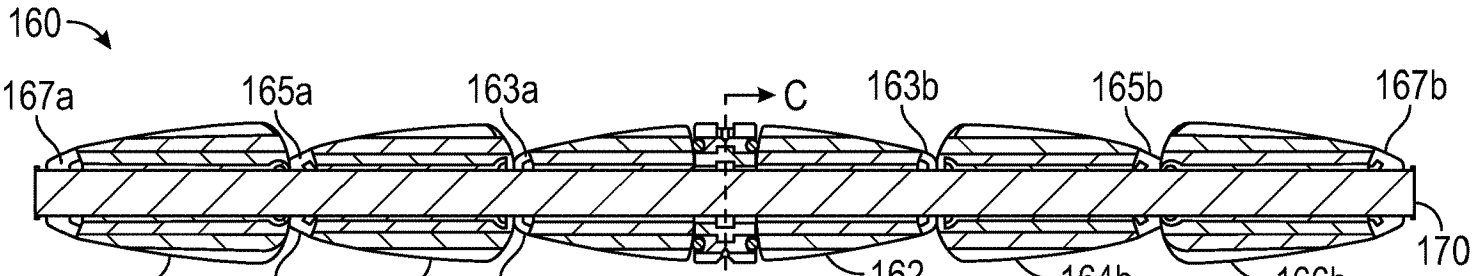
Figure 21C:
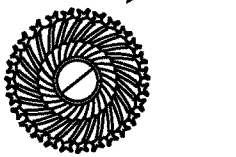
Figure 22A:
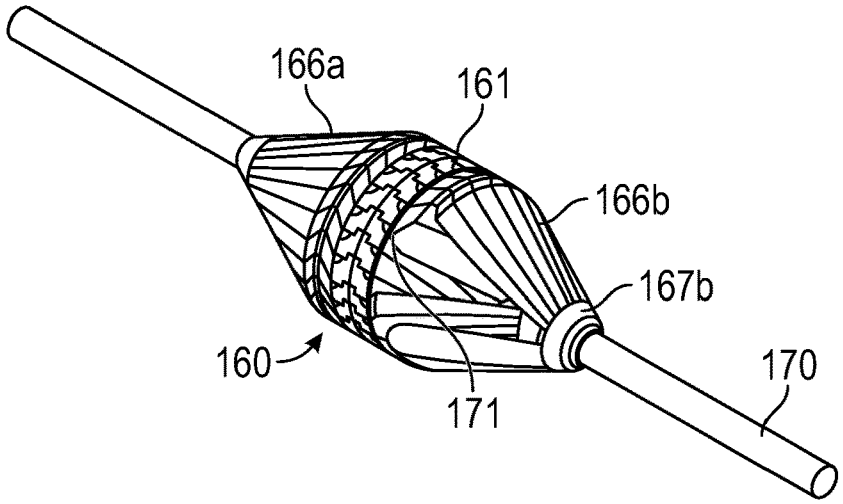
FIGS. 22A and 22B are respective partially cut away isometric and longitudinal sectional views of the apparatus of FIGS. 21A through 21C in an expanded condition, in accordance with embodiments of the present disclosure.
Figure 22B:
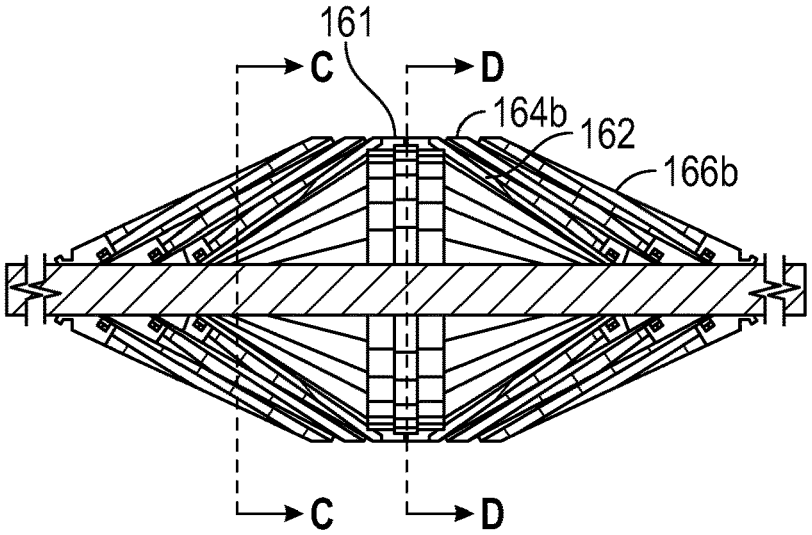
Figure 22C:
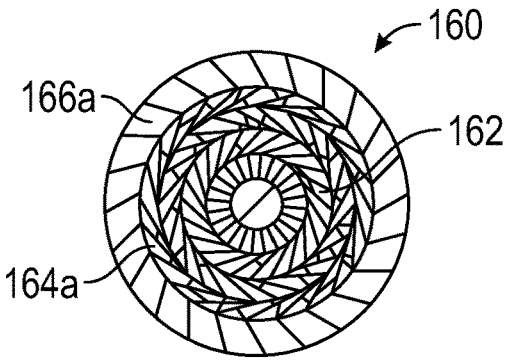
FIGS. 22C and 22D are respective cross-sectional views of the apparatus of FIGS. 22A and 22B through lines C-C and D-D, in accordance with embodiments of the present disclosure.
Figure 22D:
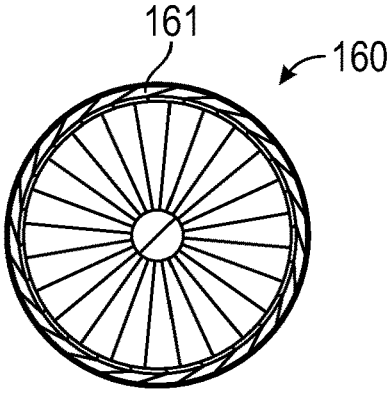
Figure 23A:
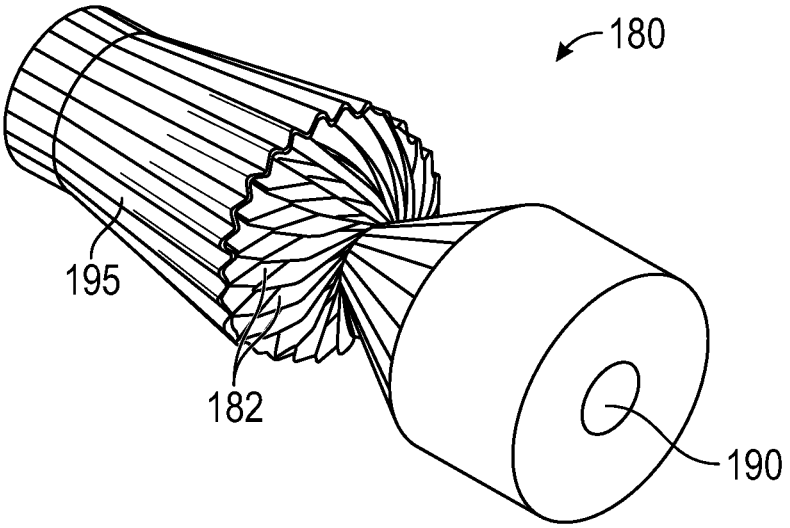
FIGS. 23A through 23C are respective isometric, longitudinal sectional, and end views of a seal apparatus in a collapsed condition, in accordance with embodiments of the present disclosure.
Figure 23B:
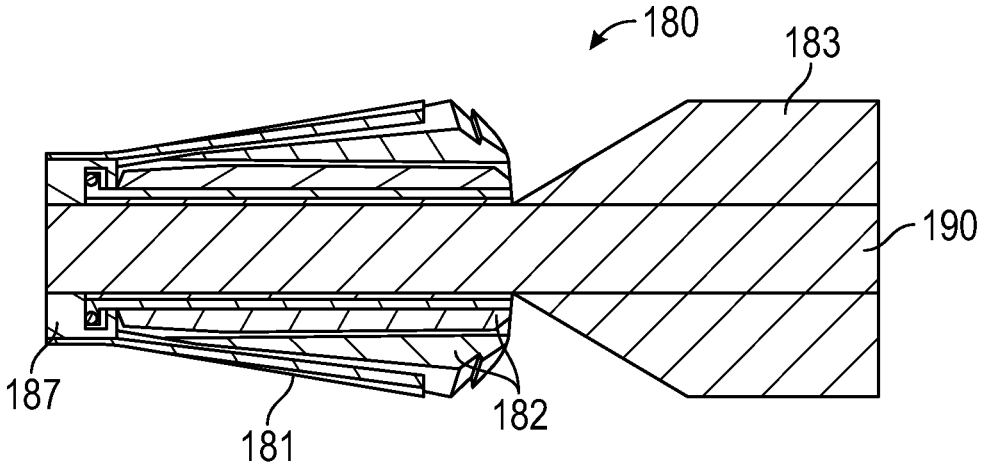
Figure 23C:
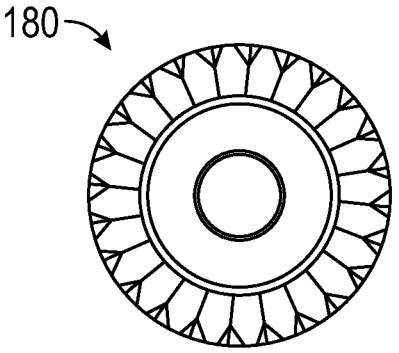
Figure 24A:
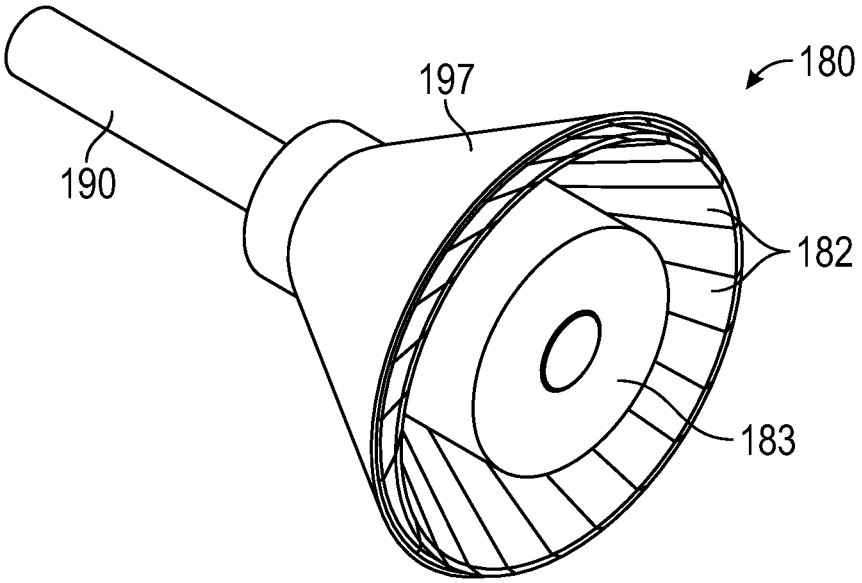
FIGS. 24A through 24C are respective isometric, longitudinal sectional, and end views of the apparatus of FIGS. 22A through 22C in an expanded condition, in accordance with embodiments of the present disclosure.
Figure 24B:
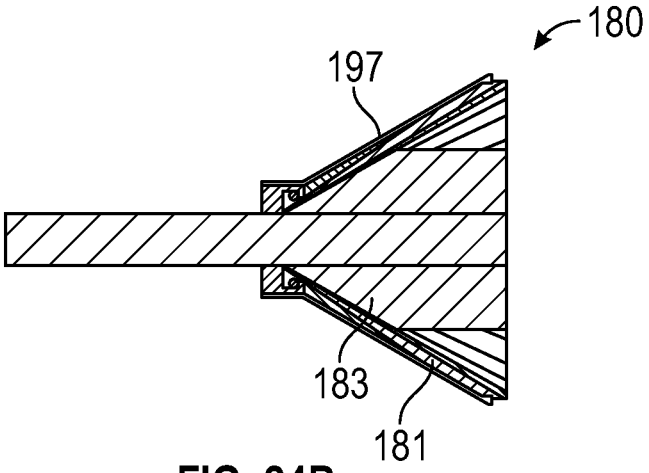
Figure 24C:
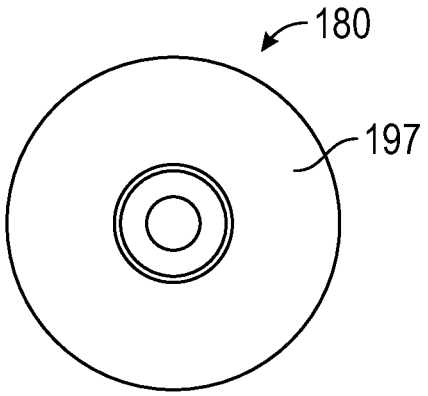

In certain embodiments, the apparatus 140 may be used in conjunction with the apparatus of other embodiments to provide an assembly of expanding apparatus. For example, certain embodiments are described with reference to FIGS. 21A through 22D. FIGS. 21A through 21C are respective isometric, longitudinal sectional, and cross-sectional views of an apparatus 160 in a collapsed condition. FIGS. 22A and 22B are respective partially cut away isometric and longitudinal sectional views of the apparatus 160 in an expanded condition. FIGS. 22C and 22D are respective cross-sectional views of the apparatus 160 of FIGS. 22A and 22B through lines C-C and D-D of FIG. 22B.

As illustrated, in certain embodiments, the apparatus 160 includes a mandrel 170 supporting a centrally disposed expanding apparatus 162, which is of the same form of the apparatus 80, with the same functionality and operation. In addition, on either side of the apparatus 162 are expanding apparatus 164*a*, 164*b* including cone structures of similar construction as the apparatus 140, with the same functionality and operation. Axially outside of the apparatus 164*a*, 164*b* are additional expanding apparatus 166*a*, 166*b*, which include cone structures of similar construction as the apparatus 140, and have the same functionality and operation.

In use, the apparatus 160 may be actuated to be radially expanded to a second diameter by an axial actuation force, which acts on one or both of retaining rings 167*a*, 167*b* to move one or both with respect to the mandrel 170. Relative movement of the outer retaining rings 167*a*, 167*b* causes the expanding apparatus 162, 164*a*, 164*b*, 166*a*, 166*b* to expand to their expanded conditions, driven by the conical wedge surfaces of the respective retaining rings 163*a*, 163*b*, 165*a*, 165*b*.

The expanded condition of the apparatus 160 is shown in FIGS. 22A through 22D. As described above with reference to FIGS. 10A through 11D, the apparatus 162 expands to a form which defines first and second hollow conical support structures at first and second flanks of the apparatus 162. The internal angles of the hollow cones formed by expanding apparatus 164*a*, 164*b* correspond to the external cone angles of the apparatus 162, and the apparatus 164*a*, 164*b* are brought into abutment with the outer flanks of the apparatus 162 to create a nested, layered support structure. Similarly, the internal angles of the hollow cones formed by expanding apparatus 166*a*, 166*b* correspond to the external cone angles of the apparatus 164*a*, 164*b*, and the apparatus 166*a*, 166*b* are brought into abutment with the outer flanks defined by apparatus 164*a*, 164*b*. The combined apparatus 160, as illustrated in FIG. 22B, provides additional support for the cylindrical ring structure 161 of the apparatus 162 due to the increase in effective wall thickness created by the abutment of conical support structures in a nested arrangement. Each conical surface is substantially or completely smooth and, therefore, the contact between conical support structures over the majority of the surfaces to optimize mechanical support.

In such embodiments, the direction in which the cone segments are layered differs between adjacent apparatus 162, 164*a*, 164*b*, 166*a*, 166*b*. For example, the layering of cone segments in the apparatus 164*a*, 164*b* is reversed compared to the direction of layering in the apparatus 162, 166*a*, 166*b*. This results in a cross-ply effect between support layers in the expanded condition, as illustrated in FIG. 22A, thereby enhancing mechanical support and load bearing through the apparatus 162, 164*a*, 164*b*, 166*a*, 166*b*, and increasing the convolution of any path between segments of adjacent support layers.

Retraction of the apparatus 162, 164*a*, 164*b*, 166*a*, 166*b* to a collapsed condition is performed by releasing or reversing the axial force on the outermost retaining rings 167*a*, 167*b*. In certain embodiments, this is facilitated by lips 171 provided on the inner surface of the cone segments, as illustrated in FIGS. 21B and 22A. When the expanding cone is in a collapsed condition, the lips 171 of its cone segments engage with an external rim on the retaining ring 167*a*, 167*b* of an adjacent expanding cone. When the outermost pair of expanding cones 166*a*, 166*b* is collapsed under tension, the lips 171 engage the rim of the retaining rings 165*a*, 165*b* to impart tension to the retaining rings 165*a*, 165*b* and retract the expanding cones 164*a*, 164*b*. Similarly, when the expanding cones 164*a*, 164*b* are collapsed under tension, the lips 171 engage the rim of the retaining rings 163*a*, 163*b* to impart tension to the retaining rings 163*a*, 163*b* and retract the expanding apparatus 162.

Although two pairs of expanding cones are provided to support the apparatus 162 illustrated FIGS. 21A to 22D, in other embodiments, fewer or greater numbers of expanding cones may be used, depending on the application. In certain embodiments, support may be provided by a single expanding cone brought into abutment with just one of the flanks of the apparatus 162. Alternatively, in other embodiments, multiple expanding cones may be used in a nested configuration to support just one of the flanks of the apparatus 162. Alternatively, in other embodiments, unequal numbers of expanding cones may be used to support opposing flanks of the apparatus 162.

Within the scope of the embodiments described herein, the expanding apparatus used in nested configurations as described with reference to FIGS. 21A through 22D may have different physical properties including but not limited to configuration, size, wall thickness, conical angle, and/or material selection, depending on application. For example, certain embodiments are described with reference to FIGS. 21A through 22D, the cone segments of the apparatus 164*a*, 164*b* differ from the cone segments of the apparatus 162, 166*a*, 166*b* to provide an improved sealing effect. In certain embodiments, cone segments of the apparatus 164*a*, 164*b* may be formed from metal that is coated with a compliant polymeric material, such as a silicone polymer coating. In certain embodiments, all surfaces of the elements may be coated, and the mutually supportive arrangement of the cone segments within the apparatus 164*a*, 164*b*, combined with the support from the adjacent apparatus 162, 166*a*, 166*b*, may keep them in compression in their operating condition. This enables the combined apparatus 160 to function effectively as a flow barrier, and in some applications, the barrier created is sufficient to seal against differential pressures to create a fluid tight seal.

In certain embodiment, the material selected for the cone segments itself may be a compliant or elastomeric material such as an elastomer, polymer, or rubber rather than a coated metallic or other relatively hard material. Alternatively, in other embodiments, the segments may include a skeleton or internal structure formed from a metallic or other relatively hard material, coated or encased in a compliant or elastomeric material such as an elastomer, polymer, or rubber. The cone segments of all, some, or one of the expanding apparatus may be formed from these alternative materials, or different materials may be used for different expanding apparatus. An individual expanding apparatus may be configured to provide sealing functionality and may, therefore, similarly be fully or partially formed from compliant or elastomeric materials.

Referring now to FIGS. 23A through 24C, there is shown an expanding and collapsing apparatus 180 configured as a seal for a fluid conduit or borehole. As illustrated, in certain embodiments, the apparatus 180 includes an expansion assembly 181 formed from a plurality of elements, including a set of ring elements 182 assembled together to form a conical ring structure 184. The ring elements 182 are assembled on a mandrel 190, with first ends of the ring elements 182 connected to a retaining ring 187. Second ends of the ring elements 182 are adjacent an actuating wedge cone 183. The ring elements 182 are similar to the cone segments 86, 142, and their form and function will be understood from FIGS. 10A through 11D and 19A through 20B, and the accompanying description. The shape of the ring elements 182 is created by the principles described with reference to FIGS. 14A through 15C. The cone segments include an outer surface, an upper planar contact surface, and a lower planar contact surface. The contact surfaces are mutually supportive when assembled to form the ring structure 184. In a first, collapsed condition, the apparatus 180 has a first outer diameter, which is defined by the outer edges of the second ends of the ring elements 182. The shape of the assembly in its collapsed condition is substantially conical.

The apparatus 180 differs from the apparatus 140 described above in that it is provided with a pleated layer 195 of compliant sealing material. As illustrated, in certain embodiments, the layer 195 surrounds the retaining ring 187 and the expanding assembly 181 over the majority of its length, and is pleated to follow the profiled surface of upstanding edges and grooves defined by the collapsed assembly 181. The apparatus 180 may be actuated by an axial actuation force, which acts on one or both of the retaining ring 187 or the wedge 183. As the apparatus 180 is expanded to the expanded condition shown in FIGS. 24A through 24C, the layer 195 is unfolded to form a compliant conical sheath 197 around the expanded conical structure.

The apparatus 180 is just one example of how the embodiments described herein may be applied to a fluid barrier or sealing apparatus, and other fluid barrier or sealing configurations are within the scope of the embodiments described herein. For example, the apparatus may be configured to operate in conjunction with a sealing element, for example, an elastomeric body or an inflatable bladder, disposed beneath a hollow conical structure formed by the expanded cone segments.

Figure 25A:
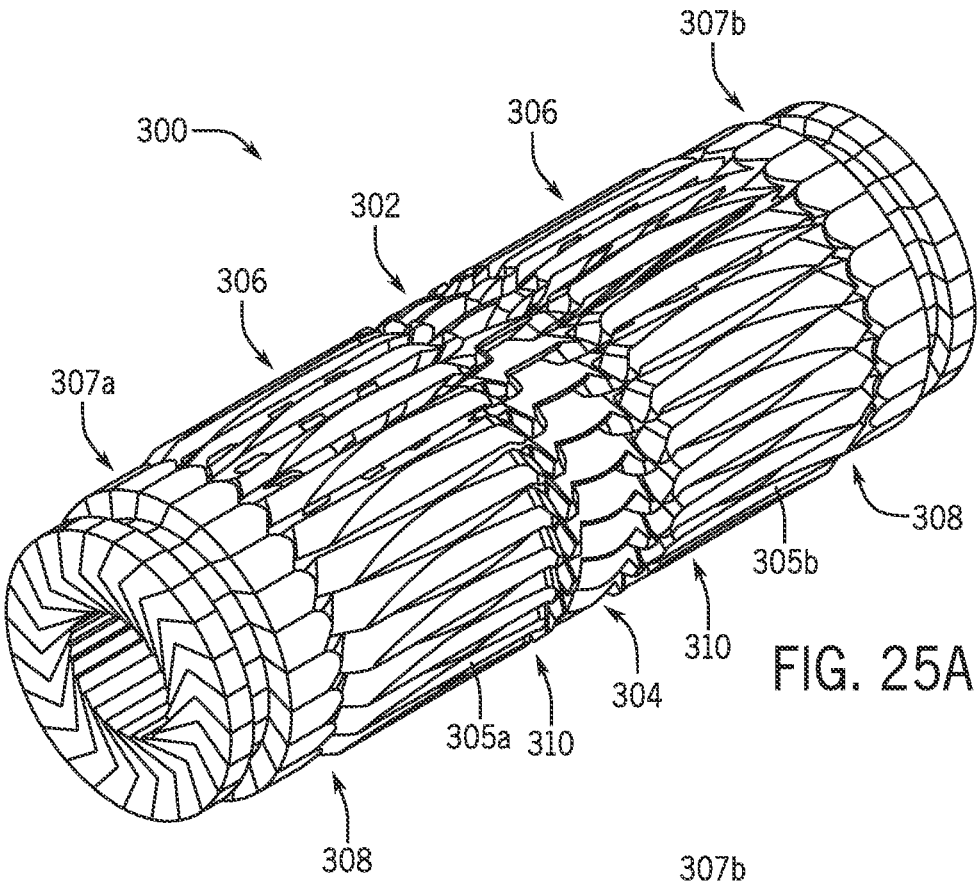
FIGS. 25A and 25B are respective isometric and sectional views of an apparatus in a collapsed condition, in accordance with embodiments of the present disclosure.
Figure 25B:
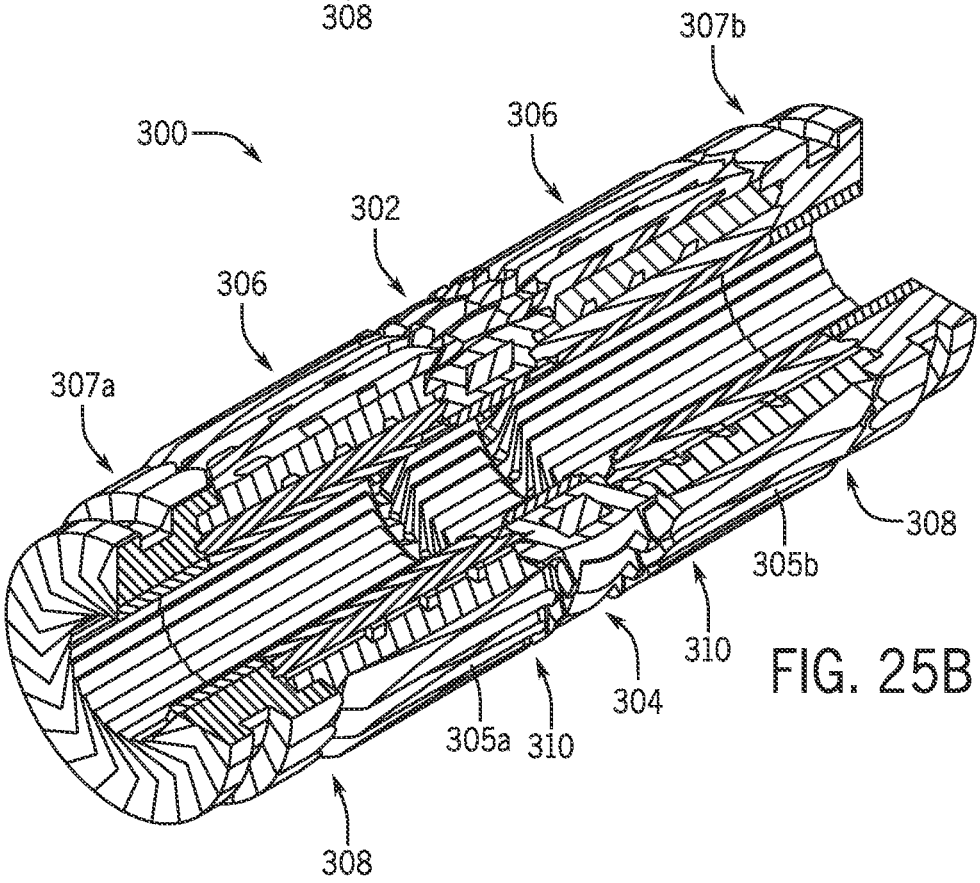
Figure 26A:
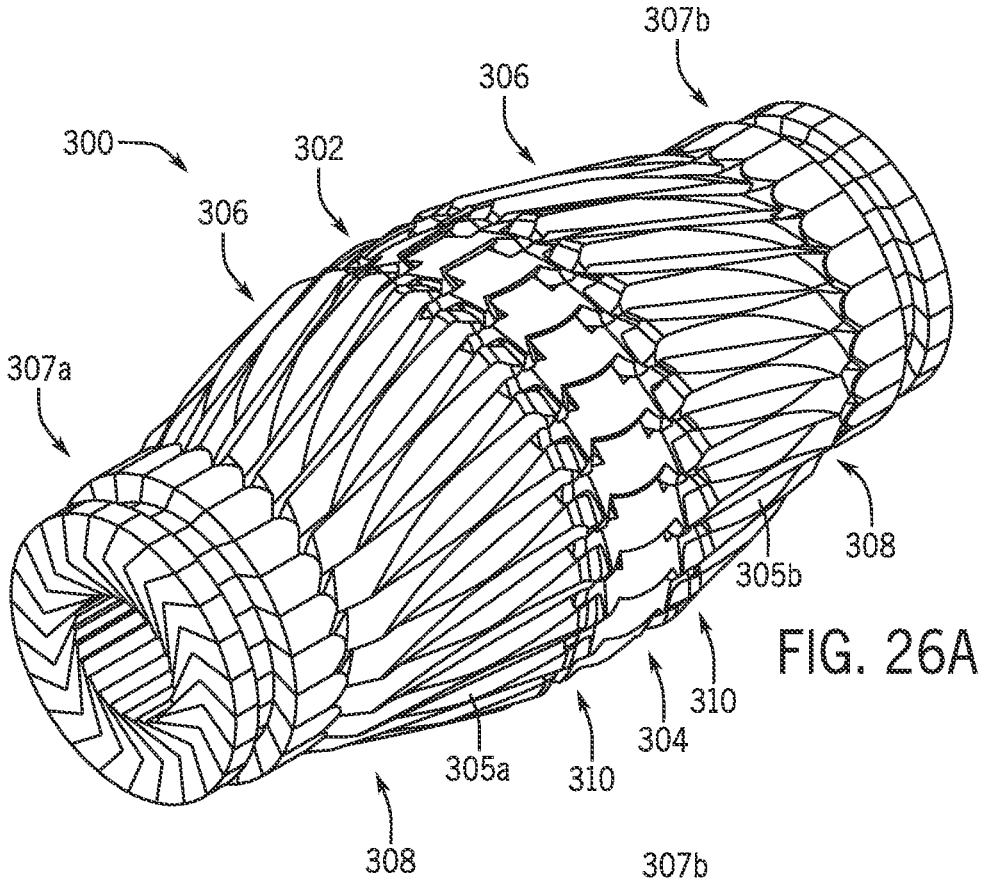
FIGS. 26A and 26B are respective isometric and sectional views of the apparatus of FIGS. 25A and 25B in a partially expanded condition, in accordance with embodiments of the present disclosure.
Figure 26B:
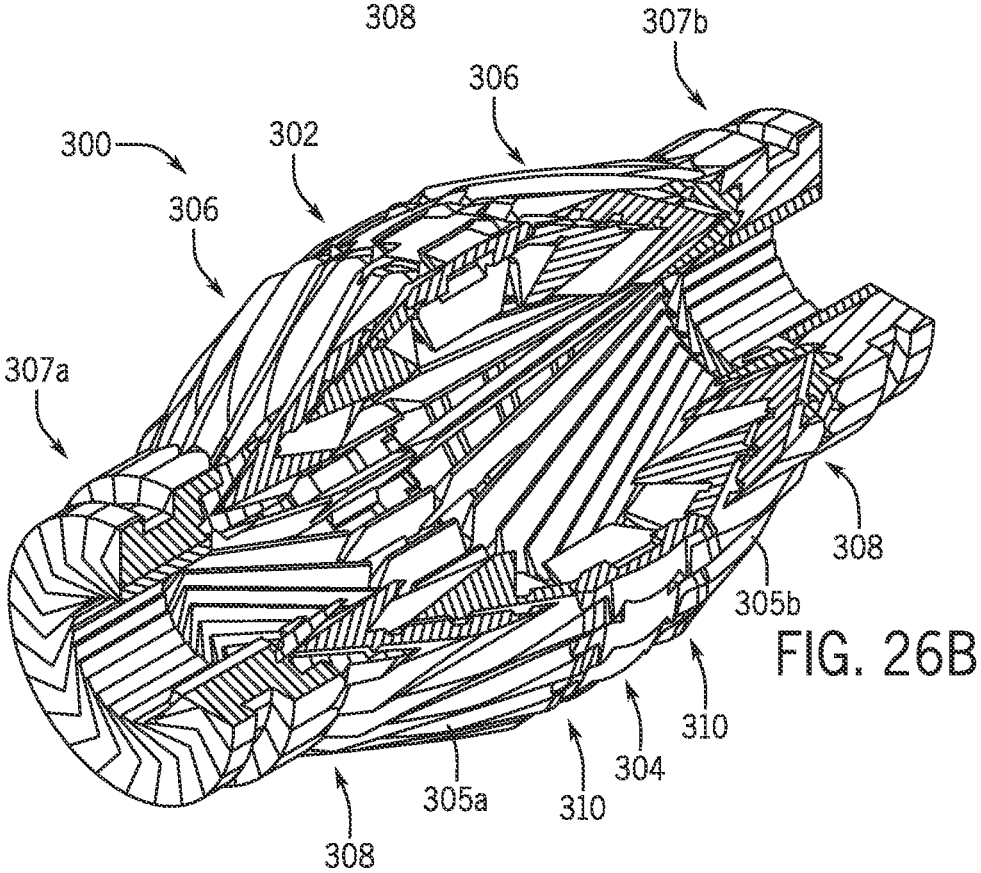
Figure 27A:
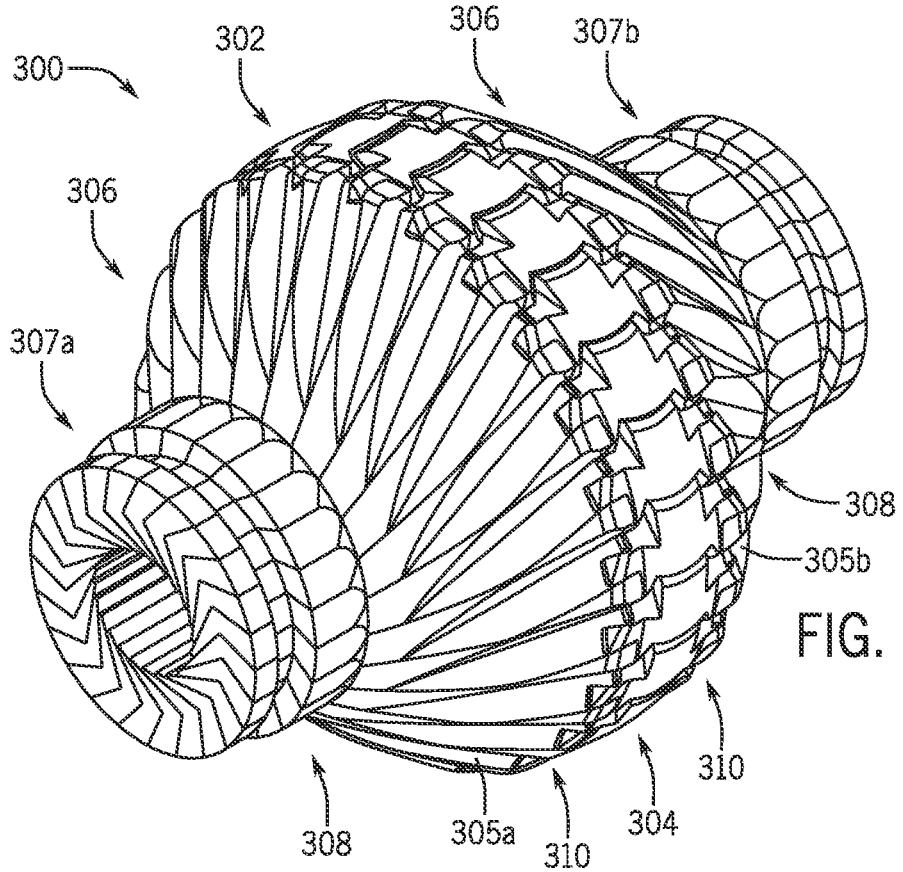
FIGS. 27A and 27B are respective isometric and sectional views of the apparatus of FIGS. 25A through 26B in a fully expanded condition, in accordance with embodiments of the present disclosure.
Figure 27B:
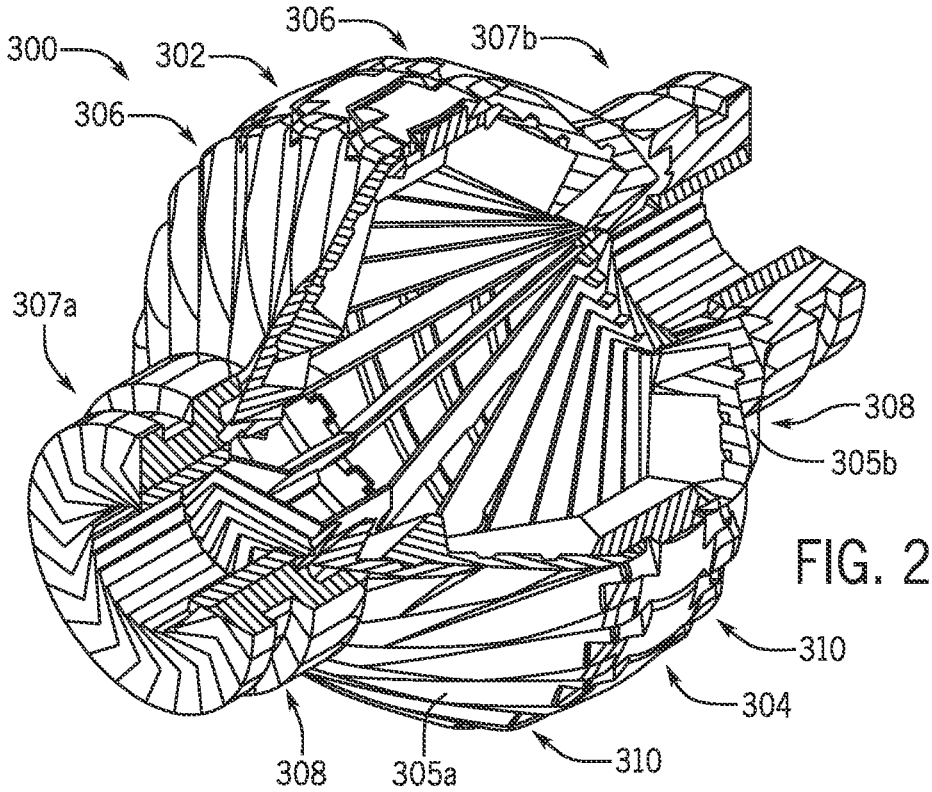

Referring now to FIGS. 25A through 36B, there is shown an expanding and collapsing apparatus 300 according to alternative embodiments. FIGS. 25A and 25B are respective isometric and sectional views of the apparatus 300 in a collapsed condition, FIGS. 26A and 26B are respective isometric and sectional views of the apparatus 300 in a partially expanded condition, and FIGS. 27A and 27B are respective isometric and sectional views of the apparatus 300 in a fully expanded condition.

The apparatus 300 is substantially similar to the apparatus 50, 80, and will be understood from FIGS. 5A through 18B and the accompanying description. As illustrated, in certain embodiments, the apparatus 300 includes an expansion assembly formed from a plurality of elements, including a set of ring elements 302 assembled to form a centrally disposed ring structure 304 around a longitudinal axis. In certain embodiments, the ring structure 304 is configured to be moved between an expanded condition and a collapsed condition by sliding the ring elements 302 with respect to one another in a direction tangential to a circle concentric with the ring structure 304 formed by the ring elements 302. Two sets 305*a*, 305*b* of structural elements 306 (i.e., support elements) are in the form of cone segments. As illustrated, in certain embodiments, first ends 308 of each of the support elements 306 may be connected to a respective retaining ring 307*a*, 307*b* (i.e., base element). In addition, in certain embodiments, second ends 310 of each of the support elements 306 may be connected to a respective ring element 302. In certain embodiments, each ring element 302 is connected to a pair of support elements 306, one from each of the respective sets 305*a*, 305*b*, at second ends 310 of the support elements 306. In the collapsed condition, the apparatus 300 has a first outer diameter, which is defined by the outer surfaces of the ring elements 302.

Figure 28:
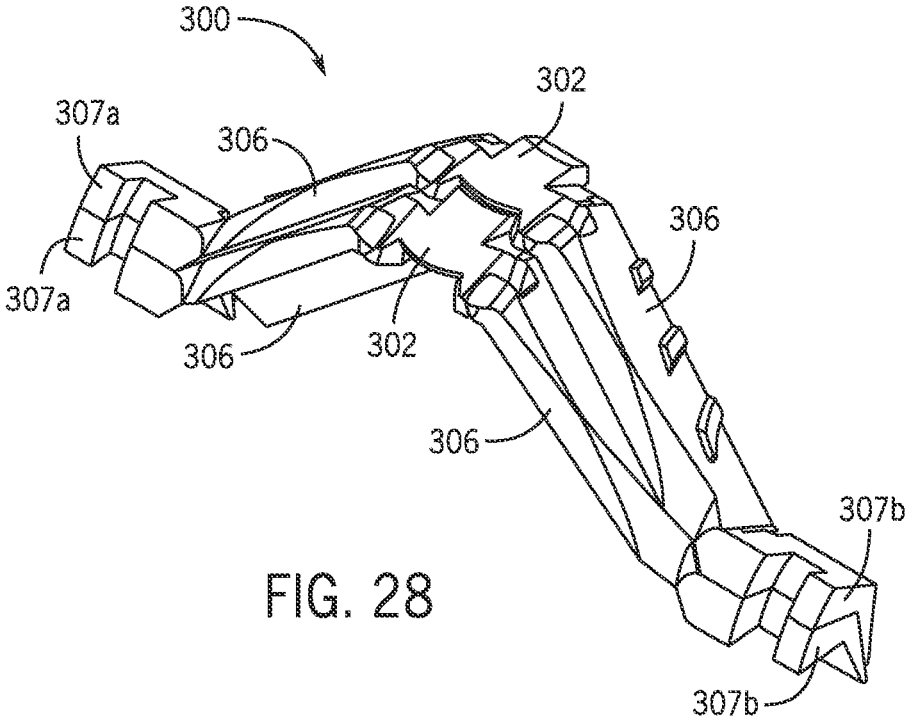
FIG. 28 is a perspective view of two central ring elements, two pairs of sets of support elements, and two pairs of base elements, illustrating how these elements of the apparatus of FIGS. 25A through 27B interact with each other, in accordance with embodiments of the present disclosure.
Figure 29A:
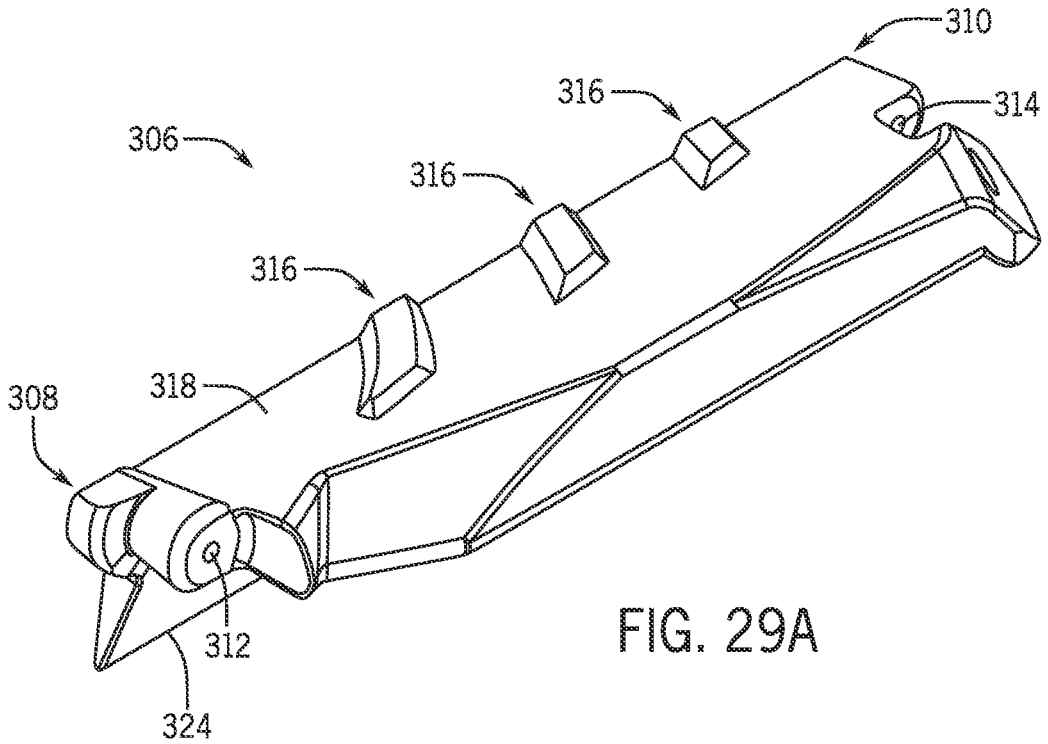
FIGS. 29A through 29D are various views of the support elements of the apparatus of FIGS. 25A through 27B, in accordance with embodiments of the present disclosure.
Figure 29B:
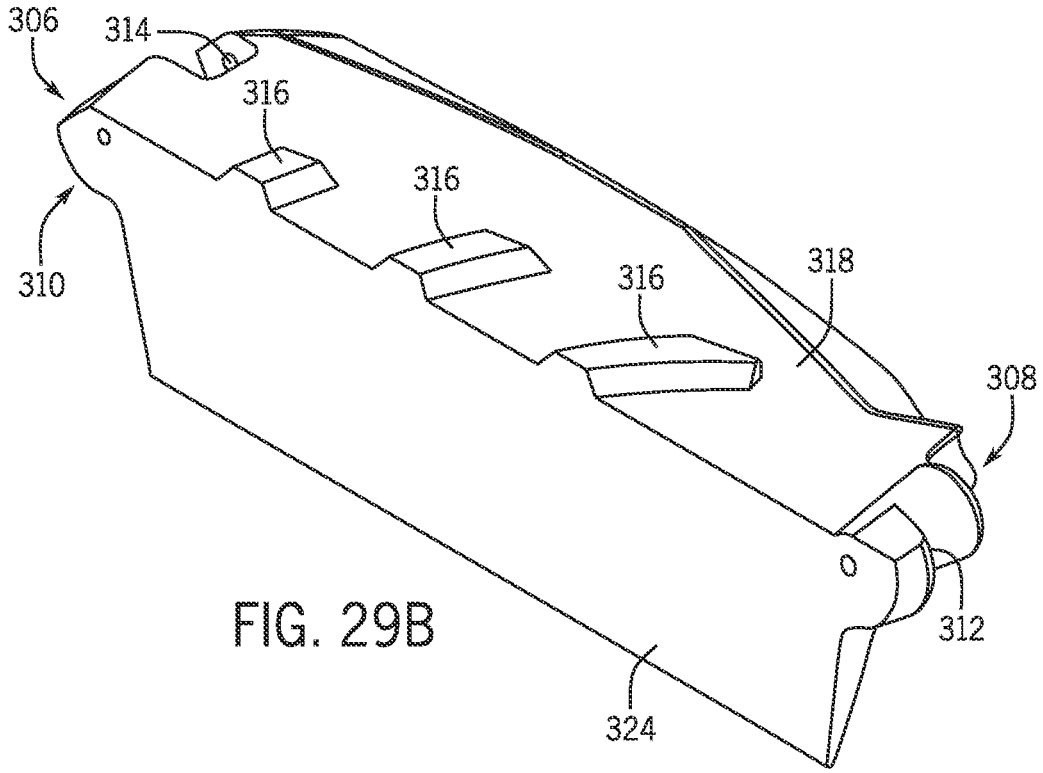
Figure 29C:
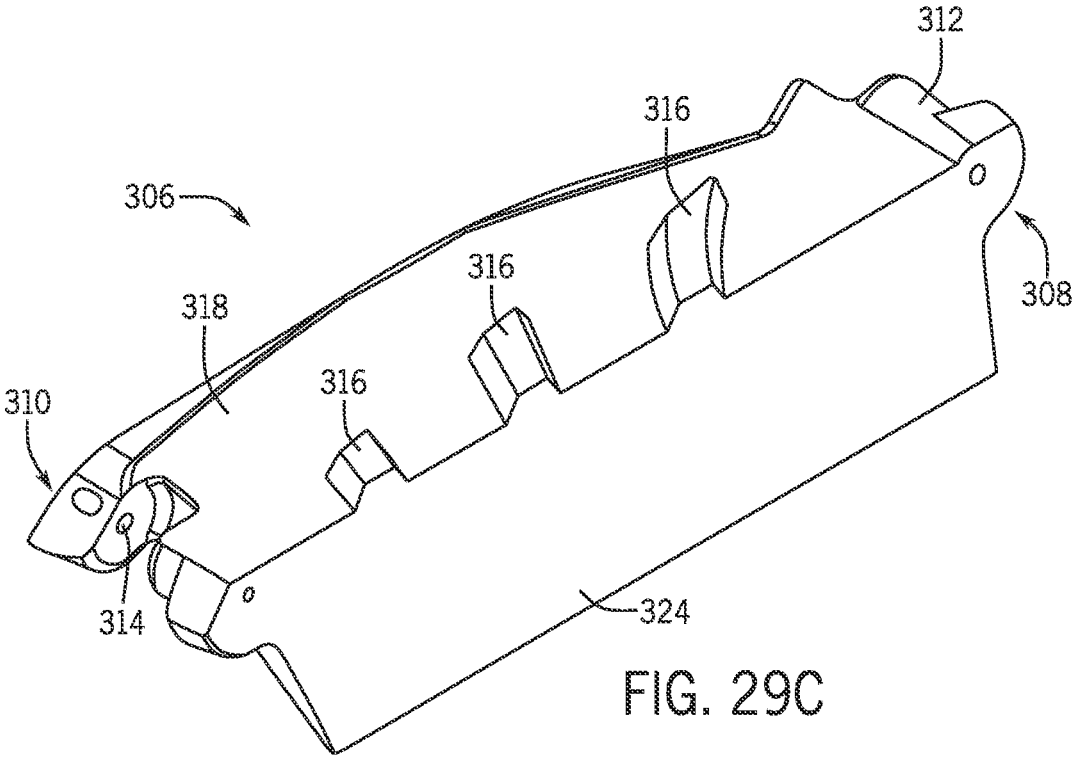
Figure 29D:
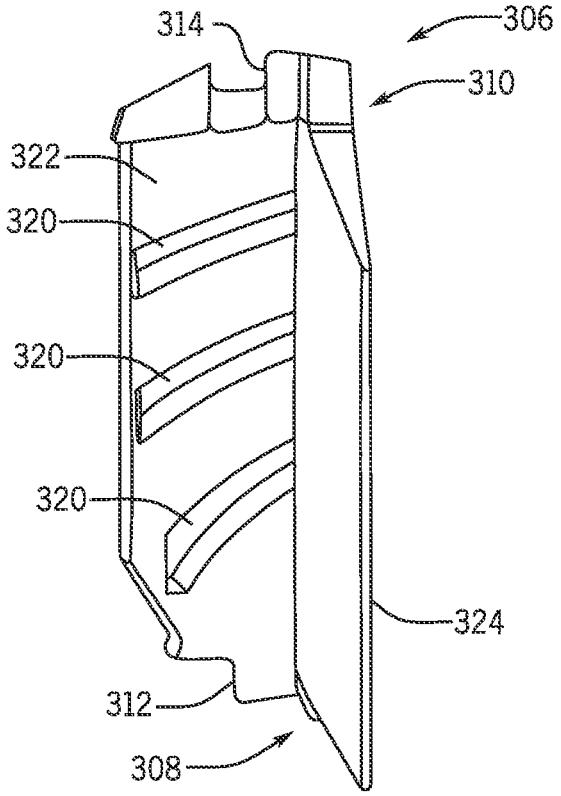

The support elements 306 are described with reference to FIGS. 29A through 32G, the ring elements 302 are described with reference to FIGS. 33A through 35, and the base elements 307*a*, 307*b* are described with reference to FIGS. 36A and 36B. In addition, FIG. 28 is a perspective view of two central ring elements 302, two pairs of sets 305*a*, 305*b* of support elements 306, and two pairs of base elements 307*a*, 307*b*, illustrating how these elements of the apparatus 300 interact with each other in the fully expanded condition illustrated in FIGS. 27A and 27B.

Operation of the apparatus 300 is substantially similar to the operation of the apparatus 50, 80 described above. The apparatus 300 may be actuated to be radially expanded from the collapsed condition having a first diameter to the expanded condition having a second diameter by an axial actuation force. The axial actuation force acts on one or both of the retaining rings 307*a*, 307*b* to move one or both with respect to a mandrel (not shown). The axial actuation force moves the one or both retaining rings 307*a*, 307*b* in a longitudinal (e.g., axial) direction toward the ring elements 302. The axial actuation force acts through the sets 305*a*, 305*b* of support elements 306 to impart axial and radial force components onto the ring elements 302. The retaining rings 307*a*, 307*b* may move the first end 308 of the support elements 306 in a longitudinal (e.g., axial) direction and the second end of the support elements in the axial direction toward the ring elements 302 and in a radially outward direction with respect to the longitudinal axis. Movement of the support elements 306 may impart the axial and radial force components onto the ring elements 302. In certain embodiments, radial expansion of the ring structure 304 may be resisted by a force created by a circumferential spring or external sleeve (e.g., made of an elastic material), but when the force is overcome, the ring elements 302 of the central ring structure 304 may be moved radially outward from the collapsed position, towards the partially expanded condition shown in FIGS. 26A and 26B, and then towards the fully expanded condition shown in FIGS. 27A and 27B. As the ring structure 304 moves radially outward, the ring elements 302 pivot with respect to the base elements 307*a*, 307*b* and the ring elements 302 to create a pair of conical support structures (e.g., via the support elements 306) for the ring structure 304. The ring elements 302 slide tangentially with respect to one another to expand the center ring structure 304 as the first ends 308 of the cone elements 306 are moved towards one another.

FIGS. 29A through 29D are various views of the support elements 306 of the apparatus 300. As illustrated, in certain embodiments, each of the support elements 306 includes various features that facilitate the expanding and collapsing nature of the apparatus 300. For example, in certain embodiments, each of the support elements 306 may include a first hinge 312 disposed at the first end 308 of the support element 306 and a second hinge 314 disposed at the second end 310 of the support element 306. In general, support hinges 312, 314 facilitate connection between the support elements 306 and adjacent elements around a respective pivot axis, as described in greater detail herein. For example, lower support hinges 312 may couple to a respective ring mating hinge to facilitate a lower hinge connection between the respective support element 306 and an adjacent retaining ring 307 (e.g., base element), and upper support hinges 314 may couple to a respective element mating hinge to facilitate an upper hinge connection between the respective support element 306 and an adjacent central ring element 302.

As described in greater detail below, each of the hinges 312, 314 may include axes of rotation that align with axes of rotation of the ring mating hinges of adjacent base elements 307 (e.g., a lower hinge axis of rotation) or the element mating hinges of adjacent central ring elements 302 (e.g., an upper hinge axis of rotation). In certain embodiments, the lower hinge connection and the upper hinge connection may be angularly offset such that axial movement of the hinge may cause the ring elements 302 to move radially outward (e.g., expand), as well as slide with respect to one another in a direction tangential to a circle concentric with the ring structure 304 formed by the ring elements 302. The hinges 312, 314 allow compression/tension to be applied to the apparatus 300 along it axis, allowing positive expansion and retraction to be controlled by the relative position of the base elements 307 to each other. In certain embodiments, the upper and/or lower hinge connections comprise ball and socket connections, knuckle and socket connections, hinge and pin connections, or any suitable rotatable connection.

In addition, in certain embodiments, each of the support elements 306 may include a first interlocking feature, which may include a set of male interlock features 316 disposed on an upper planar contact surface 318 (e.g., outer surface) of the support element 306. Furthermore, in certain embodiments, each of the support elements 306 may include a second interlocking feature, which may include a set of female interlock features 320 disposed on a lower planar contact surface 322 (e.g., inner surface) of an adjacent support element 306. The first interlocking feature may be configured to interlock with the second interlocking feature of an adjacent support element 306. For example, each male interlock feature of a set of male interlock features 316 of a support element 306 may be configured to mate with corresponding female interlock features of a set of female interlock features 320 of an adjacent support element 306. In certain embodiments, the first interlocking feature may be configured to interlock with the second interlocking feature of the adjacent support element 306 in the expanded condition. In certain embodiments, the first interlocking feature is configured to at least partially interlock with the second interlocking feature of the adjacent support element in the collapsed condition. For example, in certain embodiments, the first interlock feature may include two male interlock features 316 (e.g., first male interlock feature and second male interlock feature) and the second interlock feature may include two female interlock features 320 (e.g., first female interlock feature and second female interlock feature). In certain embodiments, the collapsed condition, the first male interlock feature may interlock with the first female interlock feature; however, the second male interlock feature may disengage from the second female interlock feature. In yet other embodiments, the first interlocking feature may be configured to fully disengage from the second interlocking feature when in the collapsed condition.

In addition, in certain embodiments, each of the support elements 306 may include a secondary wedge 324 (e.g., support load feature) configured to support a radial load exerted on the ring structure 304. In certain embodiments, the secondary wedge 324 may take the form of a wall portion that extends at least partially radially inward, with respect to the ring structure 304, from a portion of the inner surface of the support element 306. In certain embodiments, the secondary wedge 324 may extend substantially perpendicular from a portion of the inner surface of the support element 306. In other embodiments, the secondary wedge 324 may extend radially inward, with respect to the ring structure 304, from a lateral side 315 of the inner surface of the support element 306. In certain embodiments, the secondary wedge 324 has a first surface 301 and a second surface 303. In certain embodiments, the second surface 303 may be disposed between 2 degrees and 45 degrees offset from the first surface. An angle between the first surface 301 and the second surface 303 may form a secondary wedge angle of the secondary wedge 324 of the support element 306.

With respect to the hinges 312, 314 of the support elements 306, in certain embodiments, expansion and contraction motion of the elements of the expanding and collapsing apparatus described herein may not be strictly controlled. For example, in certain embodiments, mechanical connection between the elements of the apparatus may not be present during retraction, and instead may be reliant on point-contact during expansion, thereby resulting in a certain degree of uncertainty during expansion that the elements will be correctly aligned, as well as a certain amount of reliance on spring-forces for retraction.

Figure 30:
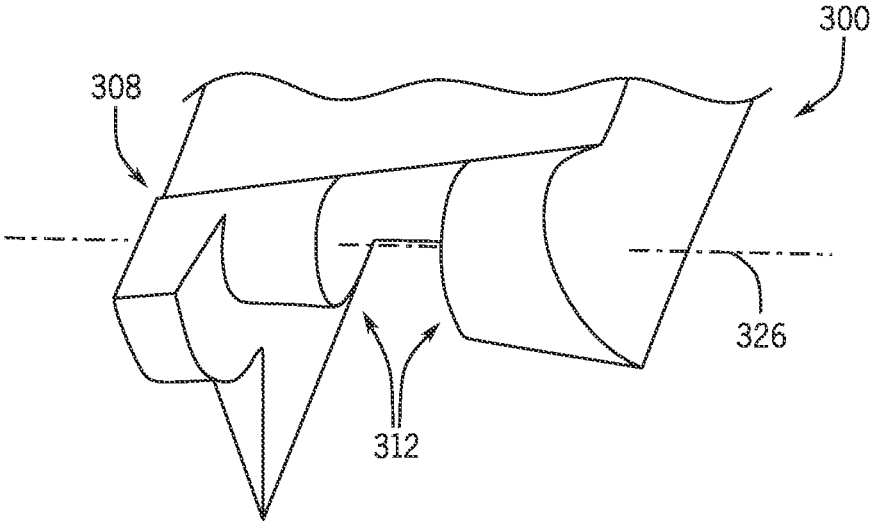
FIG. 30 is a partial perspective view of a support element, illustrating an axis that is formed by a hinge disposed on the first end of the support element.

However, an understanding of the geometry and motion of the elements allows appropriate pivot axes (e.g., upper hinge axis of rotation and lower hinge axis of rotation) to be determined for the hinges. These axes relate to the motion of the elements relative to an adjacent element of the apparatus (e.g., ring element with adjacent support element, support element with adjacent base element, and so forth). Elements rotate around these axes relative to the adjacent element. Using these determined axes, the hinges 312, 314 of the support elements 306 may be created to allow a continuous mechanical connection between all elements of the apparatus 300 during expansion and contraction. For example, FIG. 30 is a partial perspective view of a support element 306, illustrating an axis 326 that is formed by the hinge 312 disposed on the first end 308 of the support element 306. The axis 326 is determined to facilitate the relative motion of the support element 306 with respect to an adjacent base element 307. It will be appreciated that all of the other hinges described herein (e.g., the hinges 312, 314 of the support elements 306, as well as hinges of the ring elements 302 and the base elements 307, may be similarly constructed based on a determination of the relative motion between the respective elements.

Figure 31A:
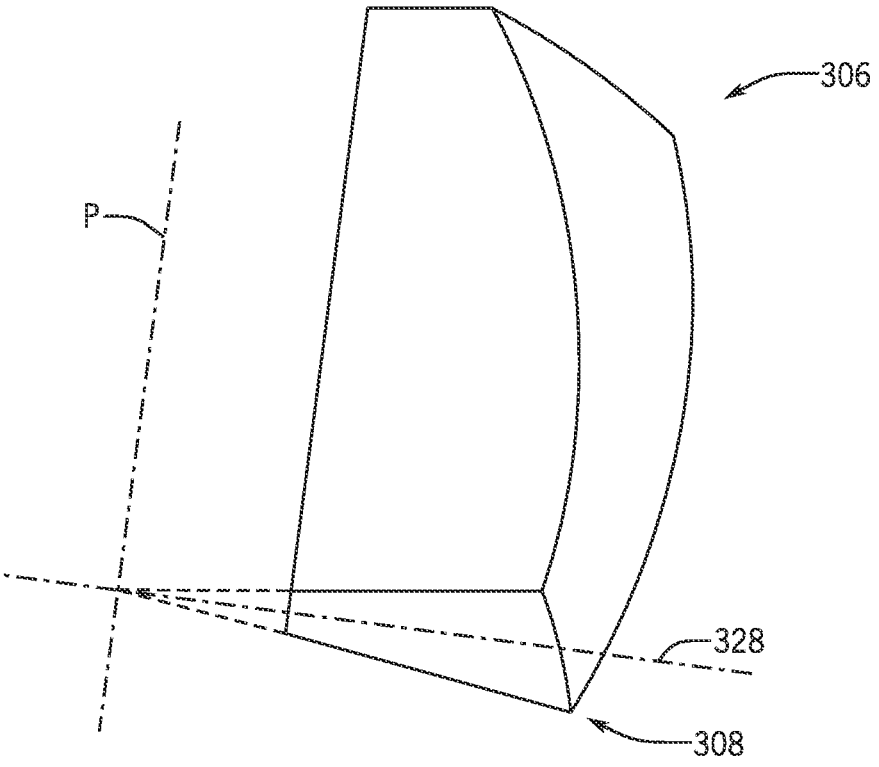
FIGS. 31A and 31B are geometric reference diagrams, useful for understanding how a support element as described herein may be formed, in accordance with embodiments of the present disclosure.
Figure 31B:
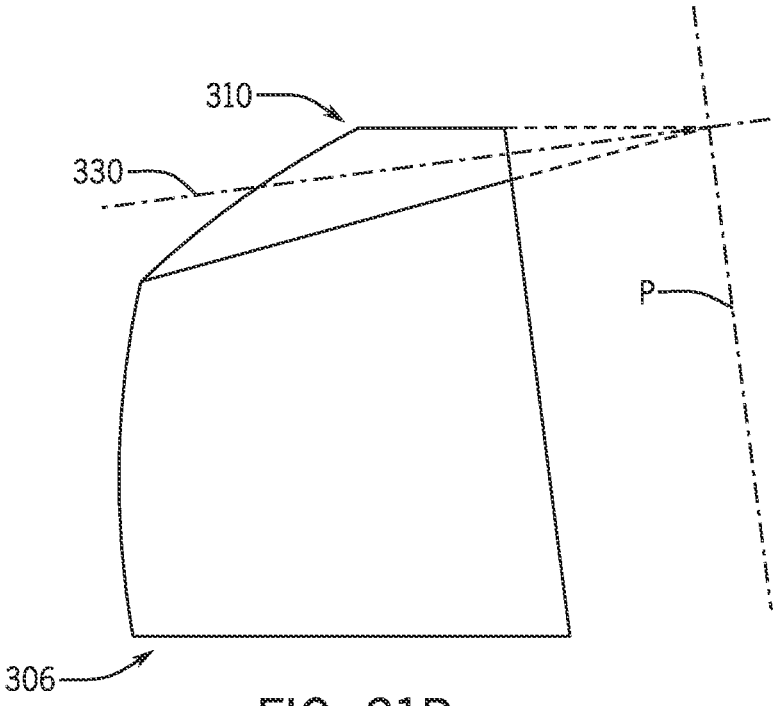

Motion of the support elements 306 relative to adjacent elements of the expanding and collapsing apparatus 300 is governed by their shape, and FIGS. 31A and 31B are useful for understanding the manner in which the shape of the support elements 306 is created in certain embodiments. For example, a bisecting line between the upper planar contact surface 318 and the lower planar contact surface 322 (i.e., a line that is equidistant from the upper planar contact surface 318 and the lower planar contact surface 322) at both bottom and top faces (i.e., at the first end 308 and the second end 310, respectively) of the support elements 306 forms the rotation axes for the support elements 306 at the bottom and top faces. In general, these axes are perpendicular to the motion plane P for the support elements 306.

For example, FIG. 31A illustrates a bisecting line 328 between the upper planar contact surface 318 (e.g., outer surface) and the lower planar contact surface 322 (e.g., inner surface) of a support element 306 at the bottom face (i.e., at the first end 308 of the support element 306), which is perpendicular to the motion plane P. In certain embodiments, the bisecting line 328 defines the lower hinge axis of rotation 329 for the lower hinge connection between the first end 308 of the support element 306 and the retaining ring 307. As such, the lower hinge axis of rotation 329 extends along the first end 308 of the support element 306 and is substantially equidistant from a lower outer edge 317 and a lower inner edge 319. In certain embodiments, the lower outer edge 317 corresponds to an edge between the outer surface 318 and the first end 308 of the support element 306 and the lower inner edge 319 corresponds to an edge between the inner surface 322 and the first end 308 of the support element 306.

Similarly, FIG. 31B illustrates a bisecting line 330 between the upper planar contact surface 318 (e.g., outer surface) and the lower planar contact surface 322 (e.g., inner surface) of a support element 306 at the top face (i.e., at the second end 310 of the support element 306), which is perpendicular to the motion plane P. The bisecting line 330 defines the upper hinge axis of rotation 331 for the upper hinge connection between the second end 310 of the support element 306 and the respective ring elements 302. As such, the upper hinge axis of rotation 331 extends along the second end 310 of the support element 306 and is substantially equidistant from an upper outer edge 321 and an upper inner edge 323. In certain embodiments, the upper outer edge 321 corresponds to an edge between the outer surface 318 and the second end 310 of the support element 306 and the upper inner edge 323 corresponds to an edge between the inner surface 322 and the second end 310 of the support element 306. By revolving hinges 312, 314 around these determined axes, features can be developed that ensure a constant mechanical connection for the full range of expansion and retraction of the apparatus 300.

With respect to the interlocks 316, 320 of the support elements 306, in certain embodiments, load capacity on the expanding and collapsing apparatus described herein may be limited due to a lack of load-sharing between support elements 306. For example, in certain embodiments, the support elements 306 may not support each other in directions parallel to upper and lower planes. Introduction of the interlocks 316, 320 of the support elements 306 enables the support elements 306 to support adjacent elements in the respective array 305 in directions parallel to the upper and lower planes. In addition, the interlocks 316, 320 of the support elements 306 allow support for a relatively wide range of motion of the elements, not only a final determined position. Furthermore, the interlocks 316, 320 prevent relative movement of adjacent support elements 306 in an additional dimension. This allows support to be kept when the final expansion diameter is not known. Accordingly, the interlocks 316, 320 of the support elements 306 adds self-supporting functionality to support elements 306, prevents plane-plane movement of the support elements 306, which prevents bending, further constrains the freedom of movement of the expanding and collapsing apparatus 300, and allows further distribution/sharing of stress, such that the expanding and collapsing apparatus 300 acts more like a solid piece, as opposed to an assembly of parts.

As illustrated in FIGS. 29A through 29D, in certain embodiments, the male interlocks 316 of the first interlocking feature may be in the form of extensions of protrusions extending from the upper planar contact surfaces 318 (e.g., outer surface) of the support elements 306, which are configured to mate with female interlocks 320, of the second interlocking feature, of adjacent support elements 306, which may be in the form of similarly shaped grooves or recesses into the lower planar contact surfaces 322 (e.g., inner surface) of the support elements 306. In certain embodiments, using the lower pivot axis and the wedge profile, the center point of the expansion of the support elements 306 may be determined. For example, as described in greater detail below with respect to FIGS. 32B through 32G, concentric circles may be drawn from the center point, which create the path along which the sets of interlocks 316, 320 are created. A new lower center point may then be created by rotating the original upper center point around the primary axis of the cone ("x-axis") by an amount equal to the wedge angle of the support element 306.

Motion of the support elements 306 relative to adjacent support elements 306 is governed by their shape, and FIGS. 31A and 31B are useful for understanding the manner in which the shape of the support elements 306 is created in certain embodiments. As described above, each of the support elements 306 rotates around a pivot axis (e.g., lower hinge axis of rotation 329) of an adjacent base support 307 (e.g., via a hinge 312), and this pivot axis represents a neutral axis for the rotation of the support element 306 (i.e., its position will not change). Adjacent support elements 306 expanding relative to each other create a sinusoidal relationship (i.e., they move up and out relative to each other as a function of both the expansion angle and the wedge/element angle). This may be approximated as a guide circle centered on the neutral axis (e.g., the axis of its respective hinge 312) of the support elements 306.

The upper planar contact surface 318 (e.g., outer surface) of the support element 306 is not along this neutral axis. However, the upper planar contact surface 318 meets the neutral axis at an origin point 332 (see FIG. 32A), which is stationary. In certain embodiments, the origin point 332 may be disposed in a location offset from the respective support element 306. As illustrated in FIGS. 32B through 32G, concentric upper guide circles 334 may be drawn relative to the origin point 332 of the support element 306. In certain embodiments, the male interlocks 316 of the first interlocking feature are disposed along these concentric upper guide circles 334. For example, each protrusion of a set of protrusions of the male interlocks 316 are configured to respectively extend from the outer surface of a respective support element 306 along a respective protrusion guide path that follows a portion of a respective upper guide circle of the concentric upper guide circles 334.

When fully expanded, the upper planar contact surface 318 of one support element 306 is fully mated to the lower planar contact surface 322 of an adjacent support element 306. Thus, to create the female interlocks 320, respective origin points 332 of the support elements 306 are rotated by the wedge angle 336 (e.g., which is equal to an angle between the origin point 332 and a translated origin point 338) around the primary axis (e.g., "x-axis") 344 of the expanding and collapsing apparatus 300. In certain embodiments, the translated origin point 338 may be disposed in a location offset from the respective support element 306. From this point, the concentric lower guide circles 346 of the same dimension as the male interlocks 316 are created, and the female interlocks 320 of the second interlocking feature are created along these lines. That is, each recess of the set of recesses of the female interlocks 320 are configured to follow a respective recess guide path that follows a portion of a respective lower guide circle configured to pass through the respective support element 306. As such, the male interlocks 316 are centered on the origin point 332, while the female interlocks 320 are centered on the translated origin point 338.

In certain embodiments, adjustment techniques may be used to account for a "cam effect" as the male interlocks 316 swing into position during expansion. More simply, the channels on the lower side of the support elements 306 (i.e., the female interlocks 320 on the lower planar contact surfaces 322 of the support elements 306) are an inverse feature based on the ribs on the upper side of the support elements 306 (i.e., the male interlocks 316 on the upper planar contact surfaces 318 of the support elements 306), rotated at the wedge angle around the x-axis for their position to mate correctly with an adjacent support element 306. In certain embodiments, an upper guide circle and a corresponding lower guide circle may have a substantially similar diameter (e.g., diameters within 5% of each other, within 2% of each other, within 1% of each other, or even closer). Furthermore, in certain embodiments, the origin point 332 of the respective upper guide circle may be offset from the translated origin point 338 of the respective lower guide circle.

Figure 32A:
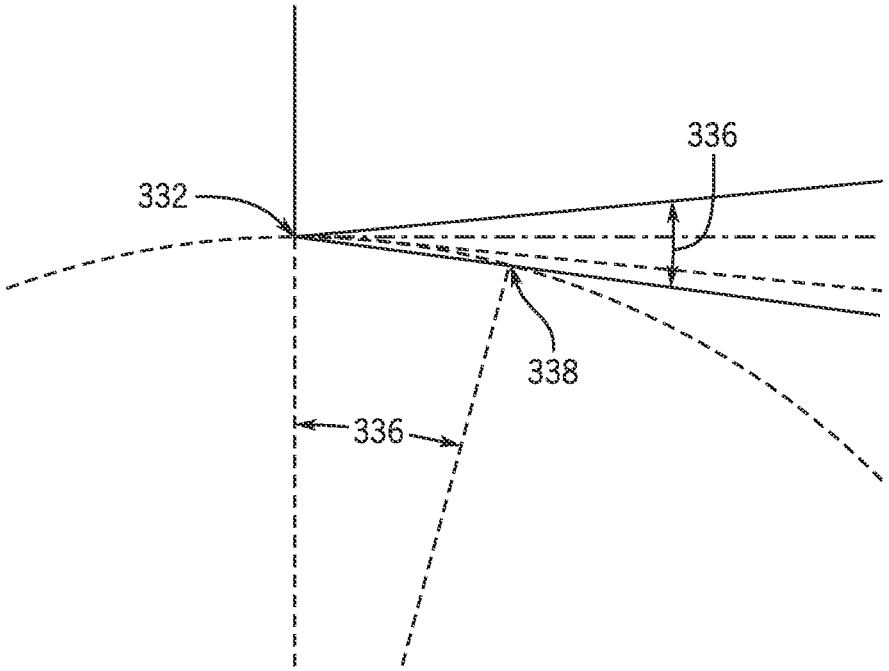
FIGS. 32A through 32G are geometric reference diagrams, useful for understanding how a support element as described herein may be formed, in accordance with embodiments of the present disclosure.
Figure 32B:
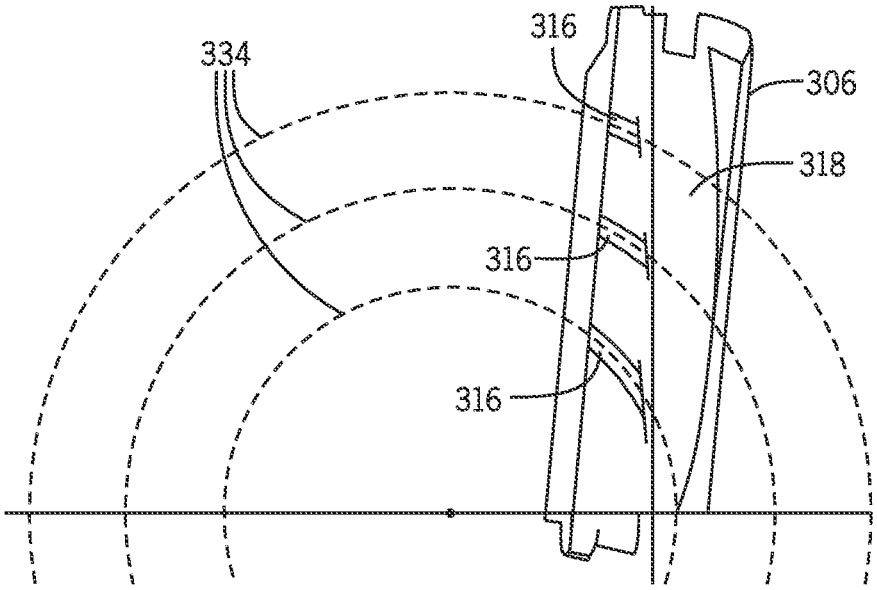
Figure 32C:
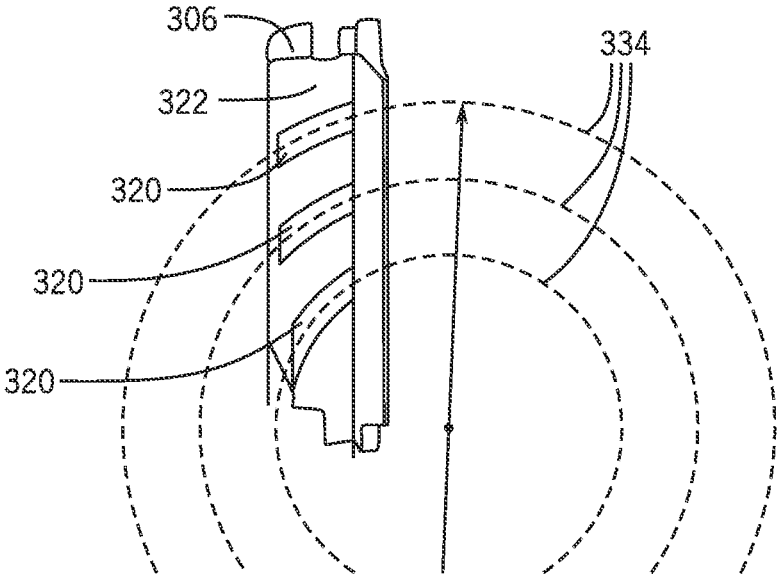
Figure 32D:
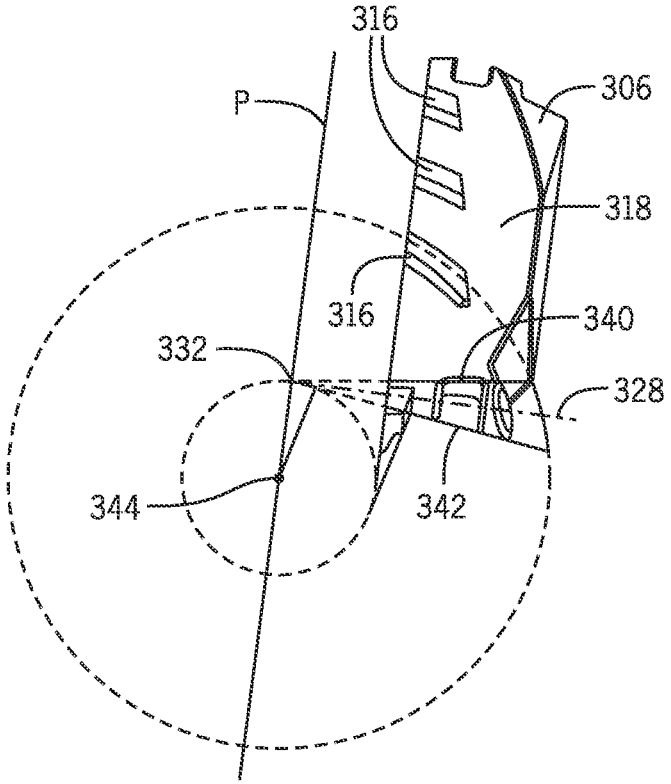
Figure 32E:
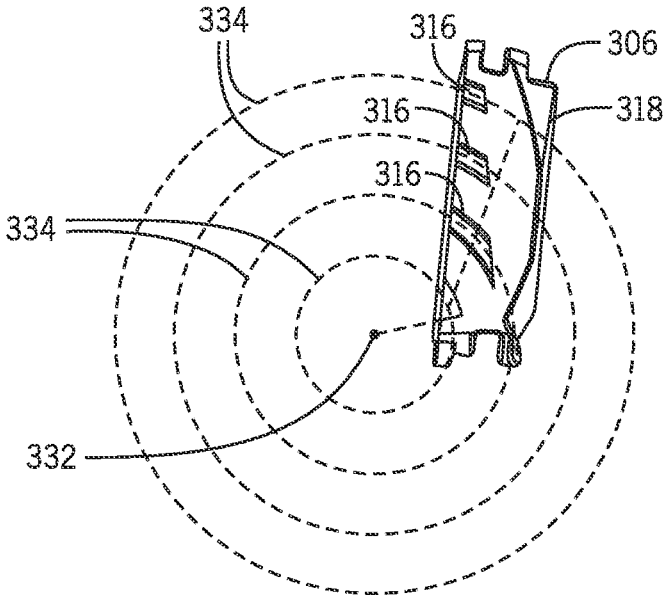
Figure 32F:
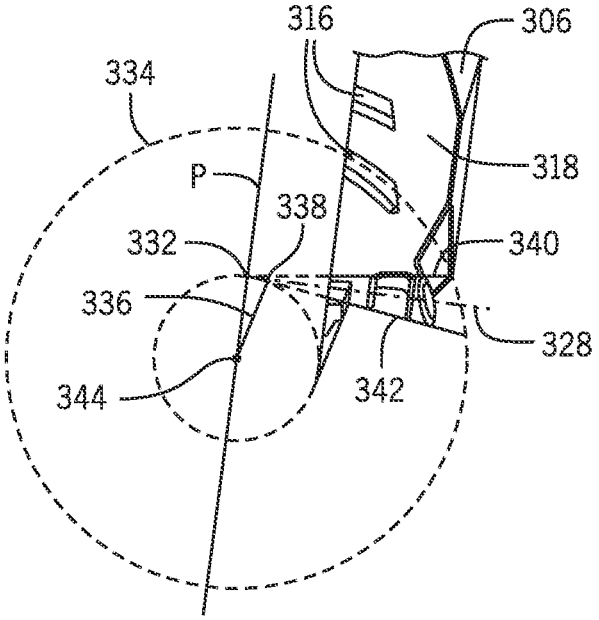
Figure 32G:
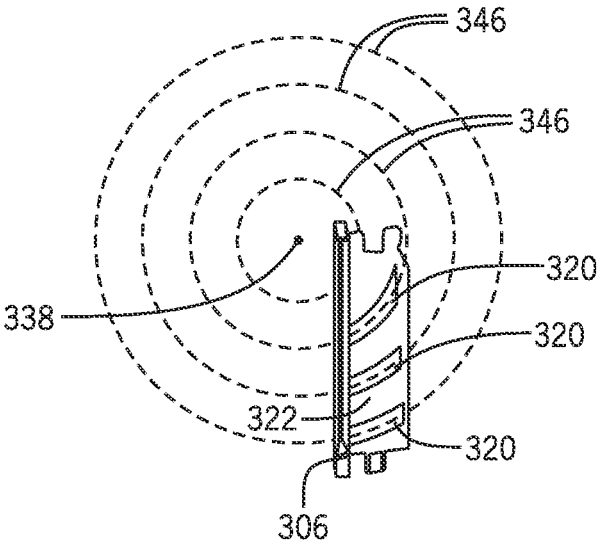

As illustrated in FIG. 32D, the origin point 332 may be defined as the intersection of converging lines corresponding to edges 340, 342 (i.e., which relate to the upper planar contact surface 318 and the lower planar contact surface 322, respectively) of the support elements 306, wherein the origin point 332 is a point along the motion plane P from the primary rotation axis (e.g., "x-axis") 344 of the expanding and collapsing apparatus 300. As illustrated in FIG. 32E, the concentric circles 334 from the origin point 332 define the location at which the male interlocks 316 are disposed along the upper planar contact surface 318 of the support elements 306. As illustrated in FIG. 32F, as described above, the origin point 332 (i.e., the "upper origin point") may be defined as the convergence point of the lines (e.g., that form the wedge angle 336) corresponding to edges 340, 342 of the support elements 306, and the translated origin point 338 (i.e., the "lower origin point") may be defined as rotation of the wedge angle from the origin point 332 around the x-axis 344. As illustrated in FIG. 32G, concentric circles 346 from the translated origin point 338 define the location at which the female interlocks 320 are disposed along the lower planar contact surface 322 of the support elements 306.

FIGS. 33A through 33E are various views of the ring elements 302 of the apparatus 300. As illustrated, in certain embodiments, each of the ring elements 302 includes various features that facilitate the expanding and collapsing nature of the apparatus 300. For example, in certain embodiments, each of the ring elements 302 may include a first hinge 348 disposed on a first side 350 of the ring element 302 and a second hinge 352 disposed on a second side 354 of the ring element 302. In general, the hinges 348, 352 facilitate connection between the ring elements 302 and adjacent support elements 306 around a respective pivot axis, as described in greater detail herein. For example, the hinges 348 facilitate connection between the respective ring element 302 and an adjacent support element 306 of the first set 305*a* of support elements, and the hinges 352 facilitate connection between the respective ring element 302 and an adjacent support element 306 of the second set 305*b* of support elements. As described in greater detail above, similar to the hinges 312, 314 of the support elements 306, each of the hinges 348, 352 of the ring elements 302 may include axes of rotation that align with axes of rotation of mating hinges 314 of adjacent support elements 306. The orientation of the axes of rotation of the hinges 348, 352 of the ring elements 302 may be determined in a substantially similar manner as described above with respect to the hinges 312, 314 of the support elements 306.

Figure 33A:
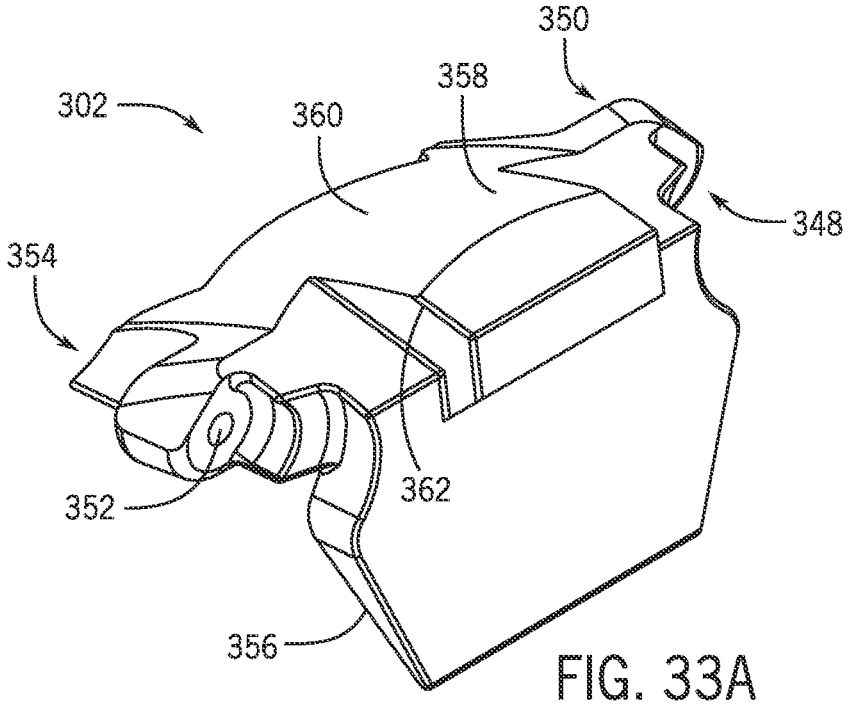
FIGS. 33A through 33E are various views of the ring elements of the apparatus of FIGS. 25A through 27B, in accordance with embodiments of the present disclosure.
Figure 33B:
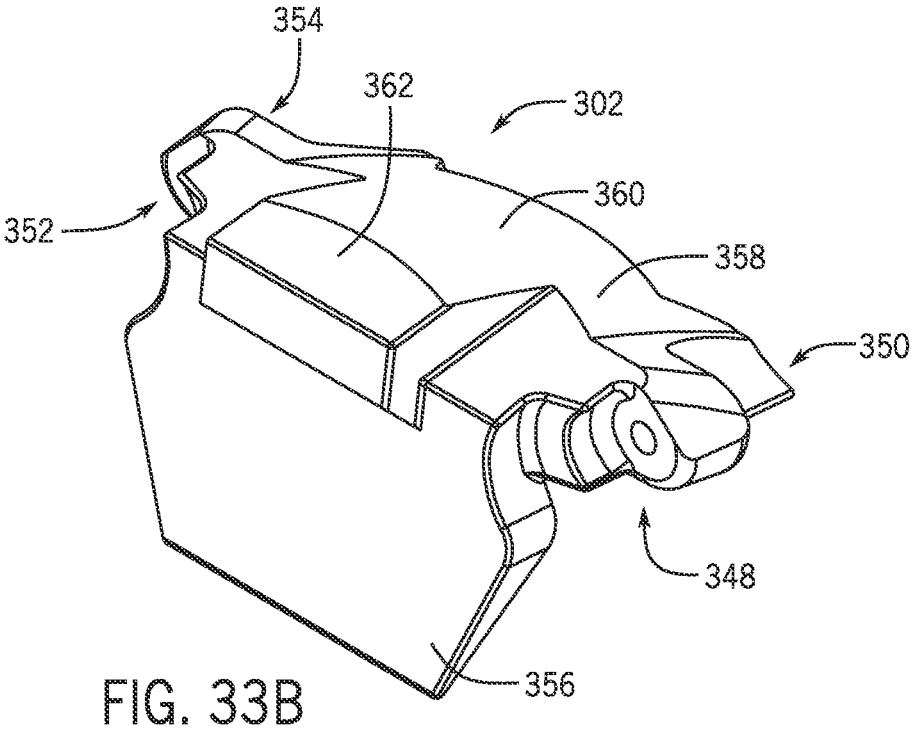
Figure 33C:
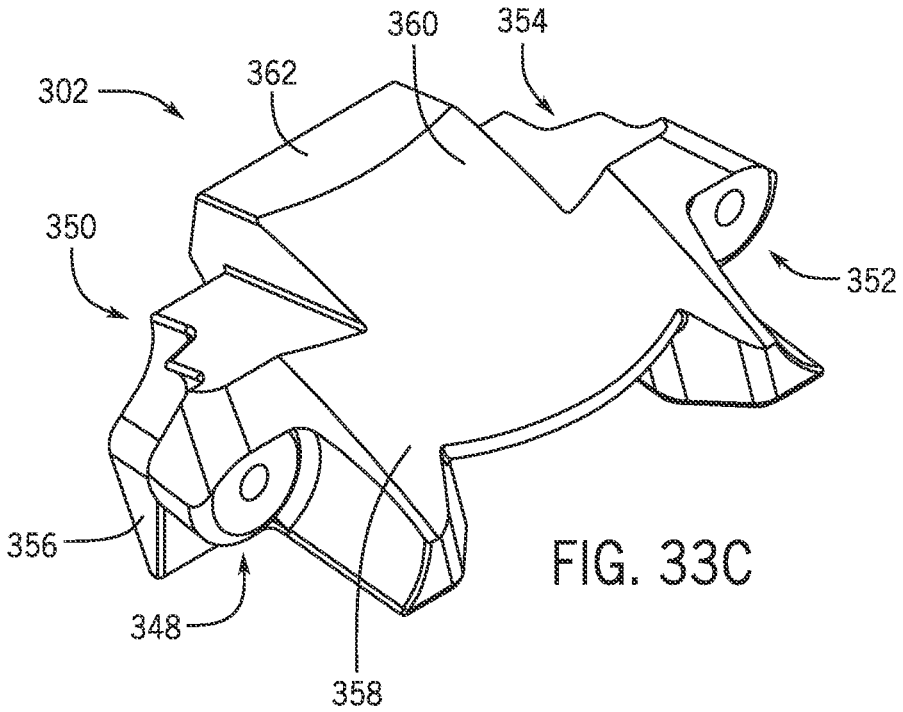
Figure 33D:
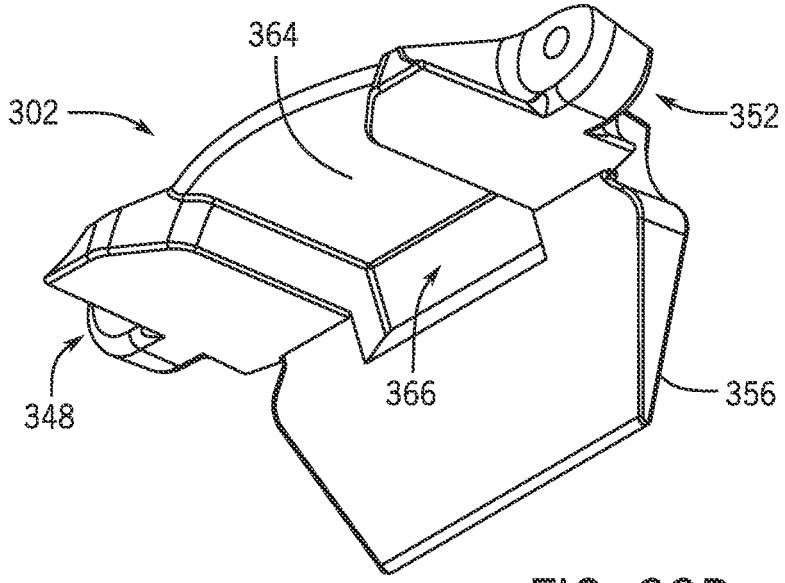
Figure 33E:
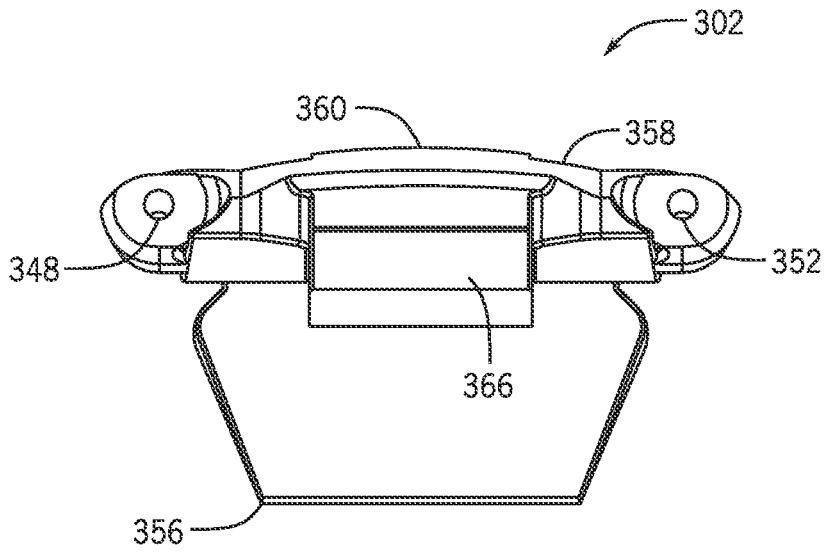

In addition, in certain embodiments, each of the ring elements 302 may include a secondary wedge 356, which may take the form of a wall portion that extends substantially perpendicular from a side of a ring cap 358 of the ring element 302. In addition, as illustrated in FIGS. 33A through 33C, in certain embodiments, the ring cap 358 of the ring element 302 may include a domed outer geometry 360 having a male dovetail 362. In addition, as illustrated in FIGS. 33D and 33E, in certain embodiments, the ring cap 358 may include an inner geometry 364 having a female dovetail 366, which is configured to mate with a male dovetail 362 of an adjacent ring element 302.

With respect to the secondary wedge 356 of the ring elements 302, in certain embodiments, there may be relatively low strength provided by the elements of the expanding and collapsing apparatus described herein. For example, load characteristics of the expanding and collapsing apparatus may generate relatively large forces that are mostly perpendicular to the section of the element with the most material, thereby resulting in relatively large amounts of material of the expanding and collapsing apparatus being unstressed, while relatively small amounts of material of the expanding and collapsing apparatus being overstressed. Therefore, the load-bearing capacity of the expanding and collapsing apparatus may be limited by the relatively small amount of material being overstressed.

Altering the shape of the ring elements 302, as illustrated in FIGS. 33A through 33E, to include the secondary wedge 356 will help remove the unstressed areas, and add material to the relatively highly stressed areas without changing the expansion and contraction properties of the apparatus 300. In other words, adding the secondary wedge 356 to the ring elements 302 creates a more even stress distribution, and increases the capacity of the individual ring elements 302. It will be appreciated that the secondary wedges 324 of the support elements 306 (as well as the secondary wedges 378 of the base elements 307, described below) serve substantially similar purposes.

Figure 34A:
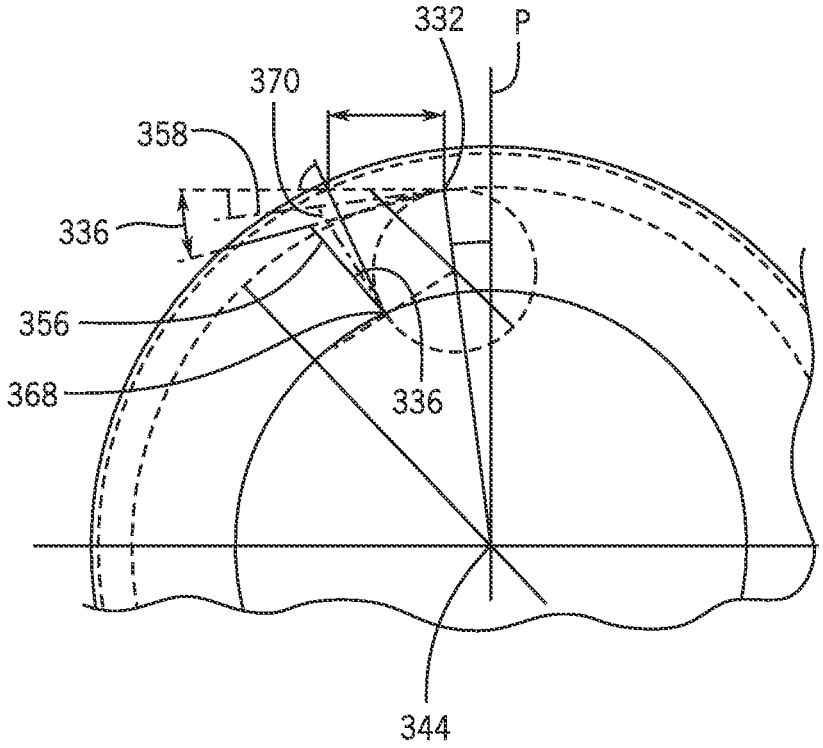
FIGS. 34A and 34B are geometric reference diagrams, useful for understanding how a ring element as described herein may be formed, in accordance with embodiments of the present disclosure.

As illustrated in FIG. 34A, in certain embodiments, the secondary wedge 356 of the ring elements 302 extends substantially perpendicular from an inner surface of the wedge (e.g., formed by the ring cap 358 of the ring elements 302). In certain embodiments, the ring cap 358 has an inner geometry 364 (e.g., inner surface) and an outer domed geometry 360 (e.g., outer surface) offset from the inner surface such the ring cap 358 has a wedge shape. An angle between the inner surface and the outer surface forms the wedge angle 336. In general, the wedge angle 336 of the wedge formed by the ring cap 358 of the ring element 302 is the same as (e.g., within 2 degrees, within 1.5 degrees, within 1 degree, within 0.5 degree, or even closer, in certain embodiments) the wedge angle 336 of the secondary wedge 356. A bisector line 368 may be formed between the two new edges of a first surface 359 and a second surface 361 of the secondary wedge 356 to create a secondary centerline 370, which is perpendicular to an imaginary line that passes through the center point (e.g., along the x-axis 344 of the expanding and collapsing apparatus 300) of the collapsed ring elements 302 (e.g., the longitudinal axis). For a cone segment, an additional step may be needed. For example, because the cone is designed in the expanded position, and rotates rather than slides to expand, the geometry should be translated to the collapsed position.

Figure 34B:
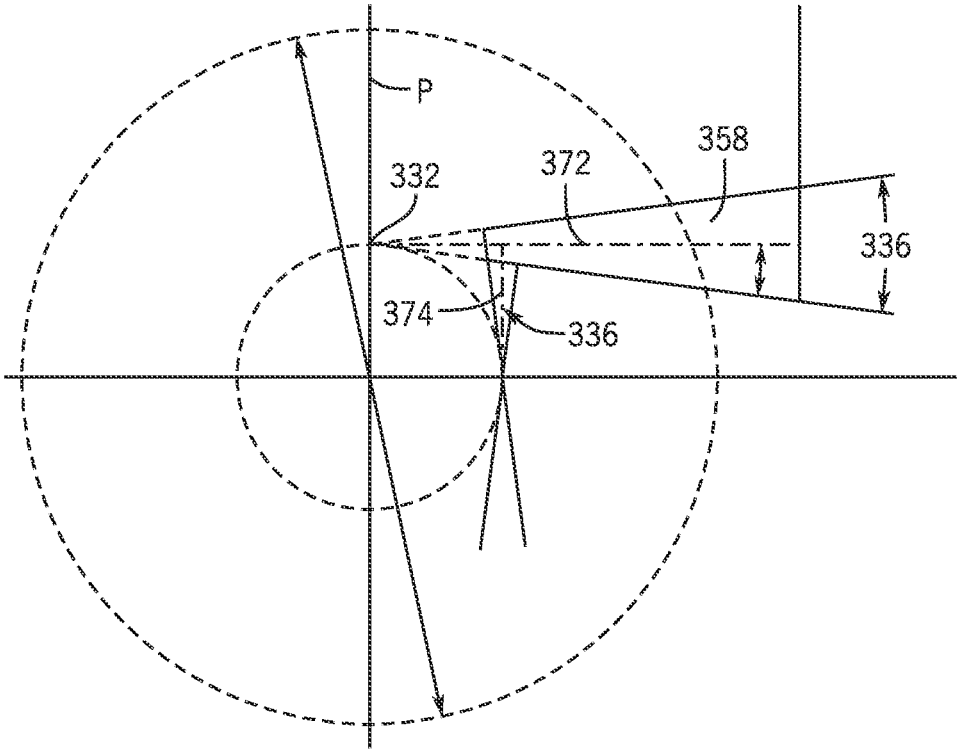

FIG. 34B illustrates a ring element 302 having a secondary wedge 356 (e.g., ring load feature) to differentiate from the simple wedge geometry discussed in reference to FIG. 3. As discussed above, the secondary wedge 356 may have the same wedge angle 336 as the primary wedge (e.g., formed by the ring cap 358). In general, the secondary wedge 356 lies below the direction of expansion. In certain embodiments, the secondary wedge 356 extends at least partially radially inward, with respect to the ring structure 304, from the inner surface of the ring element 302. In other words, the angle between a mid-plane line 372 of the primary wedge and a mid-plane line 374 of the secondary wedge 356 is between 0 degrees and 180 degrees. For example, in certain embodiments, the angle between a mid-plane line 372 of the primary wedge and a mid-plane line 374 of the secondary wedge 356 may be between approximately (90°−wedge angle/2) and 180°. In certain embodiments where the elements of the expanding and collapsing apparatus 300 are collapsing around a mandrel, the secondary wedge 356 may be trimmed if the lowest point passes below the diameter of the mandrel, in such a way that moving up along the motion plane would cause interference with the mandrel.

The secondary wedge 356 of the ring elements 302 increases the moment of inertia in the loading direction of the elements of the expanding and collapsing apparatus 300, thereby providing resistance to bending. In addition, the secondary wedge 356 of the ring elements 302 provides a positive stop for the ring elements 302 to prevent over-deflection. In addition, the secondary wedge 356 of the ring elements 302 allows a larger bearing area when under full load, thereby providing quantifiable limits to rotation/canting of the ring elements 302.

With respect to the domed outer geometry 360 of the ring cap 358 of the ring elements 302, in certain embodiments, the domed outer geometry 360 provides a feature that is rotationally symmetric around the primary axis of the ring structure 304 of the expanding and collapsing apparatus 300, thereby enabling a rolling motion against the casing while under load, as opposed to a pinching force. The domed outer geometry 360 protects a seal component (e.g., elastomer), described in greater detail below, from forces that would result in its potential damage. In addition, the domed outer geometry 360 allowed for greater pressure ratings, dependent upon the seal component used.

Figure 35:
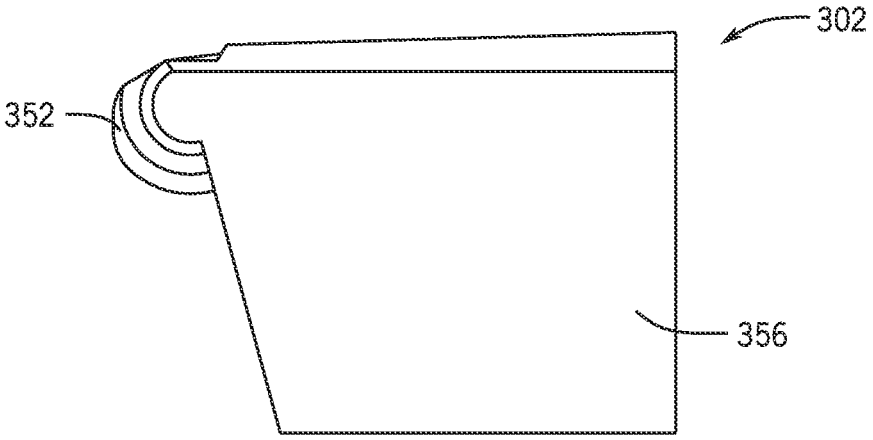
FIG. 35 is a partial side view of a ring element, in accordance with embodiments of the present disclosure.

As illustrated in FIGS. 33A through 33E, in certain embodiments, the hinges 348, 352 of the ring elements 302 may be a single hinge element configured to be inserted within two hinge elements of the hinges 312, 314 of the support elements 306. As illustrated in FIG. 35, in certain embodiments, the hinges of the ring elements 302 may be mitered according to the expansion angle to ensure full contact when at full expansion.

Figure 36A:
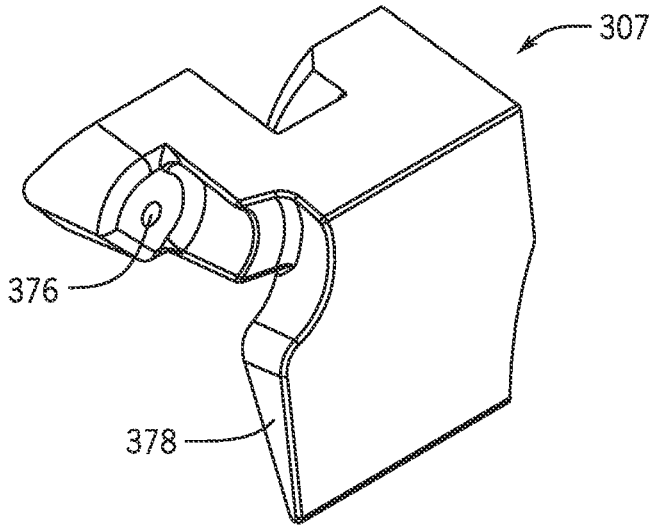
FIGS. 36A and 36B are perspective views of the base elements of the apparatus of FIGS. 25A through 27B, in accordance with embodiments of the present disclosure.
Figure 36B:
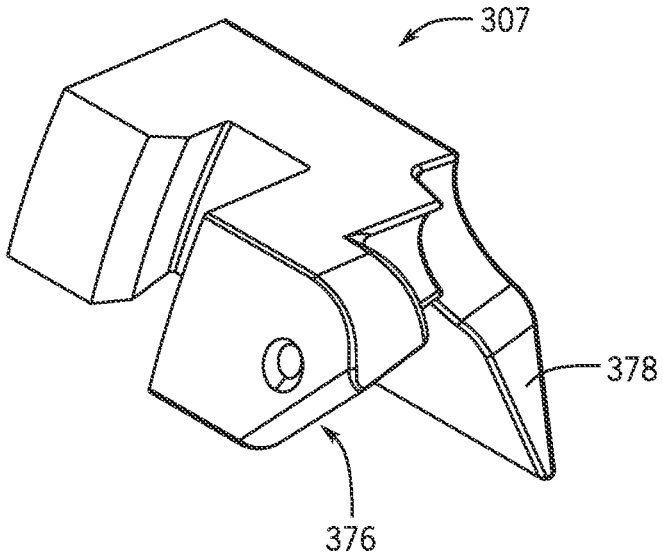

FIG. 36A and FIG. 36B are views of the base elements 307 of the apparatus 300. As illustrated, in certain embodiments, each of the base elements 307 includes various features that facilitate the expanding and collapsing nature of the apparatus 300. For example, in certain embodiments, each of the base elements 307 may include a hinge 376 that facilitates connection between the base elements 307 and adjacent support elements 306 around a respective pivot axis, as described in greater detail herein. For example, the hinge 376 facilitates connection between the respective base element 307 and an adjacent support element 306. As described in greater detail above, similar to the hinges 312, 314 of the support elements 306 and the hinges 348, 352 of the ring elements 302, the hinges 376 of the base elements 307 may include an axis of rotation that aligns with an axis of rotation of mating hinges 312 of adjacent support elements 306. The orientation of the axes of rotation of the hinges 376 of the base elements 307 may be determined in a substantially similar manner as described above with respect to the hinges 312, 314 of the support elements 306. In addition, in certain embodiments, each of the base elements 307 may include a secondary wedge 378, which may take the form of a wall portion that extends substantially perpendicular from the base element 307.

The embodiments of the apparatus 300 described herein may be incorporated into a sealing device 380 that may be used as part of a downhole tool 382 in a bottom hole assembly (BHA) of wireline or slickline. In particular, in certain embodiments, the sealing device 380 may be used as part of a retrievable bridge plug 382 used primarily in production environments. In certain embodiments, the sealing device 380 may be used as part of the downhole tool 382 on primarily wireline runs, and may be the target of retrieval operations on primarily slickline and wireline.

Figure 37A:
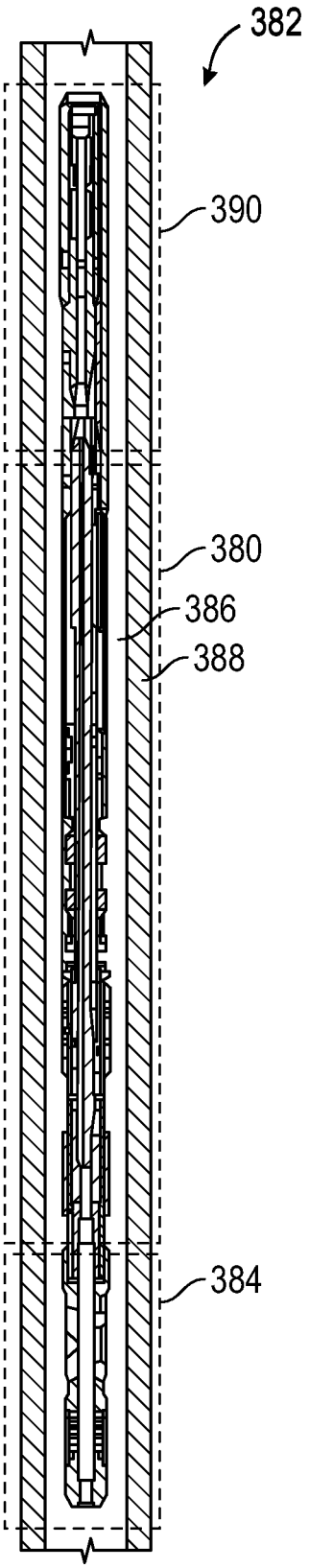
FIGS. 37A through 37C are cross-sectional views illustrating an example downhole tool that includes a sealing device, in accordance with embodiments of the present disclosure.
Figure 37B:
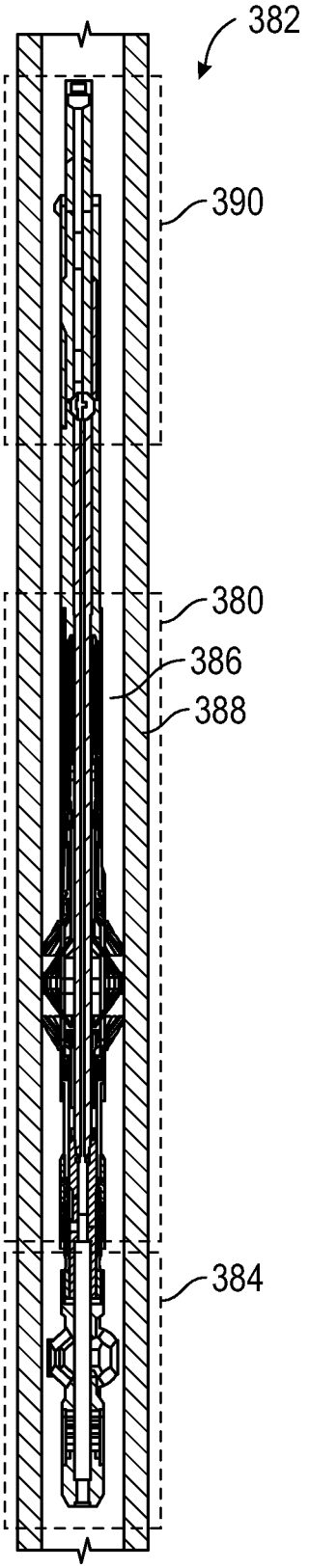
Figure 37C:
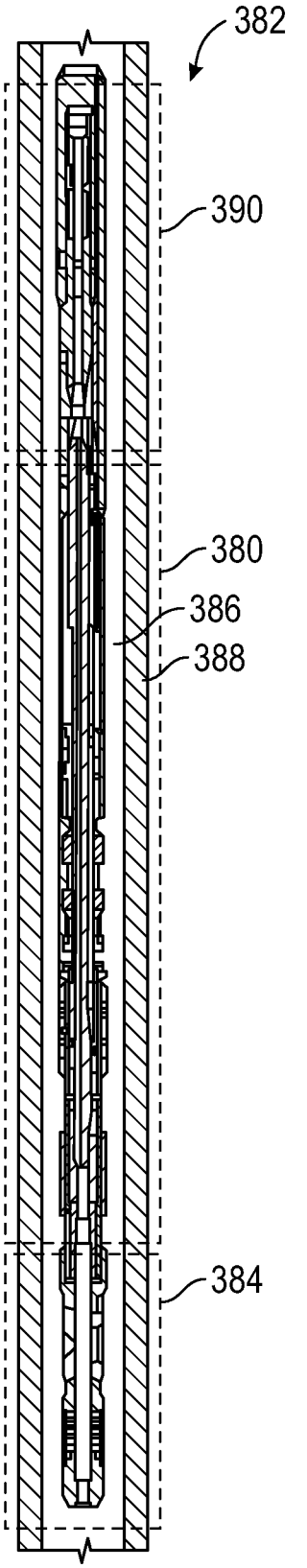
Figure 38:
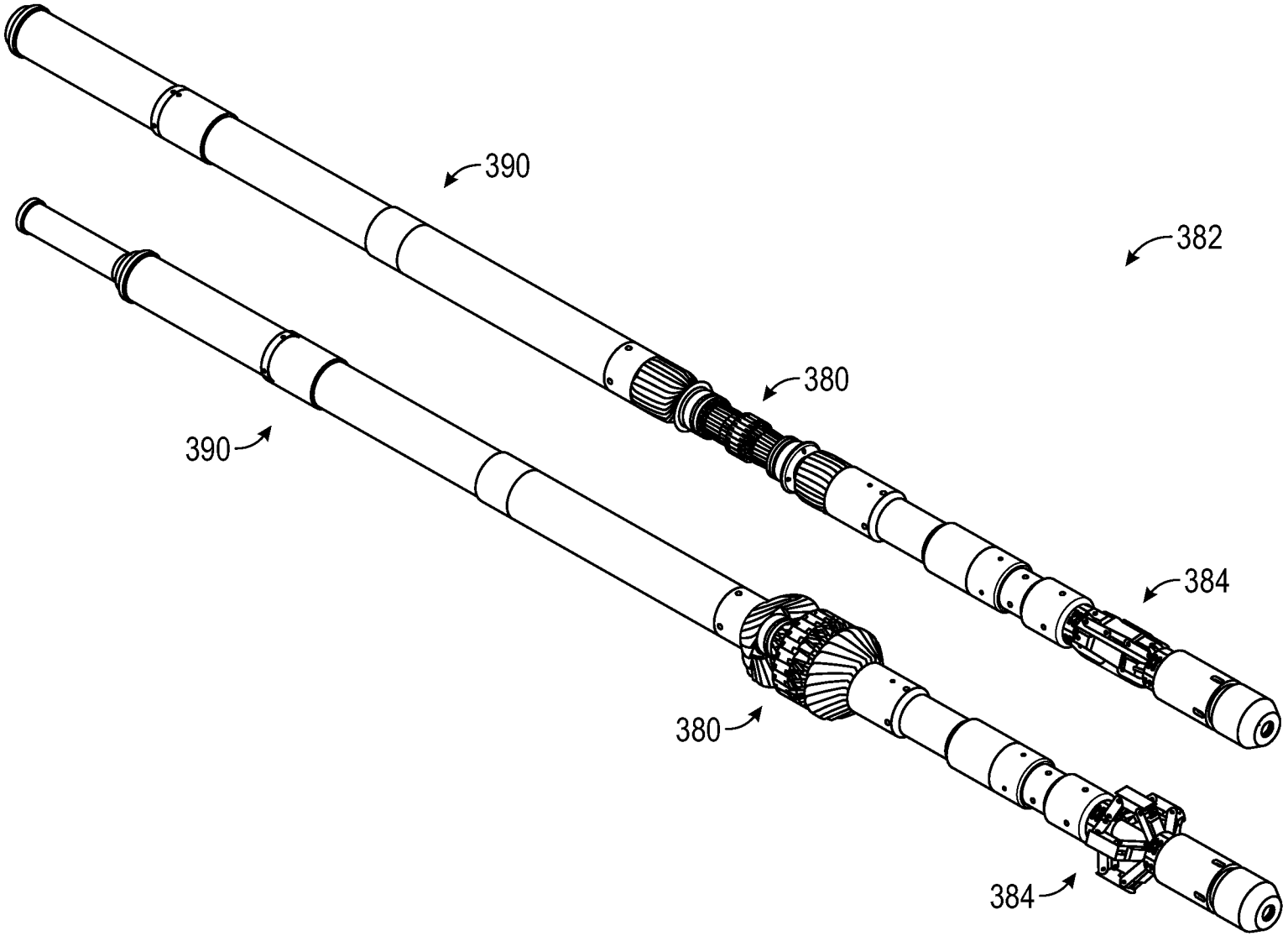
FIG. 38 illustrates perspective views of a downhole tool with slips/anchors and a sealing device in collapsed and expanded states, in accordance with embodiments of the present disclosure.

FIGS. 37A through 37C are cross-sectional views illustrating an example downhole tool 382 (e.g., a high expansion retrievable bridge plug) that includes a sealing device 380 having an apparatus (e.g., one of apparatus 10, 50, 80, 140, 160, 180, 280, 300, as described in greater detail herein. FIG. 37A illustrates the downhole tool 382 before expansion of the sealing device 380, FIG. 37B illustrates the downhole tool 382 during expansion of the sealing device 380, and FIG. 37C illustrates the downhole tool 382 after collapse of the sealing device 380 before retrieval of the downhole tool 382. As illustrated in FIGS. 37A through 37C, in certain embodiments, the downhole tool 382 may include a set of anchors (e.g., slips) 384 disposed at a downhole axial location of the downhole tool 382 along a wellbore 386 defined by wellbore casing 388, a load retention/equalization mechanism 390 disposed at an uphole axial location of the downhole tool 382 along the wellbore 386 defined by the wellbore casing 388, and the sealing device 380 disposed axially between the slips/anchors 384 and the load retention/equalization mechanism 390. FIG. 38 illustrates perspective views of the downhole tool 382 with the slips/anchors 384 and the sealing device 380 in collapsed and expanded states.

As described in greater detail herein, the sealing device 380 functions by forming an initial, relatively low pressure seal with a relatively small force and minimal deformation of a sealing element of the sealing device 380, and maintaining this maximum force and compressive deformation through the operation of the downhole tool 382, independent of differential pressure across the sealing device 380 by using an energizer spring stack that is isolated from the main load path of the downhole tool 382. The sealing element of the sealing device 380 is then inflated by the well fluid itself against a support barrier that can hold the resultant force due to the differential pressure.

Figure 39A:
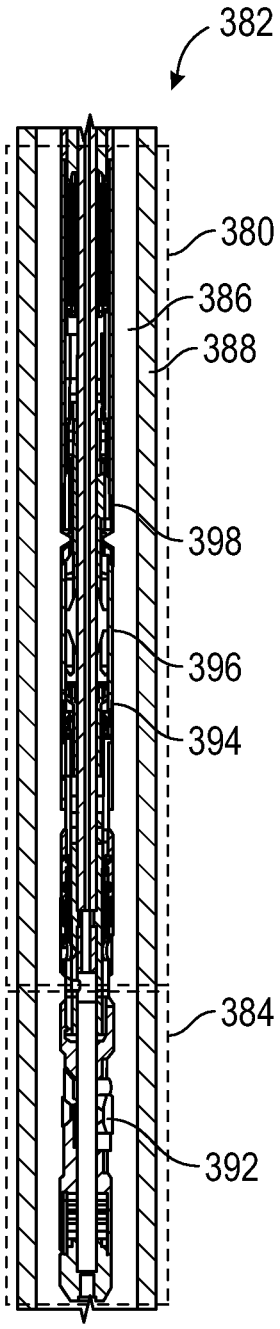
FIGS. 39A through 39E are cross-sectional views illustrating a sequence during which a downhole tool is transitioned from an un-set condition to a fully set condition, in accordance with embodiments of the present disclosure.
Figure 39B:
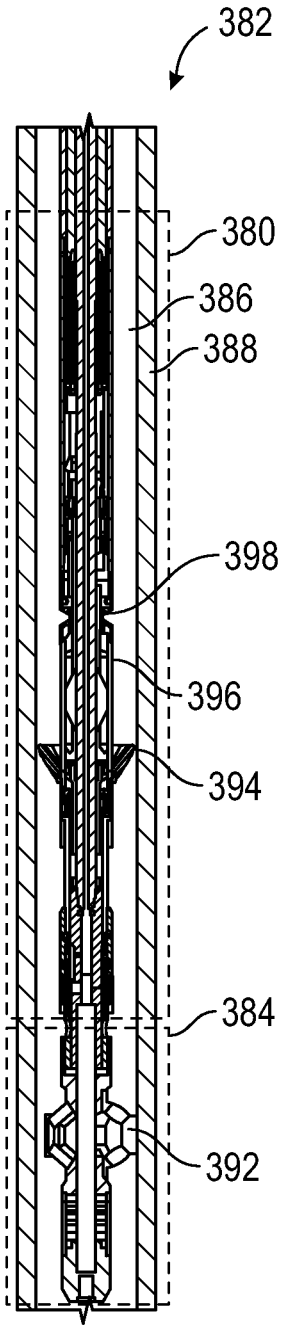
Figure 39C:
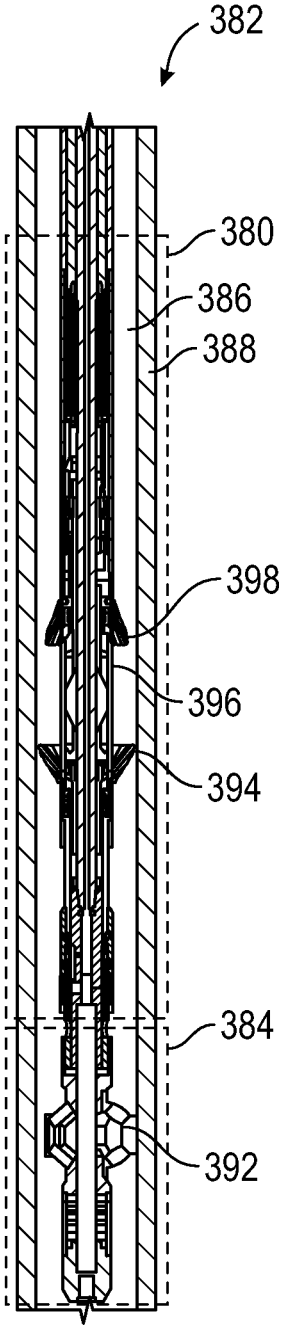
Figure 39D:
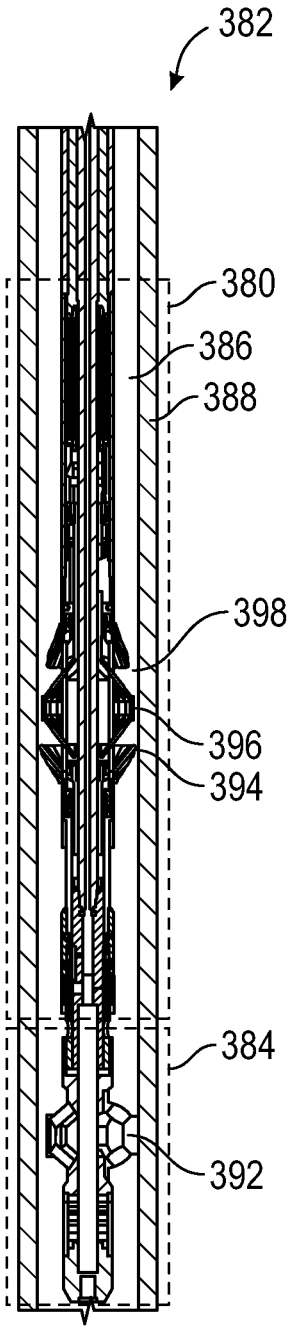
Figure 39E:
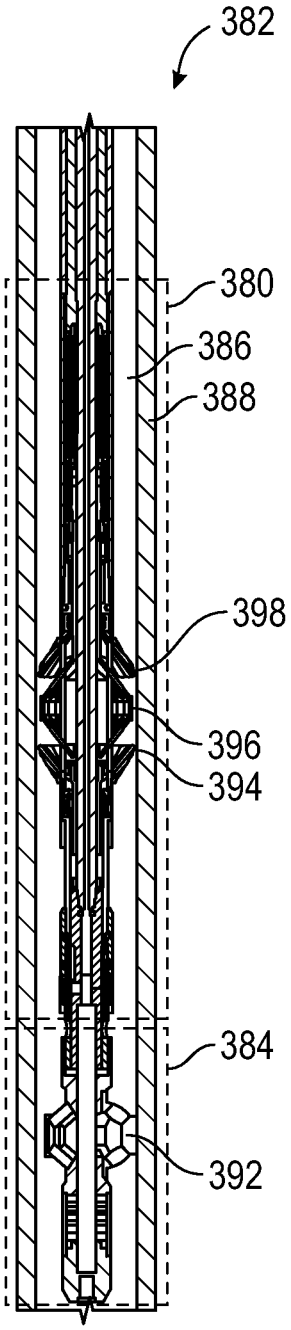

FIGS. 39A through 39E are cross-sectional views illustrating a sequence during which the downhole tool 382 is transitioned from an un-set condition (e.g., as illustrated in FIG. 39A), where the slips/anchors 384 and the sealing device 380 are both in a collapsed state and do not contact the wellbore casing 388 (e.g., to enable running of the downhole tool 382 into and out of the wellbore 386), to a fully set condition (e.g., as illustrated in FIG. 39E), where the slips/anchors 384 and the sealing device 380 are both in an expanded state and contact the wellbore casing 388 (e.g., to lock the downhole tool 382 in place axially relative to the wellbore casing 388 and to form a seal between the sealing device 380 and the wellbore casing 388). As will be appreciated, only a portion of the downhole tool 382 illustrated in FIGS. 37A through 37C is illustrated in FIGS. 39A through 39E for convenience of the discussion of the transitioning sequence illustrated in FIGS. 39A through 39E.

Once the downhole tool 382 is run into the wellbore 386 to a required depth (e.g., as illustrated in FIG. 39A), the downhole tool 382 begins to set. In particular, as illustrated in FIG. 39B, the slips/anchors 384 are set first by actuating one or more gripper slips 392 of the slips/anchors 384 to expand radially outward to make contact with the wellbore casing 388 to lock the downhole tool 382 in place axially relative to the wellbore casing 388. Then, as illustrated in FIG. 39C, lower (e.g., downhole) support barriers 394 of the sealing device 380 begin expanding radially outward until they contact the wellbore casing 388. Then, as illustrated in FIG. 39D, expansion elements 396 (e.g., elements 302, 306 of the apparatus 300 described herein) of the sealing device 380 begin expanding radially outward to compress an elastomer seal component of the sealing device 380 against the wellbore casing 388, as described in greater detail herein. In addition, as also described in greater detail herein, in certain embodiments, a seal energizer spring of the sealing device 380 may be used to maintain the initial setting force of the elastomer seal component against the wellbore casing 388 created by the expansion elements 396. Then, as illustrated in FIG. 39E, upper (e.g., uphole) support barriers 398 of the sealing device 380 begin expanding radially outward until they contact the wellbore casing 388. At this point, the downhole tool 382 is in a fully set condition.

As described in greater detail herein, once in the fully set condition illustrated in FIG.

39E and differential pressure begins to build, a spool/inflation valve of the load retention/equalization mechanism 390 begins directing the higher pressure underneath (e.g., radially within) an elastomer seal component (e.g., the elastomer seal component illustrated in FIGS. 43A and 43B) of the sealing device 380, thereby inflating the elastomer seal component of the sealing device 380 radially outward against the lower pressure side of the elastomer seal component (e.g., formed between the expansion elements 396 and the wellbore casing 388) to create a main setting force of the elastomer seal component 414 against the wellbore casing 388. As described in greater detail herein, in certain embodiments, the elastomer seal component of the sealing device 380 may be an elastomer material in the form of a sheath, which is disposed radially between the expansion elements 396 and the support barriers 394, 398. As the elastomer seal component of the sealing device 380 inflates radially outward against the support barriers 394, 398, it is prevented from extruding or inflating any further. The load generated against the support barriers 394, 398 is transferred to the slips/anchors 384 without directly affecting the expansion elements 396. At this point, the elastomer seal component of the sealing device 380 is holding the full differential pressure in burst, while the initial contact sealing patch generated by the expansion elements 396 continues to prevent communication due to differential pressure.

Once downhole operations using the downhole tool 382 have been completed, the downhole tool 382 may be retrieved from the wellbore by running the downhole tool 382 out of the wellbore 386. Before this occurs, the downhole tool 382 must be transitioned from the fully set condition illustrated in FIG. 39E to the unset condition illustrated in FIG. 39A. In general, the transitioning sequence illustrated in FIGS. 39A through 39E may be reversed to do so.

The sealing device 380 and the load retention/equalization mechanism 390 of the downhole tool 382 described herein primarily include five features that enable the sealing techniques described herein: (1) the support barriers 394, 398 of the sealing device 380; (2) an expansion device 400 (e.g., an apparatus 300 as described in greater detail herein) of the sealing device 380; (3) an elastomer seal component (e.g., the elastomer seal component illustrated in FIGS. 43A and 43B) of the sealing device 380; (4) a spool/inflation valve 402 of the load retention/equalization mechanism 390; and (5) a seal energizing spring 404 of the sealing device 380. Each of these features will now be described in greater detail.

Figure 40A:
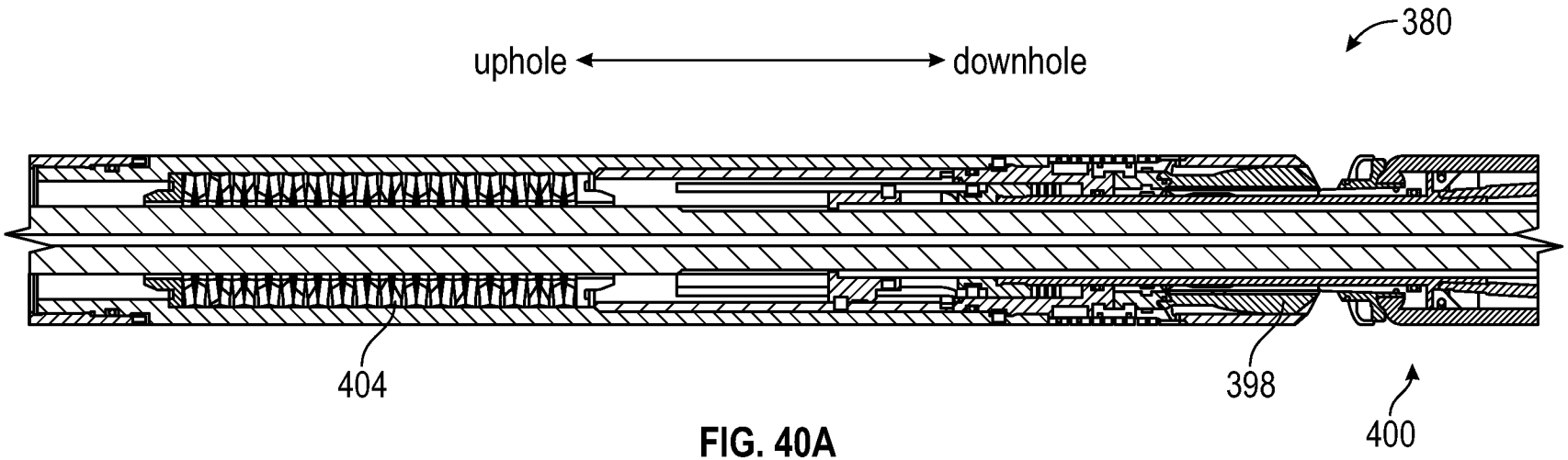
FIGS. 40A and 40B are cross-sectional views of a sealing device of a downhole tool, in accordance with embodiments of the present disclosure.
Figure 40B:
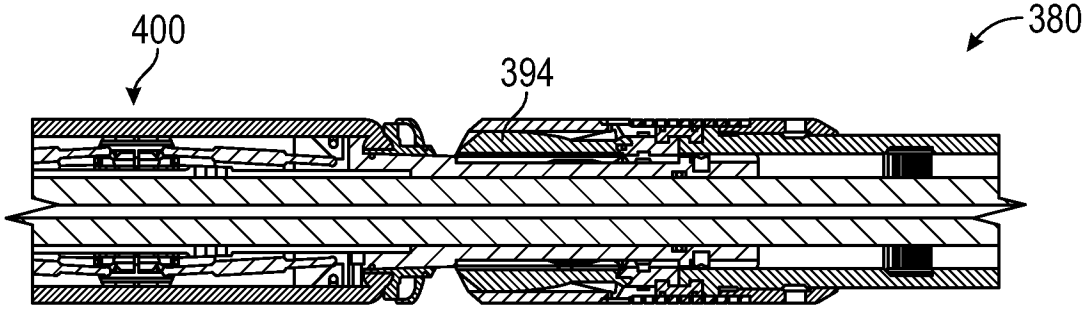
Figure 41:
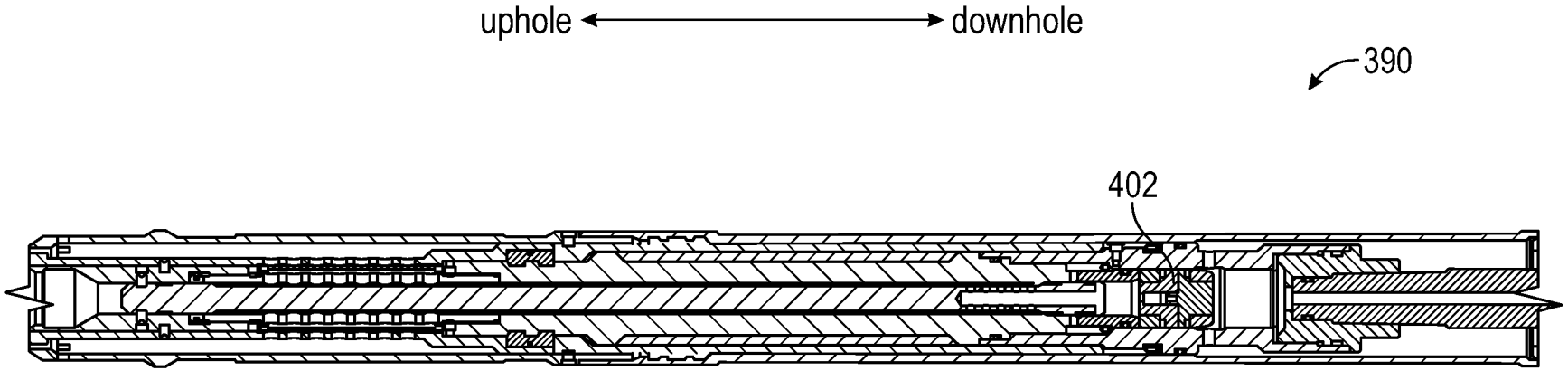
FIG. 41 is a cross-sectional view of a load retention/equalization mechanism of a downhole tool, in accordance with embodiments of the present disclosure.

FIG. 40A is a cross-sectional view of an upper (e.g., uphole) portion of the sealing device 380, FIG. 40B is a cross-sectional view of a lower (e.g., downhole) portion of the sealing device 380, and FIG. 41 is a cross-sectional view of the load retention/equalization mechanism 390, which is disposed uphole from the sealing device 380. As illustrated in FIGS. 40A and 40B, in certain embodiments, the lower and upper support barriers 394, 398 of the sealing device 380 are disposed on opposite axial sides of the expansion device 400. As described in greater detail herein, the support barriers 394, 398 are configured to expand to form a mechanical structure that abuts an internal diameter of a wellbore casing 388 with a minimal gap between the elements of the support barriers 394, 398 and the wellbore casing 388. In certain embodiments, the support barriers 394, 398 function in a substantially similar manner to the support elements 306 of the apparatus 300 (e.g., the expansion device 400 of the sealing device 380) described in greater detail herein. In particular, in certain embodiments, each of the lower and upper support barriers 394, 398 are formed by a set of (e.g., 16, 18, 20, 22, 24, or even more) conically hinged support barrier elements 406, similar to the support elements 306 described herein with reference to FIGS. 28 through 32.

Figure 42A:
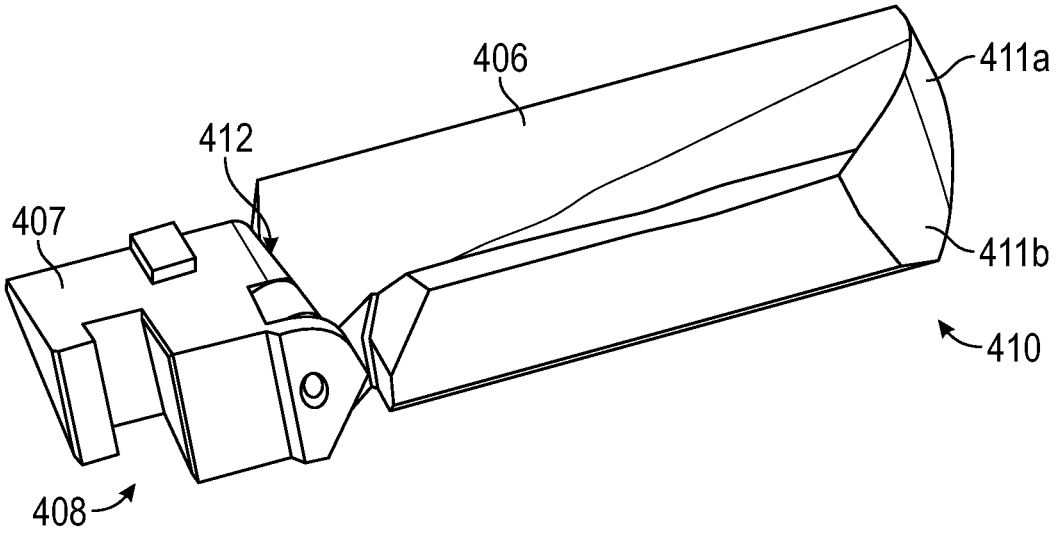
FIGS. 42A and 42B are perspective views of example support barrier elements and associated base elements of support barriers of a sealing device of a downhole tool, in accordance with embodiments of the present disclosure.
Figure 42B:
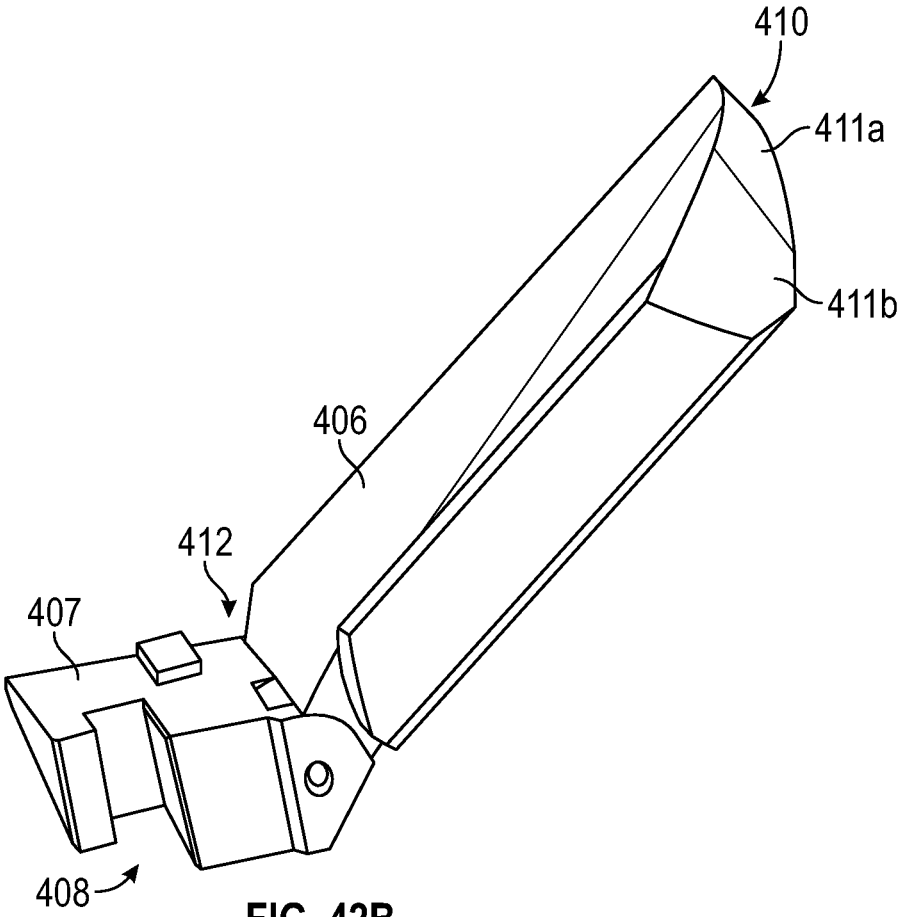

For example, FIGS. 42A and 42B are perspective views of example support barrier elements 406 and associated base elements 407 of the support barriers 394, 398. In particular, FIG. 42A illustrates a support barrier element 406 in a fully collapsed state (e.g., when the sealing device 380 is in an unset condition, as illustrated in FIG. 39A), and FIG. 42B illustrates a support barrier element 406 in a fully expanded state (e.g., when the sealing device 380 is in a fully set condition, as illustrated in FIG. 39E). As illustrated in FIGS. 42A and 42B, in certain embodiments, first ends 408 of each of the support barrier elements 406 may be connected to a respective base element 407 via a hinged connection 412. It will be appreciated that the base elements 407 associated with the support barrier elements 406 are substantially similar to the base elements 307 of the apparatus 300 described in greater detail herein, and that axial actuation forces acting on the base elements 407 (e.g., as provided by the seal energizing spring 404) may impart axial and radial force components onto the support barrier elements 406 in a similar manner as the base elements 307 of the apparatus 300.

In addition, as also illustrated in FIGS. 42A and 42B, to help maintain a relatively small gap between the support barrier elements 406 and an inner diameter of a wellbore casing 388, in certain embodiments, the support barrier elements 406 are cut to have a specific dual profile (e.g., casing interface surfaces 411*a*, 411*b*) to ensure that, at both a maximum inner diameter and a minimum inner diameter of the wellbore casing 388, there is no (or, at least very minimal) gap between a second end 410 of the support barrier elements 406 and the wellbore casing 388. In general, the greatest gap occurs in the middle of the casing range, which results in a maximum extrusion gap that is approximately half of what would be achieved if the support barrier elements 406 did not have the dual profile formed by the casing interface surfaces 411*a*, 411*b*. Although illustrated in FIGS. 42A and 42B as having a dual profile configuration having two casing interface surfaces 411*a*, 411*b*, in other embodiments, the second ends 410 of the support barrier elements 406 may instead include a multi-profile configuration having a plurality of casing interface surfaces 411 (e.g., three casing interface surfaces 411, four casing interface surfaces 411, five casing interface surfaces 411, or even more).

As described in greater detail herein, the support barriers 394, 398 are capable of holding a rated differential pressure for a downhole tool 382 across an entire inner diameter surface of a wellbore casing 388 while operating in burst. In addition, as also described in greater detail herein, the support barriers 394, 398 are capable of collapsing back to approximately the same diameter as when they were run downhole into the wellbore 386 without positive intervention.

Returning to FIGS. 40A and 40B, in certain embodiments, the expansion device 400 of the sealing device 380 is substantially similar to the apparatus 300 described in greater detail herein. The expansion device 400 forms an initial seal between an elastomer seal membrane and an inner diameter of a wellbore casing 388. To do this, the expansion device 400 generates a nominally uniform contact pressure area between the elastomer seal membrane, the inner diameter of the wellbore casing 388, and an outer diameter of the expansion device 400. In general, the expansion device 400 generates a minimum amount of stress in the elastomer seal component (e.g., the elastomer seal component illustrated in FIGS. 43A and 43B) to prevent over-deformation and damage to the elastomer seal component 414.

Figure 43A:
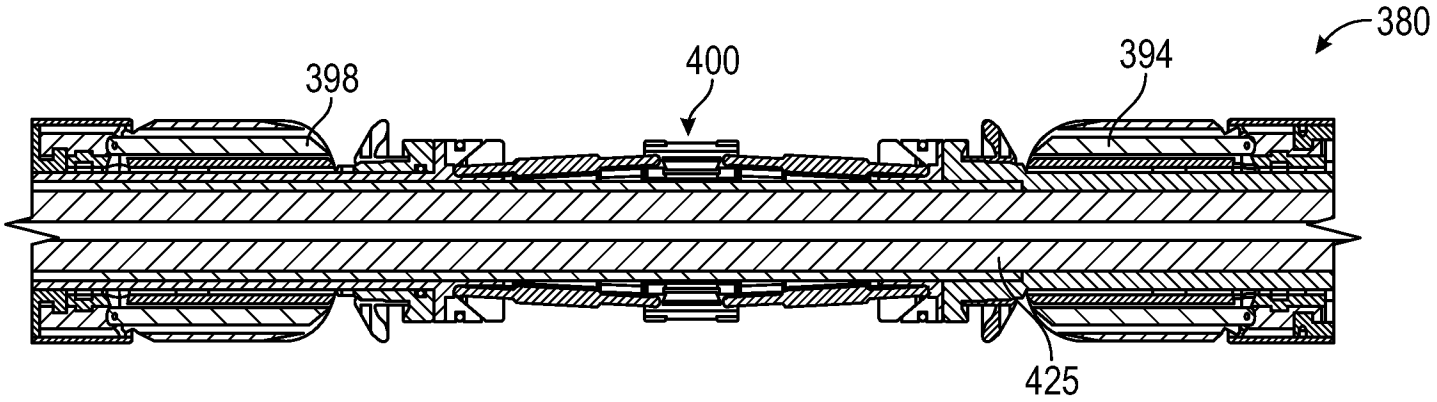
FIGS. 43A and 43B are cross-sectional views of support barriers, an expansion device, and an elastomer seal component of a sealing device of a downhole tool in a fully collapsed state and a fully expanded state, respectively, in accordance with embodiments of the present disclosure.
Figure 43B:
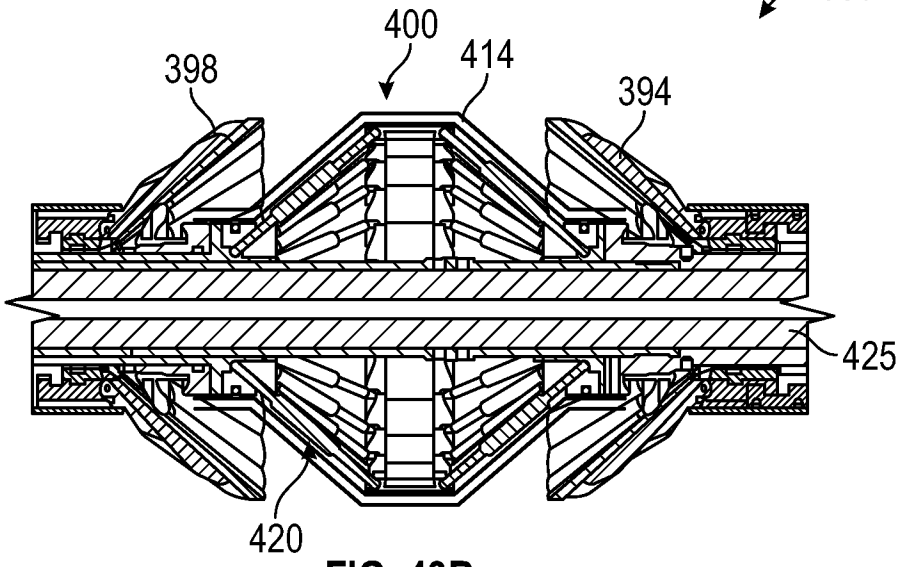

FIGS. 43A and 43B are cross-sectional views of the support barriers 394, 398, the expansion device 400, and an elastomer seal component 414 of the sealing device 380 described herein. In particular, FIG. 43A illustrates the support barriers 394, 398 and the expansion device 400 in a fully collapsed state (e.g., when the sealing device 380 is in an unset condition, as illustrated in FIG. 39A), and FIG. 43B illustrates the support barriers 394, 398 and the expansion device 400 in a fully expanded state (e.g., when the sealing device 380 is in a fully set condition, as illustrated in FIG. 39E). As illustrated in FIGS. 43A and 43B, the elastomer seal component 414 may be comprised of an elastomer membrane that is disposed radially between the expansion device 400 and the support barriers 394, 398. As such, the elastomer seal component 414 does not experience high levels of pinching by, for example, being stretched over the expansion device 400 insofar as the support barriers 394, 398 provide a certain amount of protection for the elastomer seal component 414.

During expansion of the expansion device 400, the elastomer seal component 414 is physically stretched and compressed between the expansion elements of the expansion device 400 and the inner diameter of the wellbore casing 388 such that a relatively low-pressure seal may be formed. Once the application of differential pressure begins, the elastomer seal component 414 is capable of inflating under pressure into the support barriers 394, 398 without breaking. Later, upon retrieval of the downhole tool 382 from the wellbore 386, once the expansion device 400 and the support barriers 394, 398 have been collapsed again, the elastomer seal component 414 returns to its original (e.g., nominal) shape and/or presents relatively low (e.g., less than 400 lbf) of resistance, for example, when attempting to pull the through a gauge ring.

As described in greater detail herein, a spool/inflation valve 402 (FIG. 41) of the load retention/equalization mechanism 390 (e.g., which is disposed axially upstream of the sealing device 380) directs the high side of the differential pressure under the elastomer seal component 414, which ensures that the elastomer seal component 414 is inflating, and that the support barriers 394, 398 are holding in burst. In general, the spool/inflation valve 402 is hydraulically coupled to both an uphole volume 416 and a downhole volume 418 within the wellbore 386 (shown in FIGS. 44A and 44B). As described in greater detail herein, the separate uphole and downhole volumes 416, 418 are created by the seal created by the elastomer seal component 414 via expansion of the expansion device 400 of the sealing device 380. In certain embodiments, the spool/inflation valve 402 may govern pressure within the expansion device 400 under the elastomer seal component 414. In certain embodiments, the spool/inflation valve 402 may shuttle according to the pressure differential between the uphole and downhole volumes 416, 418 to eliminate hydrostatic pressure from acting on the elastomer seal component 414. In particular, in certain embodiments, the spool/inflation valve 402 may shuttle to a first position or to a second position to allow the lowest pressure of the uphole and downhole volumes 416, 418 into an internal volume 420 under the elastomer seal component 414. For example, if the higher pressure is in the uphole volume 416 and the lower pressure is in the downhole volume 418, the spool/inflation valve 402 may shuttle to the first position to allow the higher pressure of the uphole volume 416 into the internal volume 420 under the elastomer seal component 414 and, conversely, if the higher pressure is in the downhole volume 418 and the lower pressure is in the uphole volume 416, the spool/inflation valve 402 may shuttle to the second position to allow the higher pressure of the downhole volume 418 into the internal volume 420 under the elastomer seal component 414

Figure 44A:
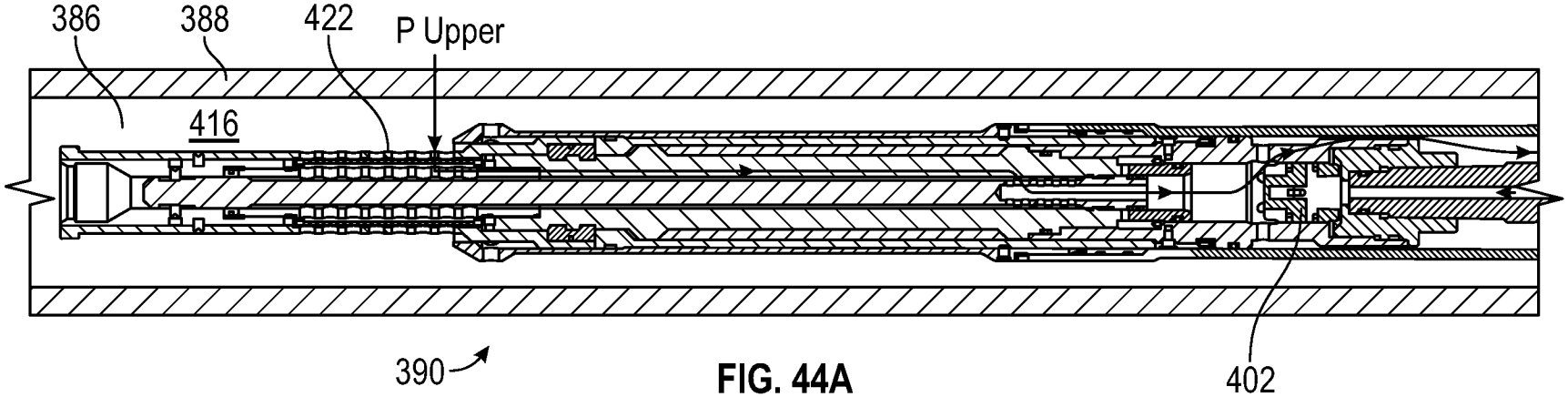
FIGS. 44A and 44B are cross-sectional views of a load retention/equalization mechanism and a sealing device of a downhole tool while a differential pressure between uphole and downhole volumes is higher in the uphole volume, in accordance with embodiments of the present disclosure.
Figure 44B:
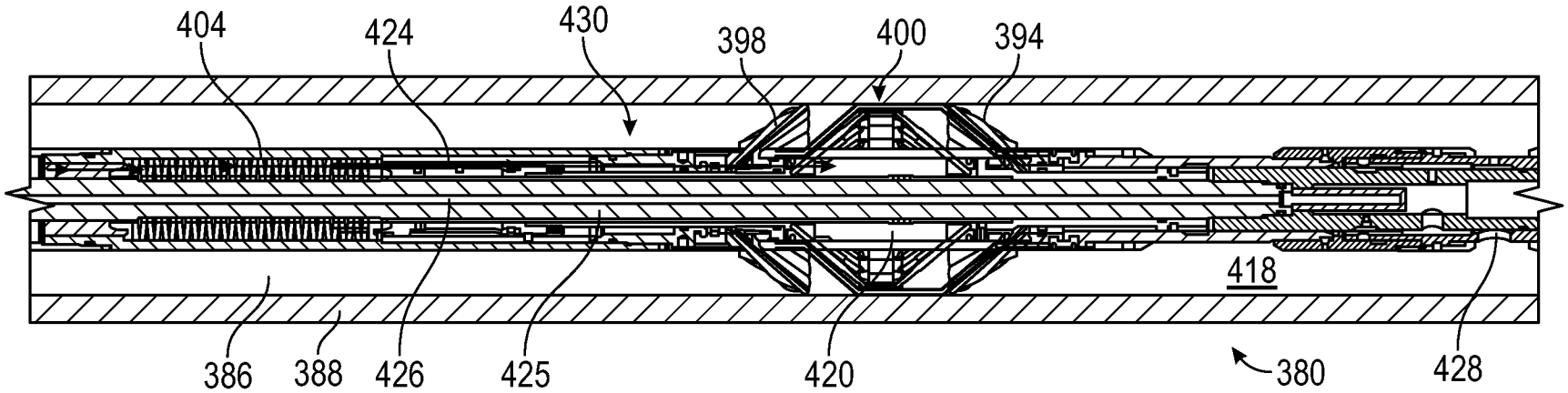
Figure 45A:
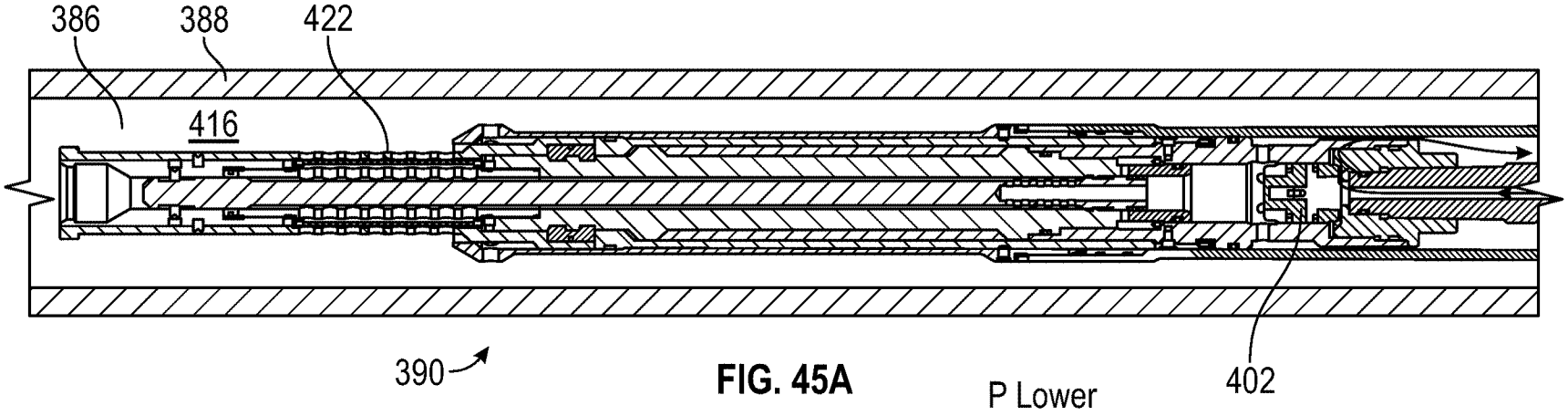
FIGS. 45A and 45B are cross-sectional views of a load retention/equalization mechanism and a sealing device of a downhole tool while a differential pressure between uphole and downhole volumes is higher in the downhole volume, in accordance with embodiments of the present disclosure.
Figure 45B:
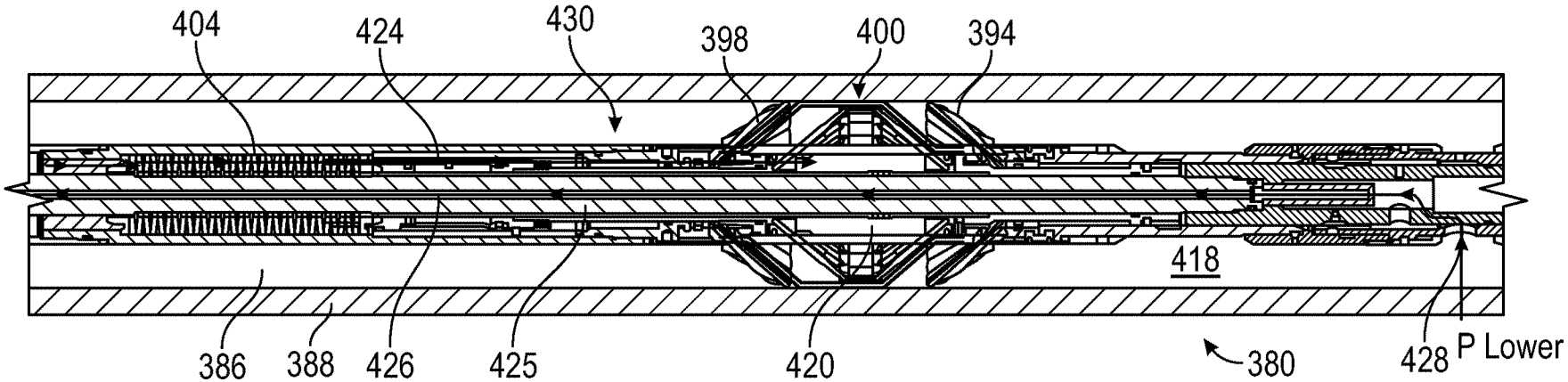

To help illustrate the functionality of the spool/inflation valve 402 of the load retention/equalization mechanism 390, FIGS. 44A and 44B are cross-sectional views of the load retention/equalization mechanism 390 and the sealing device 380 while the differential pressure between the uphole and downhole volumes 416, 418 is higher in the uphole volume 416, and FIGS. 45A and 45B are cross-sectional views of the load retention/equalization mechanism 390 and the sealing device 380 while the differential pressure between the uphole and downhole volumes 416, 418 is higher in the downhole volume 418. As illustrated in FIGS. 44A and 44B, when the differential pressure is higher in the uphole volume 416 of the wellbore 386, the spool/inflation valve 402 is shuttled to a first position whereby fluid from the uphole volume 416 enters through an uphole mandrel 422 and is directed into the internal volume 420 through a passage 424 (e.g., which includes the seal energizing spring 404, in certain embodiments) that is, for example, radially offset and hydraulically isolated from the main load path 426 through a central mandrel 425 of the downhole tool 382 (e.g., at least partially by the spool/inflation valve 402). Conversely, as illustrated in FIGS. 45A and 45B, when the differential pressure is higher in the downhole volume 418 of the wellbore 386, the spool/inflation valve 402 is shuttled to a second position whereby fluid from the downhole volume 418 enters through at least one downhole opening 428 and is directed into the internal volume 420 through the main load path 426 of the downhole tool 382 and the passage 424 that is radially offset and hydraulically isolated from the main load path 426 (e.g., at least partially by the spool/inflation valve 402).

As described in greater detail herein, the seal energizing spring 404 allows for consistent and reliable loading of an elastomer seal component 414 (e.g., which may be a relatively thin rubber membrane). In certain embodiments, the seal energizing spring 404 is located in the passage 424 that is radially offset and hydraulically isolated from the main load path 426 of the downhole tool 382 such that it is not in the direct load path of the support barriers 394, 398. In general, the seal energizing spring 404 provides an axial actuation force that acts on the base elements 407 (FIGS. 42A and 42B) associated with the support barrier elements 406 of the support barriers 394, 398 to move the support barrier elements 406 both axially and partially (e.g., at least the second ends 410 of the support barrier elements 406) radially with respect to the downhole tool 382, as described in greater detail herein. For example, in certain embodiments, the seal energizing spring 404 may provide an axial force that pushes axially against an internal sub assembly 430 that, in turn, pushes axially against the base elements 407 associated with the support barrier elements 406 of the upper support barriers 398 to move the support barrier elements 406 both axially and partially (e.g., at least the second ends 410 of the support barrier elements 406) radially with respect to the downhole tool 382, as described in greater detail herein. As such, the loading and displacement of the seal energizing spring 404, and the expansion elements of the expansion device 400, is not affected by the differential pressure between the uphole and downhole volumes 416, 418 of the wellbore 386 or by temperature variations. This enables the loading of the elastomer seal component 414 (e.g., the elastomer seal component illustrated in FIGS. 43A and 43B) to be reliable and independent from backlash within the downhole tool 382, temperature variations, and pressure loading. This, in turn, facilitates the elastomer seal component 414 being set at a nominally low force as it is not required to compensate for these variations.

Figure 46:
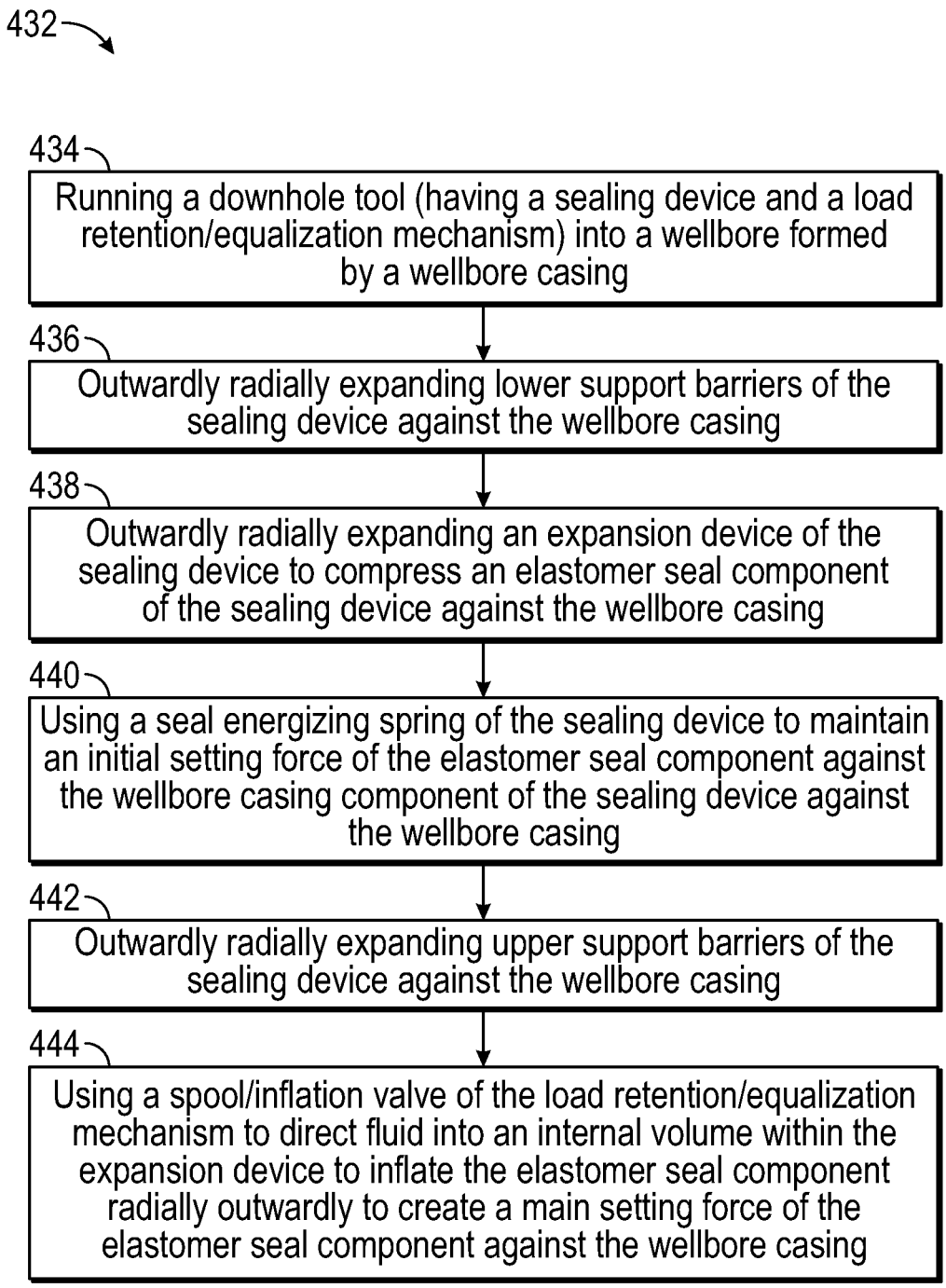
FIG. 46 is a flow diagram of a method for transitioning a downhole tool from an un-set condition to a fully set condition, in accordance with embodiments of the present disclosure.

FIG. 46 is a flow diagram of a method 432 for transitioning a downhole tool 382 from an un-set condition (e.g., as illustrated in FIG. 39A) to a fully set condition (e.g., as illustrated in FIG. 39E). In certain embodiments, the method 432 includes running a downhole tool 382 into a wellbore 386 formed by a wellbore casing 388, wherein the downhole tool 382 includes a sealing device 380 and a load retention/equalization mechanism 390 (block 434). The method also includes outwardly radially expanding lower support barriers 394 of the sealing device 380 against the wellbore casing 388 (block 436). The method further includes outwardly radially expanding an expansion device 400 of the sealing device 380 to compress an elastomer seal component 414 of the sealing device 380 against the wellbore casing 388 (block 438). The method also includes using a seal energizing spring 404 of the sealing device 380 to maintain an initial setting force of the elastomer seal component 414 against the wellbore casing 388 (block 440). The method further includes outwardly radially expanding upper support barriers 398 of the sealing device 380 against the wellbore casing 388 (block 442). The method also includes using a spool/inflation valve 402 of the load retention/equalization mechanism 390 to direct fluid into an internal volume 420 within the expansion device 400 to inflate the elastomer seal component 414 radially outwardly to create a main setting force of the elastomer seal component 414 against the wellbore casing 388 (block 444). As described in greater detail herein, the spool/inflation valve 402 directs the fluid into the internal volume 420 based on a differential pressure between a first volume 416 uphole relative to the downhole tool 382 and a second volume 418 downhole relative to the downhole tool 382. As will be appreciated, in certain embodiments, the steps 434, 436, 438, 440, 442, 444 of the method 432 are performed in the order illustrated in FIG. 46.

Figure 47:
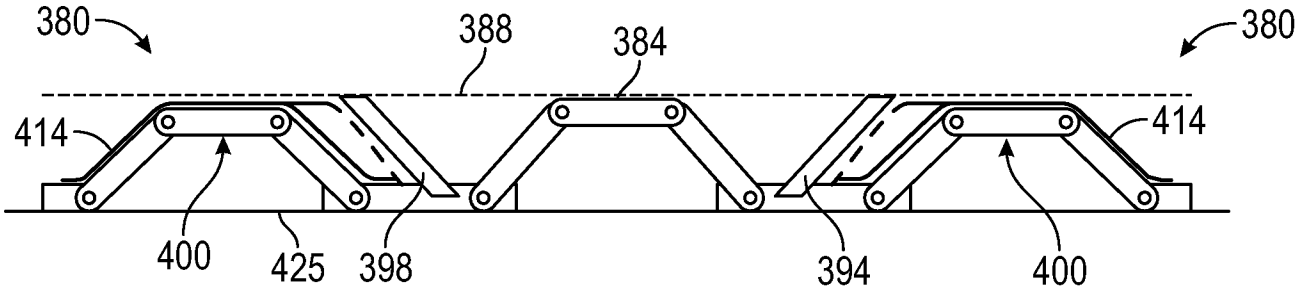
FIG. 47 is a partial cross-sectional view of a sealing device of a downhole tool, wherein the sealing device is disposed on opposite axial sides of slips/anchors of the downhole tool, in accordance with embodiments of the present disclosure.

Although illustrated in FIGS. 37A through 45B as including a particular physical arrangement of a sealing device 380 for use in a downhole tool 382, other embodiments may include various other arrangements of components (e.g., expansion devices 400, elastomer seal components 414, support barriers 394, 398, and other components) of the sealing device 380. For example, FIG. 47 is a partial cross-sectional view of a sealing device 380 that is disposed on opposite axial sides of the slips/anchors 384. For example, as illustrated in FIG. 47, in certain embodiments, expansion devices 400 may be disposed on the opposite axial sides of the slips/anchors 384, separated from the slips/anchors 384 by upper and lower support barriers 394, 398. In such an embodiment, it will be appreciated that the lower and upper support barriers 394, 398 are oriented in opposite directions as compared to the embodiments illustrated in FIGS. 37A through 45B. However, their interaction with respective expansion devices 400 (and their associated elastomer seal components 414 are substantially similar as described in greater detail herein with respect to FIGS. 37A through 45B. It will be appreciated that the bold portions of the elastomer seal components 414 illustrated in FIGS. 47 through 49 are illustrative of the elastomer seal components 414 being in a collapsed condition, whereas the dashed portions of the elastomer seal components 414 illustrated in FIGS. 47 through 49 are illustrative of the elastomer seal components 414 being in an expanded condition, as described in greater detail herein.

Figure 48:
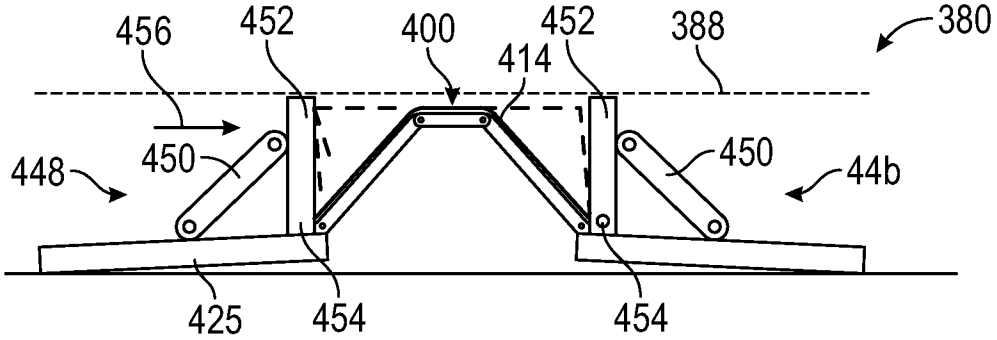
FIG. 48 is a partial cross-sectional view of a sealing device of a downhole tool, wherein the sealing device includes lower and upper support structures, in accordance with embodiments of the present disclosure.

In addition, FIG. 48 is a partial cross-sectional view of a sealing device 380 having lower and upper support structures 446, 448 that function in a substantially similar manner to the lower and upper support barriers 394, 398 described in greater detail herein. However, the lower and upper support structures 446, 448 are slightly different than the lower and upper support barriers 394, 398 insofar as they include pivoting structures 450 that slide axially to expand and rotate support elements 452 about a pivot point 454, as illustrated by arrow 456, such that the support elements 452 contact a wellbore casing 388.

Figure 49:
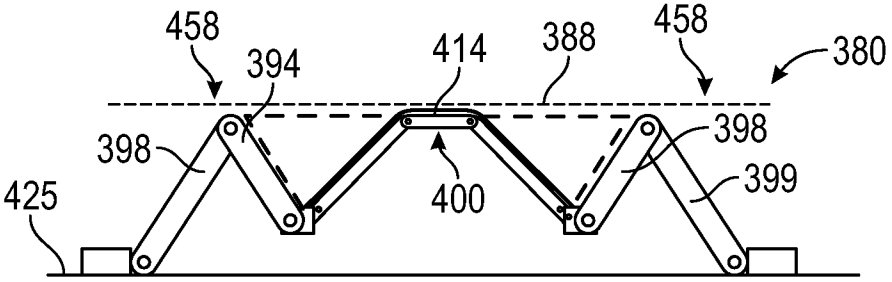
FIG. 49 is a partial cross-sectional view of a sealing device of a downhole tool, when the sealing device includes two pairs of support barriers disposed on opposite axial sides of an expansion device of the sealing device, in accordance with embodiments of the present disclosure.

In addition, FIG. 49 is a partial cross-sectional view of a sealing device 380 having two pairs of support barriers 394, 398 disposed on opposite axial sides of an expansion device 400. As such, the embodiment illustrated in FIG. 49 is substantially similar to the embodiments described in greater detail herein with respect to FIGS. 37A through 45B, with the main exception being that each pair of support barriers 394, 398 are coupled to each other via a hinged connection 458 (e.g., at ends 410 of the support barrier elements 406 of the support barriers 394, 398) such that the pairs of support barriers 394, 398 from "A-frame" support barriers.

In the foregoing embodiments, where the expanding and collapsing apparatus is used to create a seal, the seal is typically disposed between the expanding ring structures (and the elastomer membrane) and the tubular within which the expanding and collapsing apparatus is disposed. In alternative embodiments (not illustrated), an expanding ring structure can be used to provide a seal, or at least a restrictive flow barrier directly. To facilitate this, the elements that are assembled together to create the ring structures may be formed from metal or a metal alloy that is coated with a polymeric, elastomeric or rubber material. An example of such a material is a silicone polymer coating. All surfaces of the elements may be coated, for example by a dipping or spraying process, and the mutually supportive arrangement of the elements keeps them in compression in their operating condition. This enables the ring structures themselves to function as flow barriers, and in some applications, the barrier created is sufficient to seal against differential pressures to create a fluid tight seal.

In a further alternative embodiment (not illustrated), the characteristics of the expanding/collapsing apparatus may be exploited to provide a substrate that supports a seal or another deformable element. As described herein, the expanded ring structures provide a smooth circular cylindrical surface and/or a smooth conical surface at their optimum expanded conditions. This facilitates their application as a functional endo-skeleton for a surrounding sheath. As described in greater detail herein, a deformable elastomeric membrane may be provided over an expanding ring structure. When in its collapsed condition, the sheath is supported by the collapsed ring structures. The ring structures are deployed in the manner described herein against the retaining force of the circumferential spring element and any additional retaining force provided by the sheath, and the sheath is deformed to expand with the ring structure into contact with the surrounding surface. The sheath is sandwiched between the smooth outer surface of the ring structure and the surrounding surface to create a seal. It will be appreciated that the apparatus described herein may be used as an endo-skeleton to provide structural support for components other than deformable sheaths, including tubulars, expanding sleeves, locking formations and other components in fluid conduits or wellbores.

The expansion apparatus described herein may be applied to a high expansion packer or plug and, in particular, to a high expansion retrievable bridge plug. The ring structure may be arranged to provide a high-expansion anti-extrusion ring for a seal element of a retrievable bridge plug. Alternatively, or in addition to, elements of ring structures of the apparatus may be provided with engaging means to provide anchoring forces that resist movement in upward and/or downward directions. The elements of the rings structure may therefore function as slips, and may in some cases function as an integrated slip and anti-extrusion ring. Advantages over previously proposed plugs include the provision of a highly effective anti-extrusion ring; providing an integrated slip and anti-extrusion assembly, which reduces the axial length of the tool; providing slips with engaging surfaces that extend around the entire circumference of the tool to create an enlarged anchoring surface, which enables a reduction in the axial length of the slips for the same anchoring force; the ability of slips of a ring structure of one particular size to function effectively over a wider range of tubular inner diameters and tubing weights/wall thicknesses. Alternatively, or in addition to, the apparatus may be used to anchor any of a wide range of tools in a wellbore, by providing the surfaces of the element with engaging means to provide anchoring forces that resist movement in upward and/or downward directions.

Variations to embodiments described herein may include the provision of functional formations on the basic elements in various arrangements. These may include knurls and sockets for location and support, hooks, balls and sockets or knuckles and sockets for axial connection, and/or pegs and recesses to prevent relative rotation of the elements with respect to one another and/or with respect to the underlying structure of the apparatus.

The embodiments described herein also have benefits in creating a seal and/or filling an annular space, and an additional example application is to downhole locking tools. A typical locking tool uses one or more radially expanding components deployed on a running tool. The radially expanding components engage with a pre-formed locking profile at a known location in the wellbore completion. A typical locking profile and locking mechanism includes a recess for mechanical engagement by the radially expanding components of the locking tool. A seal bore is typically provided in the profile, and a seal on the locking tool is designed to seal against the seal bore.

In addition, in certain embodiments, each of the ring structures provides a smooth, unbroken circumferential surface, which may engage a locking recess, providing upper and lower annular surfaces in a plane perpendicular to the longitudinal axis of the bore. This annular surface may be relatively smooth and unbroken around the circumference of the ring structures and, therefore, the lock is in full abutment with upper and lower shoulders defined in the locking profile. This is in contrast with conventional locking mechanisms that may only have contact with a locking profile at a number of discrete, circumferentially-separated locations around the device. The increased surface contact can support larger axial forces being directed through the lock. Alternatively, in other embodiments, an equivalent axial support may be provided in a lock, which has reduced size and/or mass.

Another advantage of the embodiments described herein is that a seal bore (i.e., the part of the completion with which the elastomer creates a seal) may be recessed in the locking profile. The benefit of such configuration is that the seal bore is protected from the passage of tools and equipment through the locking profile. This avoids impact with the seal bore that would tend to damage the seal bore, reducing the likelihood of reliably creating a successful seal.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A method, comprising:

running a downhole tool into a wellbore formed by a wellbore casing, wherein the downhole tool comprises a sealing device and a load retention/equalization mechanism;

outwardly radially expanding lower support barriers of the sealing device against the wellbore casing;

outwardly radially expanding an expansion device of the sealing device to compress an elastomer seal component of the sealing device against the wellbore casing;

using a seal energizing spring of the sealing device to maintain an initial setting force of the elastomer seal component against the wellbore casing;

outwardly radially expanding upper support barriers of the sealing device against the wellbore casing; and using a spool/inflation valve of the load retention/equalization mechanism to direct fluid into an internal volume within the expansion device to inflate the elastomer seal component radially outwardly to create a main setting force of the elastomer seal component against the wellbore casing, wherein the spool/inflation valve directs the fluid into the internal volume based on a differential pressure between a first volume uphole relative to the downhole tool and a second volume downhole relative to the downhole tool.

2. The method of claim 1, wherein the elastomer seal component is located radially between the expansion device and the lower and upper support barriers.

3. The method of claim 1, comprising bi-directionally shuttling the spool/inflation valve between a first position when a first pressure in the first volume is higher than a second pressure in the second volume and a second position when the second pressure is higher than the first pressure, wherein bi-directionally shuttling the spool/inflation valve comprises directing fluid from the first volume into the internal volume when the spool/inflation valve is in the first position, and directing fluid from the second volume into the internal volume when the spool/inflation valve is in the second position.

4. The method of claim 1, wherein outwardly radially expanding the lower and upper support barriers each comprises moving respective first ends of a plurality of support barrier elements of the lower and upper support barriers in an axial direction relative to the downhole tool, and by moving respective second ends of the plurality of support barrier elements in at least a radial direction relative to the downhole tool.

5. The method of claim 4, wherein each support barrier comprises a plurality of base elements, wherein each base element is coupled to a respective support barrier element via a hinged connection at the first end of the respective support barrier element.

6. The method of claim 4, wherein each second end comprises a plurality of casing interface surfaces.

7. The method of claim 1, wherein outwardly radially expanding the expansion device comprises sliding a plurality of ring elements of the expansion device with respect to one another in a direction tangential to a circle concentric with a ring structure formed by the expansion device around a longitudinal axis of the downhole tool, moving respective first ends of a plurality of support elements of the expansion device in an axial direction relative to the longitudinal axis, and by moving respective second ends of the plurality of support elements in at least a radial direction relative to the longitudinal axis.

8. The method of claim 1, wherein the spring energizing seal is located in a passage that is radially offset and hydraulically isolated from a main load path of the downhole tool.

9. The method of claim 1, wherein the downhole tool comprises a retrievable bridge plug.

10. A downhole tool, comprising:

a sealing device comprising:

an elastomer seal component;

an expansion device configured to radially expand outwardly to compress the elastomer seal component against a wellbore casing within which the downhole tool is located;

lower and upper support barriers, each support barrier configured to radially expand outwardly against the wellbore, wherein the lower and upper support barriers are disposed on opposite axial ends of the expansion device; and a seal energizing spring configured to maintain an initial setting force of the elastomer seal component against the wellbore casing; and a load retention/equalization mechanism comprising a spool/inflation valve configured to direct fluid into an internal volume within the expansion device to inflate the elastomer seal component radially outwardly to create a main setting force of the elastomer seal component against the wellbore casing, wherein the spool/inflation valve directs the fluid into the internal volume based on a differential pressure between a first volume uphole relative to the downhole tool and a second volume downhole relative to the downhole tool.

11. The downhole tool of claim 10, wherein the elastomer seal component is located radially between the expansion device and the lower and upper support barriers.

12. The downhole tool of claim 10, wherein the spool/inflation valve is configured to bi-directionally shuttle between a first position when a first pressure in the first volume is higher than a second pressure in the second volume and a second position when the second pressure is higher than the first pressure, wherein the spool/inflation valve directs fluid from the first volume into the internal volume when in the first position and directs fluid from the second volume into the internal volume when in the second position.

13. The downhole tool of claim 10, wherein the lower and upper support barriers each comprise a plurality of support barrier elements, each support barrier element having a first end and a second end, wherein the plurality of support barrier elements are configured to move between an expanded condition and a collapsed condition by movement of the first end in an axial direction relative to the downhole tool, and by movement of the second end in at least a radial direction relative to the downhole tool.

14. The downhole tool of claim 13, wherein each support barrier comprises a plurality of base elements, wherein each base element is coupled to a respective support barrier element via a hinged connection at the first end of the respective support barrier element.

15. The downhole tool of claim 13, wherein each second end comprises a plurality of casing interface surfaces.

16. The downhole tool of claim 10, wherein the expansion device comprises a plurality of elements assembled together to form a ring structure around a longitudinal axis of the downhole tool, wherein the ring structure is configured to be moved between an expanded condition and a collapsed condition by movement of the plurality of elements, and wherein the plurality of elements comprises:

a plurality of ring elements configured to be moved between the expanded and collapsed conditions by sliding with respect to one another in a direction tangential to a circle concentric with the ring structure; and a plurality of support elements, each support element having a first end and a second end, wherein the plurality of support elements are configured to move between the expanded condition and the collapsed condition by movement of the first end in an axial direction relative to the longitudinal axis, and by movement of the second end in at least a radial direction relative to the longitudinal axis.

17. The downhole tool of claim 10, wherein the spring energizing seal is located in a passage that is radially offset and hydraulically isolated from a main load path of the downhole tool.

18. The downhole tool of claim 10, wherein the downhole tool comprises a retrievable bridge plug.

19. The downhole tool of claim 11, wherein the lower and upper support barriers comprise two pairs of lower and upper support barriers, wherein the two pairs of lower and upper support barriers are disposed on opposite axial ends of the expansion device.

20. A downhole tool, comprising:

slips/anchors having one or more gripper slips configured to radially expand outwardly to make contact with a wellbore casing within which the downhole tool is located to lock the downhole tool in place axially relative to the wellbore casing;

a sealing device comprising:

first and second elastomer seal components disposed on opposite axial sides of the slips/anchors;

first and second expansion devices disposed on opposite axial sides of the slips/anchors, each expansion device configured to radially expand outwardly to compress the elastomer seal components against the wellbore casing;

lower and upper support barriers disposed on opposite axial sides of the slips/anchors between the slips/anchors and a respective expansion device, each support barrier configured to radially expand outwardly against the wellbore; and one or more seal energizing springs configured to maintain an initial setting force of the elastomer seal components against the wellbore casing; and a load retention/equalization mechanism comprising a spool/inflation valve configured to direct fluid into internal volumes within the first and second expansion devices to inflate respective elastomer seal components radially outwardly to create a main setting force of the elastomer seal components against the wellbore casing, wherein the spool/inflation valve directs the fluid into the internal volumes based on a differential pressure between a first volume uphole relative to the downhole tool and a second volume downhole relative to the downhole tool.

* * * * *